US006244583B1

(12) United States Patent
Ohmichi et al.

(10) Patent No.: US 6,244,583 B1
(45) Date of Patent: Jun. 12, 2001

(54) STACK TRANSPORT FOR A SORTER WITH PRESSING DEVICE

(75) Inventors: Yoshiki Ohmichi, Toyokawa; Kazuyuki Tomishige, Toyohashi; Kuniaki Ishiguro, Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/037,012

(22) Filed: Mar. 9, 1998

(30) Foreign Application Priority Data

Mar. 11, 1997 (JP) ..... 9-055706
Mar. 11, 1997 (JP) ..... 9-055707
Mar. 11, 1997 (JP) ..... 9-056116
Mar. 11, 1997 (JP) ..... 9-056120

(51) Int. Cl.[7] ..... B65H 39/00

(52) U.S. Cl. ..... 270/58.09; 270/58.11; 270/58.23; 270/58.07; 271/180; 271/220; 271/221; 414/791; 414/792.7

(58) Field of Search ..... 270/58.01, 58.08, 270/58.09, 58.4, 58.12, 58.13, 58.19, 58.23, 58.07; 414/791, 792.7; 271/217, 220, 221, 222, 178, 180

(56) References Cited

U.S. PATENT DOCUMENTS 4,033,579 * 7/1977 Stange et al. ..... 271/217 X
4,037,832 * 7/1977 Looney ..... 271/173
4,220,325 * 9/1980 Tates et al. ..... 271/293
5,026,034 * 6/1991 Russel et al. ..... 414/792.7 X
5,098,074 * 3/1992 Mandel et al. ..... 270/58.13
5,320,336 * 6/1994 Asami ..... 270/58
5,362,200 * 11/1994 Ushirogata ..... 414/791
5,374,043 12/1994 Mandel et al. .
5,443,248 * 8/1995 Hayashi et al. ..... 270/58.23 X

FOREIGN PATENT DOCUMENTS 59-026857 3/1984 (JP) .

* cited by examiner

*Primary Examiner*—Christopher P. Ellis
*Assistant Examiner*—Patrick Mackey
(74) *Attorney, Agent, or Firm*—McDermott, Will & Emery

(57) ABSTRACT

A sheet handling apparatus which stores sheets ejected from an image forming apparatus in a bin, staples the sheets if necessary, takes the stapled or unstapled set of sheets out of the bin and transports the set of sheets up to a large-capacity tray nipping the set of sheets between rollers of a conveying gate to deliver the set of sheets onto the tray. While the conveyer gate is transporting the set of sheets upward, the set of sheets hangs down from the nipped portion, and the hanging-down portion is guided by a guide plate. A limit is set to the number of stapled sets of sheets which can be stacked on the large-capacity tray, and transportation of stapled sets of sheets to the tray by the conveyer gate over the limit is canceled. When a set of sheets is delivered onto the tray, pressing sticks press sets of sheets which have been stacked on the tray.

16 Claims, 52 Drawing Sheets

(A) BEFORE DRIVING (B) AFTER DRIVING

STACK TRANSPORT FOR A SORTER WITH PRESSING DEVICE

BACKGROUND OF THE INVENTION

1. Field of the Invention

The present invention relates to a sheet handling apparatus, and more particularly to a sheet handling apparatus for sorting and/or stapling sheets which have obtained images in a copying machine or a printer and have been ejected therefrom.

2. Description of Related Art

Conventionally, apparatuses for handling image-formed sheets, which are called finishers, have various functions, such as a function of collating sheets (sorting), a function of grouping sheets by page so that sheets in a group will have the same page (grouping), a function of stapling sheets, a function of punching sheets, etc. Meanwhile, recently, such sheet handling apparatuses have been demanded to have a large capacity. In order to make a sheet handling apparatus have a large capacity, it is required to provide a mechanism for taking sets of sheets which have been sorted and stored in bins therefrom into a large-capacity tray set by set after stapling the sheets or without stapling the sheets.

In such a sheet handling apparatus with a large-capacity tray, when a large number of stapled sets are stacked on the tray, the stack of sheet sets is very voluminous at the stapled portion. Accordingly, the number of stapled sets which can be stacked on the tray is smaller than the number of unstapled sets which can be stacked thereon. However, this point has not been considered in designing a sheet handling apparatus, and such a conventional sheet handling apparatus is likely to have trouble in stacking stapled sets of sheets on a large-capacity tray. In such a conventional apparatus, also, because the stack of stapled sets on the tray is partly voluminous at the stapled portion, the sets stapled on the tray may become out of alignment or may bend.

There has been conventionally a type of sheet handling apparatus which has a large-capacity tray above bins. In this type, the large-capacity tray is also used as a non-sort tray which receives sheets which are not required to be distributed among the bins for sorting or grouping. The large-capacity tray also receives sets of sheets which have been distributed among the bins and transported therefrom by a vertical transporting means. When the transporting means delivers a set of sheets onto the large-capacity tray, there is a possibility that the set of sheets may push a set of sheets which have been previously delivered onto the tray. Especially when unstapled sets of sheets are being stacked on the tray, it is more likely to occur that upper sheets of a previously delivered set are punched, whereby the set will be out of alignment.

When the large-capacity tray is used as a non-sort tray, the transporting means is set on a level high above the surface of the tray so as to secure sufficient capacity of the tray for sheets. However, when sets of sheets are stacked on the tray, if the transporting means is set on this level for delivery of each set to the tray, the sets of sheets may bend.

Further, when stapled sets of sheets are stacked on the tray, the stapled portion of the stack of sets is more voluminous than the other portions, and a set currently delivered to the tray may collide with the stapled portion of the stack.

Also, there has been conventionally a type of sheet handling apparatus which has a large-capacity tray below bins. In this type, each set of sheets is dropped into the tray, and the sheets may be put out of order if the sheets are not stapled. On the other hand, in the type which has a large-capacity tray above the bins and has a mechanism for handling and lifting a set of sheets to the tray, a space for the lifting of a set of sheets is necessary, thereby increasing the size of the apparatus.

Incidentally, in order to take a set of sheets out of a bin, the present inventors have decided to adopt a method wherein the set of sheets is nipped between an upper roller and a lower roller and held up from the bin. However, an upright stopper is provided for each bin at the end portion so that sheets in each bin will be put into alignment, and each stopper has a protruding portion at the end so that sheets will not fall down from each bin even with vibration due to movement of the bin. Therefore, with a mechanism which merely nips a set of sheets between an upper roller and a lower roller and holds it up, it is likely that the set of sheets hits the edge against the stopper or is caught in the protruding portion of the stopper, thereby putting the sheets out of alignment, failing in take-out of the set of sheets and/or damaging the sheets.

SUMMARY OF THE INVENTION

An object of the present invention is to provide an image forming apparatus which can avoid trouble in stacking stapled sets of sheets on a large-capacity tray by setting a limit to the number of stapled sets to be stacked on the tray.

Another object of the present invention is to provide a sheet handling apparatus which can prevent sets of sheets (particularly unstapled sets of sheets) stacked on a large-capacity tray from becoming out of alignment.

Another object of the present invention is to provide a sheet handling apparatus which can stack sets of sheets on a large-capacity tray smoothly.

Further, another object of the present invention is to provide a sheet handling apparatus which has a large-capacity tray above bins so as to take an unstapled set of sheets into the tray keeping the sheets in order and does not require so large a space for the transportation of a set of sheets to the large-capacity tray.

Furthermore, another object of the present invention is to provide a sheet handling apparatus which can nip a set of sheets in a bin between a pair of rollers and takes the set of sheets out of the bin without any trouble.

In order to attain the object above, an image forming apparatus according to the present invention comprises: image forming means which forms an image on a sheet; a plurality of bins among which image-formed sheets are distributed for sorting; stapling means which staples sheets stored in each of the bins; a tray on which stapled sets of sheets are stacked; conveying means which transports a set of sheets from each of the bins to the tray; recognizing means which recognizes the number of sets of sheets to be stacked on the tray; and control means which inhibits the conveying means from transporting sets of sheets when the recognized number is over a specified number.

In the image forming apparatus, the number of stapled sets of sheets which can be stacked on the tray is limited, and transportation/stacking of stapled sets of sheets onto the tray over the limit is canceled. With this control, trouble which may be caused by that the stack of stapled sets on the tray is partly voluminous at the stapled portion can be prevented.

A sheet handling apparatus according to the present invention comprises: a tray which can receive a large number of sheets thereon; a plurality of bins among which sheets are distributed for sorting; conveying means which transports a set of sheets from each of the bins to the tray and delivers the set of sheets onto the tray; and pressing means which presses sets of sheets which have been delivered and stacked on the tray when a set of sheets is being delivered onto the tray.

In the sheet handling apparatus, when a set of sheets is delivered onto the tray by the conveying means, sets of sheets stacked on the tray are pressed by the pressing means. Thereby, it can be prevented that sets of sheets, and unstapled sets of sheets, in particular, stacked on the tray may be pushed forward by a set of sheets which is being delivered onto the tray.

In the sheet handling apparatus, further, the tray has a recess at a portion to receive a stapled portion of a set of sheets, and the pressing means has a plurality of pressing members, one of which is disposed opposite the recess. When stapled sets of sheets are stacked on the tray, the stack is partly voluminous at the stapled portion. However, with the arrangement, the stapled portion is pressed into the recess of the tray, and collision of a set of sheets currently delivered onto the tray with the stapled portion of sets of sheets stacked on the tray can be prevented.

Another sheet handling apparatus according to the present invention comprises: a plurality of bins among which sheets ejected from an image forming apparatus are distributed for sorting; a tray which is disposed above the plurality of bins; and conveying means which transports sheets ejected from the image forming apparatus one by one to the tray and transports a set of sheets from each of the bins to the tray, the conveying means being set on a first level when delivering a sheet onto the tray and set on a second level when delivering a set of sheets onto the tray.

In this sheet handling apparatus, in a non-sort mode wherein sheets are transported from the image forming apparatus directly to the tray one by one, the conveying means is set on the first level. This first level is sufficiently high above the surface of the tray so that the tray can have a sufficient capacity. On the other hand, in a stack mode wherein sets of sheets stored in the bins are transported and stacked onto the tray, the conveying means is set on the second level which is lower than the first level for delivery of each set of sheets onto the tray. In this mode, a set of sheets is dropped onto the tray from a relatively small height and thereby placed on the tray smoothly without bending. Further, by heightening the level of the conveying means for delivery of a set of sheets onto the tray as the volume of sets of sheets stacked on the tray is increasing so that a set of sheets can be dropped onto the stack of sets of sheets on the tray from a constant height at all times, a large number of sets of sheets can be stacked on the tray smoothly.

Another sheet handling apparatus according to the present invention comprises: a plurality of bins among which sheets are distributed for sorting; a tray which is provided above the bins; conveying means which transports a set of sheets from each of the bins up to the tray while holding the set of sheets at an end portion with the set of sheets hanging down from the held portion; and a guide member which guides the hanging-down portion of the set of sheets while the conveying means is transporting the set of sheets upward.

In the sheet handling apparatus, the tray is disposed above the bins, and even unstapled sets of sheets can be held and transported to the tray by the conveying means. Each set of sheets is transported upward by the conveying means while hanging down from the held portion, and during the upward movement, the hanging-down portion is guided by the guide member. Therefore, only a small space is required for the transportation. Further, if stapling means is disposed under the sheet set conveying means and the guide member, a space can be efficiently used for the transportation of a set of sheets and for the stapling means, thereby resulting in downsizing the apparatus.

Further, another sheet handling apparatus according to the present invention comprises: a plurality of bins each of which has a stopper for putting sheets in alignment in the bin; take-out means which takes a set of sheets out of each of the bins keeping the sheets in alignment; and put-away means which, when the take-out means takes a set of sheets out of a bin, puts the set of sheets away from the stopper.

In the sheet handling apparatus, a set of sheets in a bin is put away from the stopper by the put-away means immediately before being taken out of the bin by the take-out means. Therefore, there is no possibility that a set of sheets may hit the edge against the stopper while being taken out of the bin. Also, even if the stopper has a protruding portion. With this arrangement, consequently, a set of sheets can be taken out of a bin by the take-out means without putting the sheets out of alignment, damaging the sheets or any other trouble.

BRIEF DESCRIPTION OF THE DRAWINGS

These and other objects and features of the present invention will be apparent from the following description with reference to the accompanying drawings, in which.

DETAILED DESCRIPTION OF THE PREFERRED EMBODIMENTS

An embodiment of the present invention is described with reference to the accompanying drawings. In the embodiment below, the present invention is applied to a staple-sorter which is connected to an electrophotographic copying machine.

Figure 1:
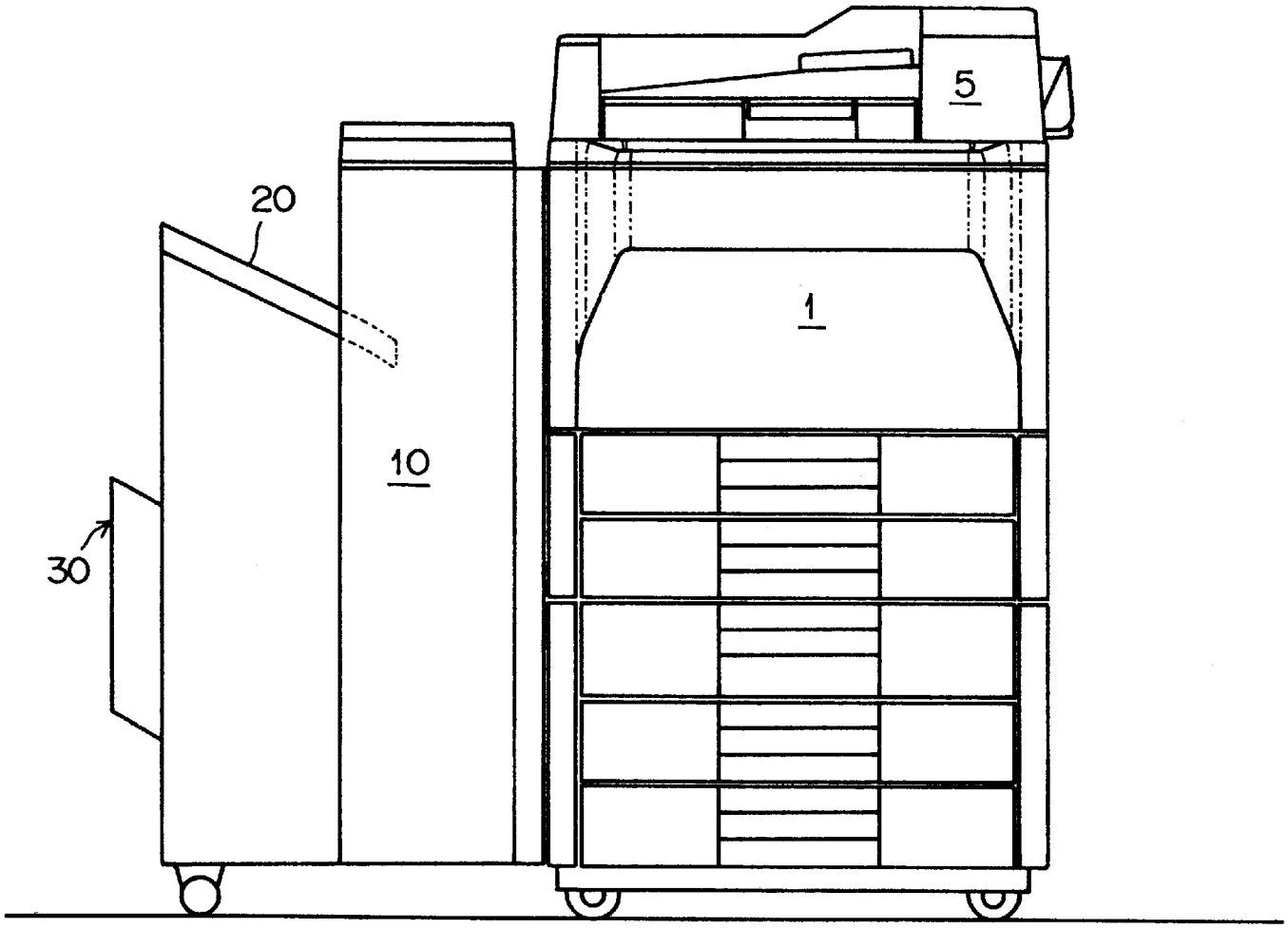
FIG. 1 is a front view of a copying machine and a staple-sorter which is an embodiment of the present invention.

In FIG. 1, the reference numerals 1 and 10 denote an electrophotographic copying machine and a staple-sorter, respectively. The copying machine 1 forms an image on a sheet by a conventional electrophotographic method and has a circulating type automatic document feeder 5 on its top. The automatic document feeder 5 feeds a stack of documents out of a tray one by one onto a platen glass. Then, each document on the platen glass is ejected therefrom and returned onto the tray after being exposed a number of times equal to the number of copies to be made (registered number) specified by the operator. After one circulation, if necessary, the documents are further fed for the second and the third circulation. The automatic document feeder 5 has a function of counting the number of fed documents.

Figure 2:
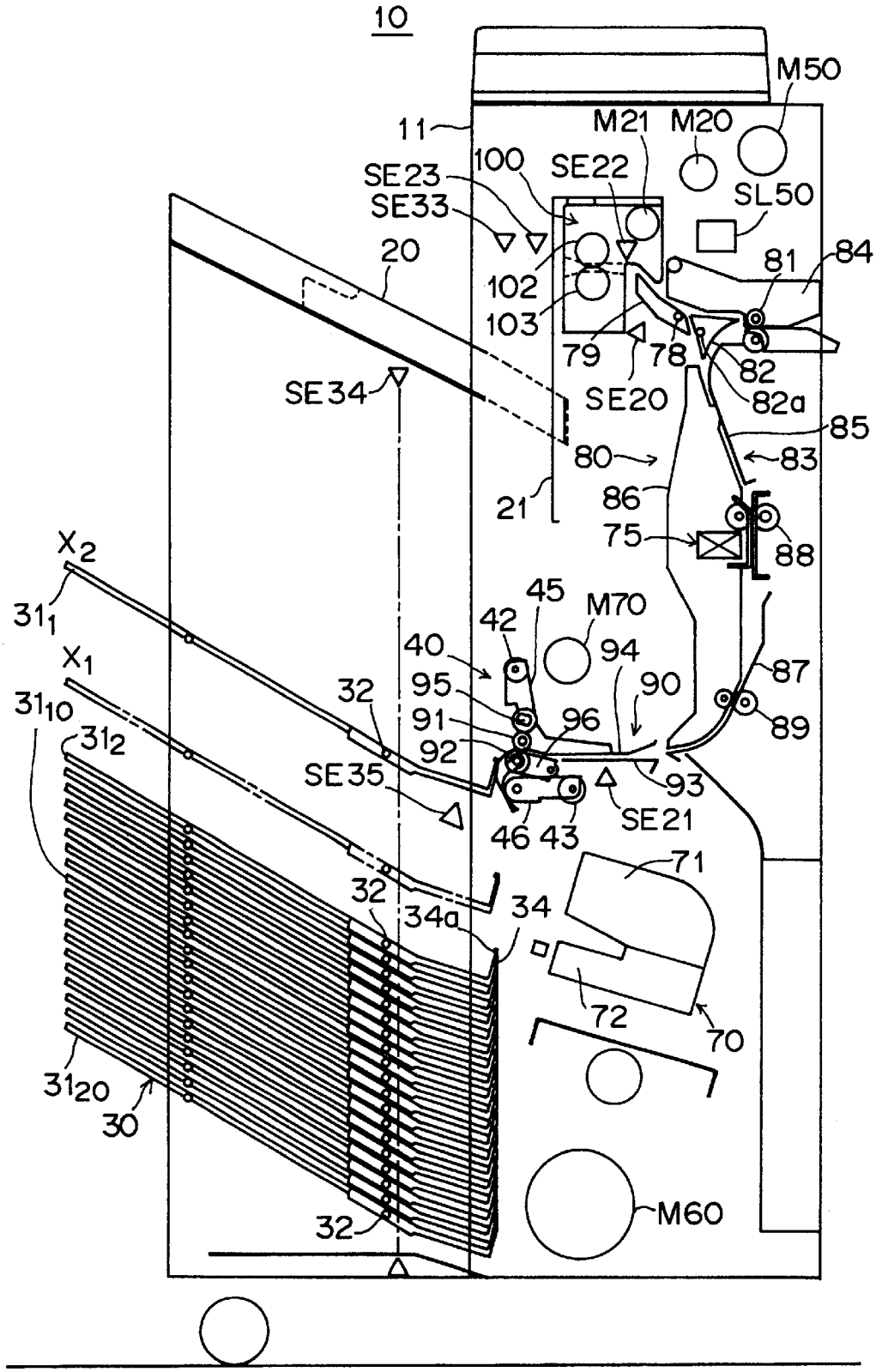
FIG. 2 is an elevational view of the staple-sorter showing the general structure thereof.

FIG. 2 shows the staple-sorter 10. The staple-sorter 10 generally comprises a large-capacity non-sort tray 20, a bin assembly 30 with a stack of twenty bins 31 ($\mathbf{31}_1$ through $\mathbf{31}_{20}$), a take-out unit 40 which takes a set of sheets out of each bin 31, a staple unit 70, a sheet conveyer section 80 and a sheet set conveyer gate 100.

This staple-sorter 10 is capable of handling sheets which have obtained images in the copying machine 1 and have been ejected therefrom in the following modes: a non-sort mode of stacking sheets on the non-sort tray 20 without sorting; a sort mode of distributing sheets among the bins 31 to store each collated set of sheets in each bin 31, a sort/staple mode of stapling each collated set of sheets, a sort/staple/stack mode of taking the collated and stapled sets of sheets out of the respective bins 31 and transporting/stacking the sets of sheets onto the non-sort tray 20; a sort/stack mode of taking the collated sets of sheets out of the respective bins 31 without stapling the sheets, and transporting/stacking the sets of sheets onto the non-sort tray 20; a group mode of distributing sheets among the bins 31 to store sheets with the same page in a bin; a group/staple mode of stapling each set of sheets having the same page; a group/staple/stack mode of taking the stapled sets of sheets, the sheets in each set having the same page, out of the respective bins 31 and transporting/stacking the sets of sheets onto the non-sort tray 20; and a group/stack mode of taking the sets of sheets, the sheets in each set having the same page, out of the respective bins 31 without stapling the sheets, and transporting/stacking the sets of sheets onto the non-sort tray 20.

Next, the internal structure of the staple-sorter 10 is described.

The sheet conveyer section 80 comprises a pair of receiving rollers 81 for receiving a sheet ejected from the copying machine 1, a diverter 82 for switching the direction in which the sheet is to be conveyed, a first conveyer section 83 which extends substantially vertically, a second conveyer section 90 which extends substantially horizontally from the first conveyer section 83 toward the bin assembly 30. The diverter 82 is so mounted as to pivot on a pin 82*a* with turning-on and turning-off of a solenoid SL50. The diverter 82 is in a position shown by the solid line in FIG. 2 while the solenoid SL 50 is off. In this state, a sheet received by the receiving rollers 81 is guided by a curved surface on the right side of the diverter 82 into the first conveyer section 83. When the solenoid SL 50 is turned on, the diverter 82 pivots clockwise slightly. In this state, a sheet received by the receiving rollers 81 is guided by the upper surface of the diverter 82 and a guide plate 79 and is transported to the non-sort tray 20 through the sheet set conveyer gate 100 as described below.

The first conveyer section 83 comprises guide plates 84, 85, 86 and 87, and pairs of transport rollers 88 and 89. A punch unit 75 for punching a sheet at its leading portion or trailing portion is provided in the middle of the first conveyer section 83. The detailed description of the punch unit 75 is omitted.

The second conveyer section 90 comprises a pair of transport rollers 91 and 92 and guide plates 93 and 94. The guide plate 94 is fitted to a side wall 93*a* of the guide plate 93 (see FIGS. 3 and 4), and the transport roller 91 is fitted to an end of the guide plate 94. The second conveyer section 90 is capable of pivoting approximately 90 degrees in the direction of arrow "a" on a shaft 95. The other transport roller 92 is fitted to a frame 96 via a shaft 97. In the sort mode and in the group mode, the second conveyer section 90 is set in a position shown by the solid line in FIGS. 2 and 3 so as to convey sheets sent from the first conveyer section 83 to the bins 31 with the transport rollers 91 and 92. At a time of taking sets of sheets out of the bins 31, which will be described later, the second conveyer section 90 pivots approximately 90 degrees in the direction of arrow "a" and comes to an upright position to retreat from the sheet conveying position.

The second conveyer section 90 is also provided with a sensor 21 for detecting a sheet being delivered into each bin 31 and a set of sheets being taken out of the bin 31. The pairs of rollers 81, 88, 89, 91 and 92, and take-out rollers 42 and 45, which will be described later, are driven to rotate by a motor M50 via a transmission system (not shown).

The bin assembly 30 comprises a stack of twenty bins 31, through $\mathbf{31}_{20}$, and the bins 31 are disposed at uniform intervals with an inclination. A pin 32 provided at the lower end of each bin 31 is in engagement with a spiral groove formed on the circumference of a vertical drive shaft (not shown). The drive shaft is rotated in forward/reverse directions by a motor M60, and one revolution of the drive shaft elevates or lowers the bins 31 by one pitch. When the bin assembly 30 is in its lowest position (home position) shown by the solid line in FIG. 2, the first bin $\mathbf{31}_1$ faces the transport rollers 91 and 92. The level where a bin 31 faces the transport rollers 91 and 92 is hereinafter referred to as level $X_2$. With one reverse revolution of the drive shaft, the first bin $\mathbf{31}_1$ is lowered from the level $X_2$ to a level $X_1$ where the bin $\mathbf{31}_1$ faces the staple unit 70. On this level $X_1$, sheets in the first bin $\mathbf{31}_1$ are stapled. Then, with one forward revolution of the drive shaft, the first bin $\mathbf{31}_1$ is lifted to the level $X_2$, where the stapled set of sheets is taken out of the bin $\mathbf{31}_1$. Simultaneously, the lower bins $\mathbf{31}_2$ through $\mathbf{31}_{20}$ are lifted by one pitch, and the second bin $\mathbf{31}_2$ is set on the level $X_1$. When a bin 31 is set on the level $X_1$ or the level $X_2$, the bin is put at a larger interval from the next bin than the intervals among the other bins. This change in the intervals among the bins 31 can be realized by providing a change in the pitch of the spiral groove formed on the circumference of the drive shaft.

In this embodiment, both delivery of a sheet into a bin 31 and take-out of a set of sheets from a bin 31 are carried out on the level $X_2$, which contributes to simplification of the sorter section.

The bin assembly 30 has a sensor which detects that the bin assembly 30 is in the home position and a sensor which detects that the bins 31 have been lifted by one pitch with one revolution of the drive shaft, although they are not shown in the drawings. Also, a transmission sensor SE34 is provided to detect the presence or absence of sheets in each bin 31. Further, a sensor SE35 is provided to detect the presence or absence of sheets in a bin 31 set on the level $X_2$. If the sensor SE35 does not detect any sheets in a bin 31 on the level $X_2$ (for example, in a case that the operator has taken sheets out of the bin 31), the take-out process from the bin 31 and the transport/stack process onto the non-sort tray 20 are cancelled, and immediately, the operation proceeds to a take-out process from the next bin 31.

Now, the staple unit 70 is described. The staple unit 70, which is a conventional electrical one, comprises a head 71 where a cartridge containing staples can be attached and detached and an anvil 72 which receives and bends a staple struck out from the head 71. The staple unit 70 moves toward a bin 31 set on the level $X_1$ and staples sheets in the bin 31 at one point on a corner or at two points in the center (see FIG. 13*b*). The staple unit 70 is initially in its home position at the front side of the staple-sorter 10 and is movable toward the rear side. The staple unit 70 moves toward the bin 31 (toward the rear side) and stops at a specified position to staple the sheets in the bin 31, and then, the staple unit 70 returns to the home position. Each bin 31 has cutouts on its bottom at staple positions, so that the end of the staple unit 70 can enter each bin 31.

Next, the take-out unit 40 is described.

Figure 3:
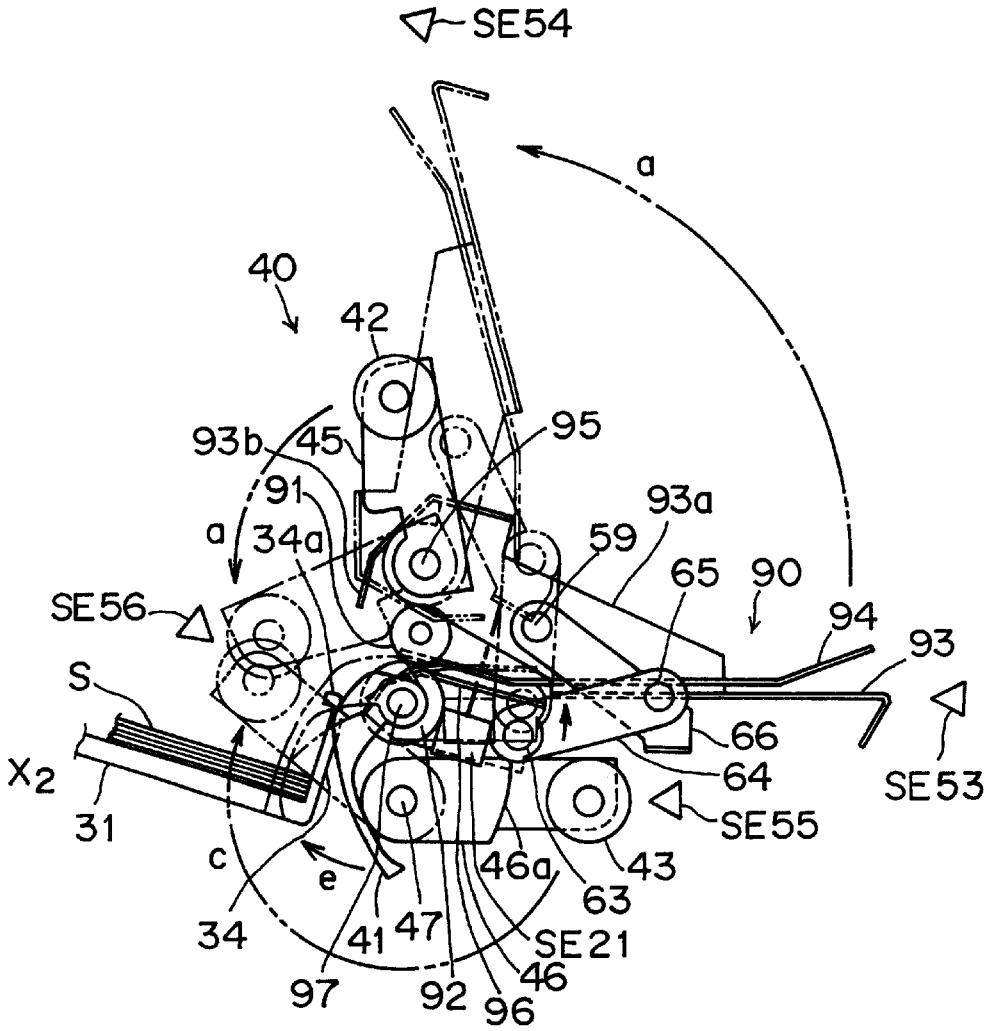
FIG. 3 is a front view of a second conveyer section and a take-out unit in the staple-sorter, showing a time of delivering a sheet into a bin.
Figure 4:
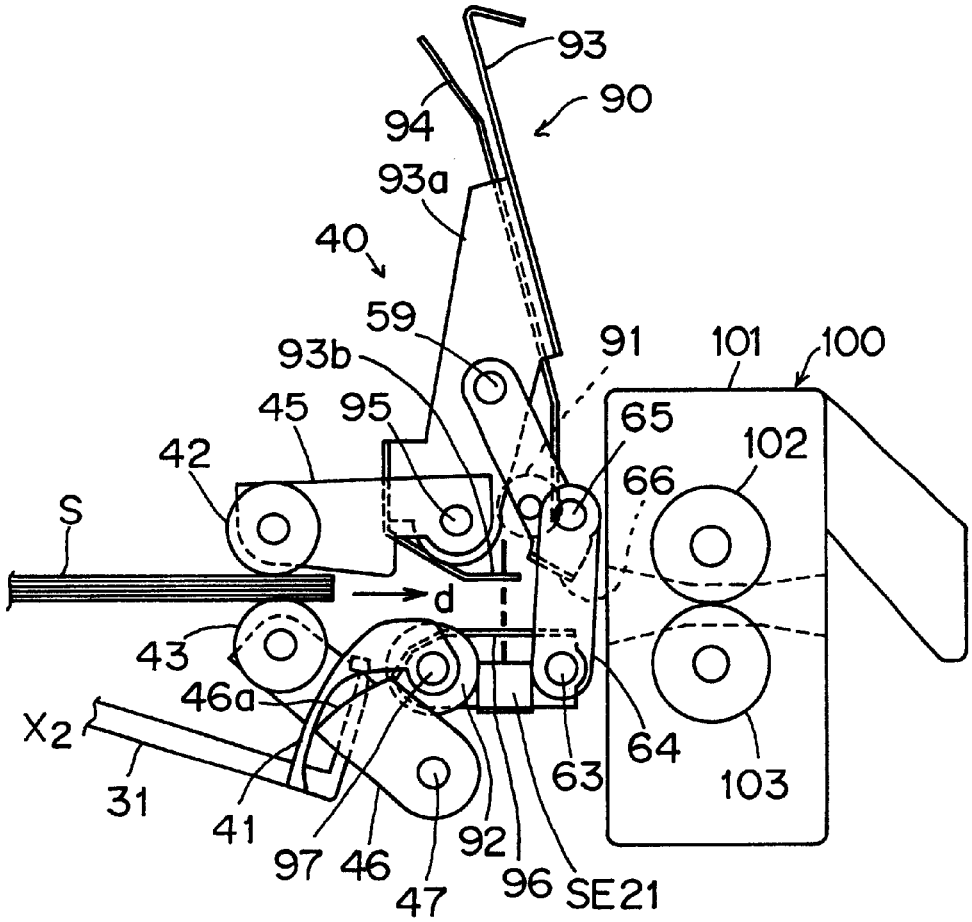
FIG. 4 is a front view of the second conveyer section and the take-out unit, showing a time of taking a set of sheets out of a bin.

The take-out unit 40 is to grab a set of sheets in a bin 31 set on the level $X_2$ and take the set of sheets out of the bin 31. As shown in FIGS. 3 and 4, the take-out unit 40 has a push-away lever 41 which pushes sheets stored in a bin 31 away from a stopper 34 of the bin 31, a lower roller 43 which holds up the sheets and an upper roller 42 which provides pressure to the sheets from the above. The upper roller 42 is fitted to an upper arm 45 which is pivoted on the shaft 95, and the lower roller 43 is fitted to a lower arm 46 which is pivoted on the shaft 47.

Figure 5:
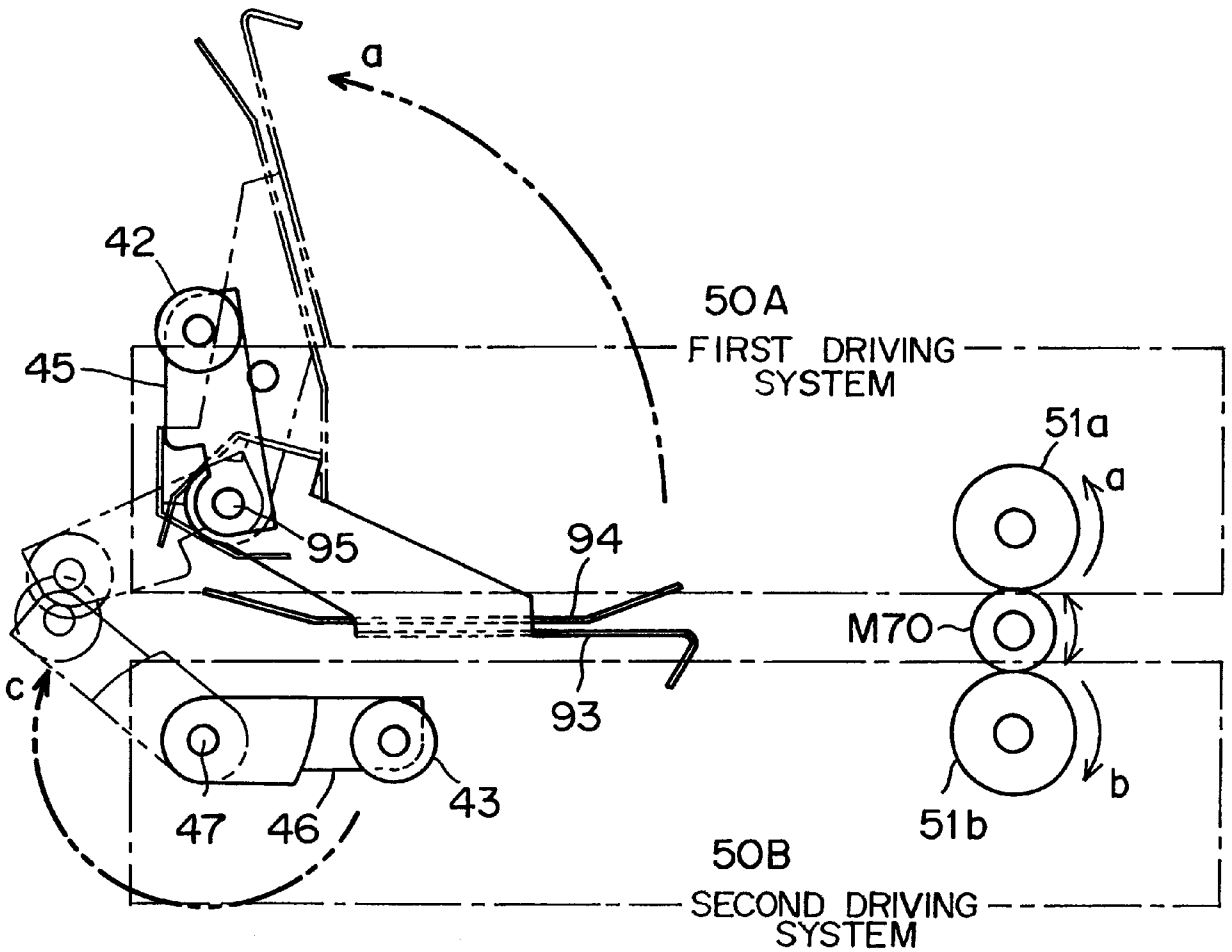
FIG. 5 is a schematic view of a driving system of the take-out unit.

The take-out unit 40 and the second conveyer section 90, as shown in FIG. 5, are moved by a reversible motor M70 via a first driving system 50A and a second driving system 50B respectively. The first driving system 50A moves the second conveyer section 90 and the upper arm 45, and the second driving system 50B moves the lower arm 46. Each of the driving systems 50A and 50B has a one-way mechanism (not shown), so that forward rotation and reverse rotation of the motor M70 actuate the first driving system 50A and the second driving system 50B respectively.

Figure 6:
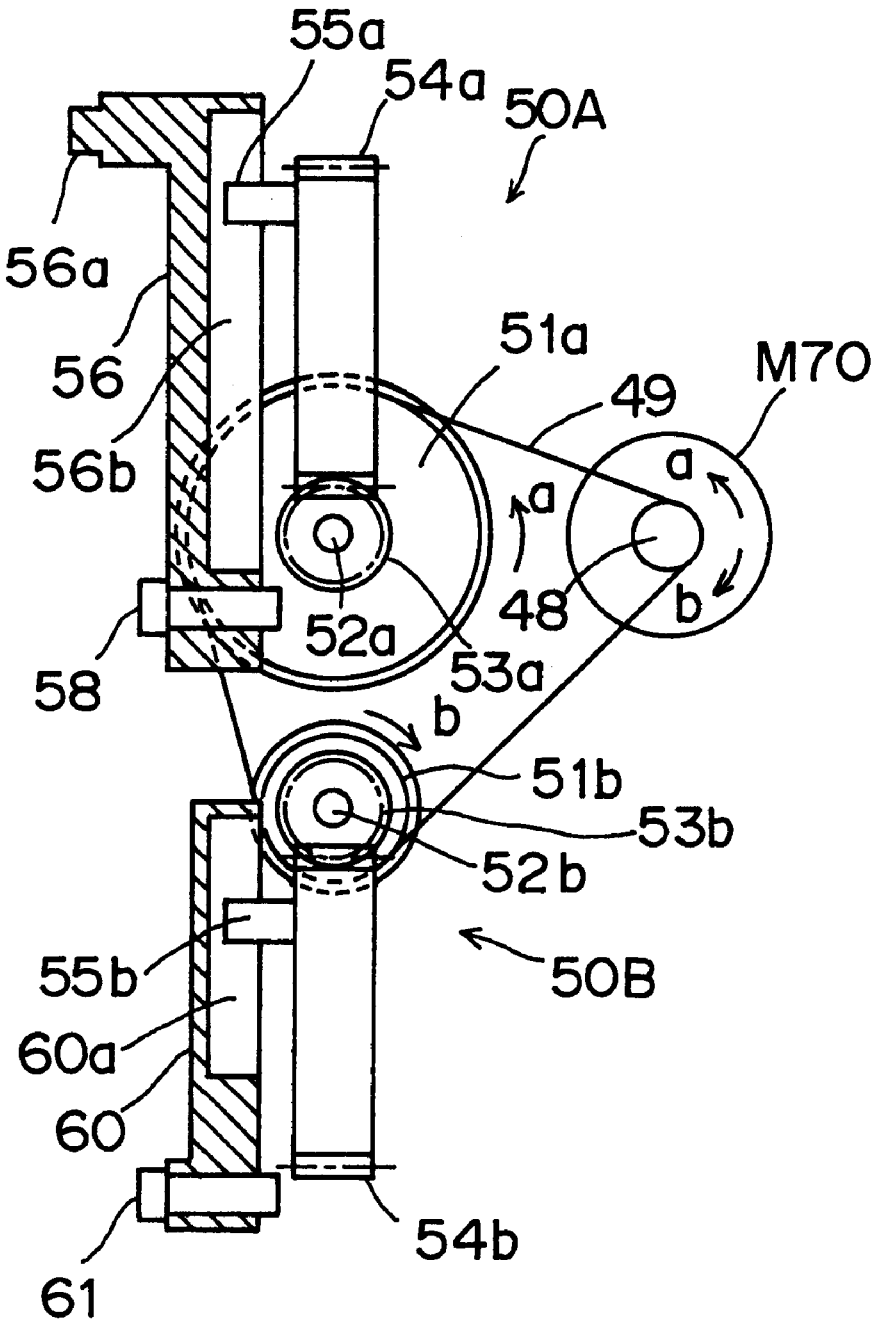
FIG. 6 is a sectional view of the driving system.
Figure 7:
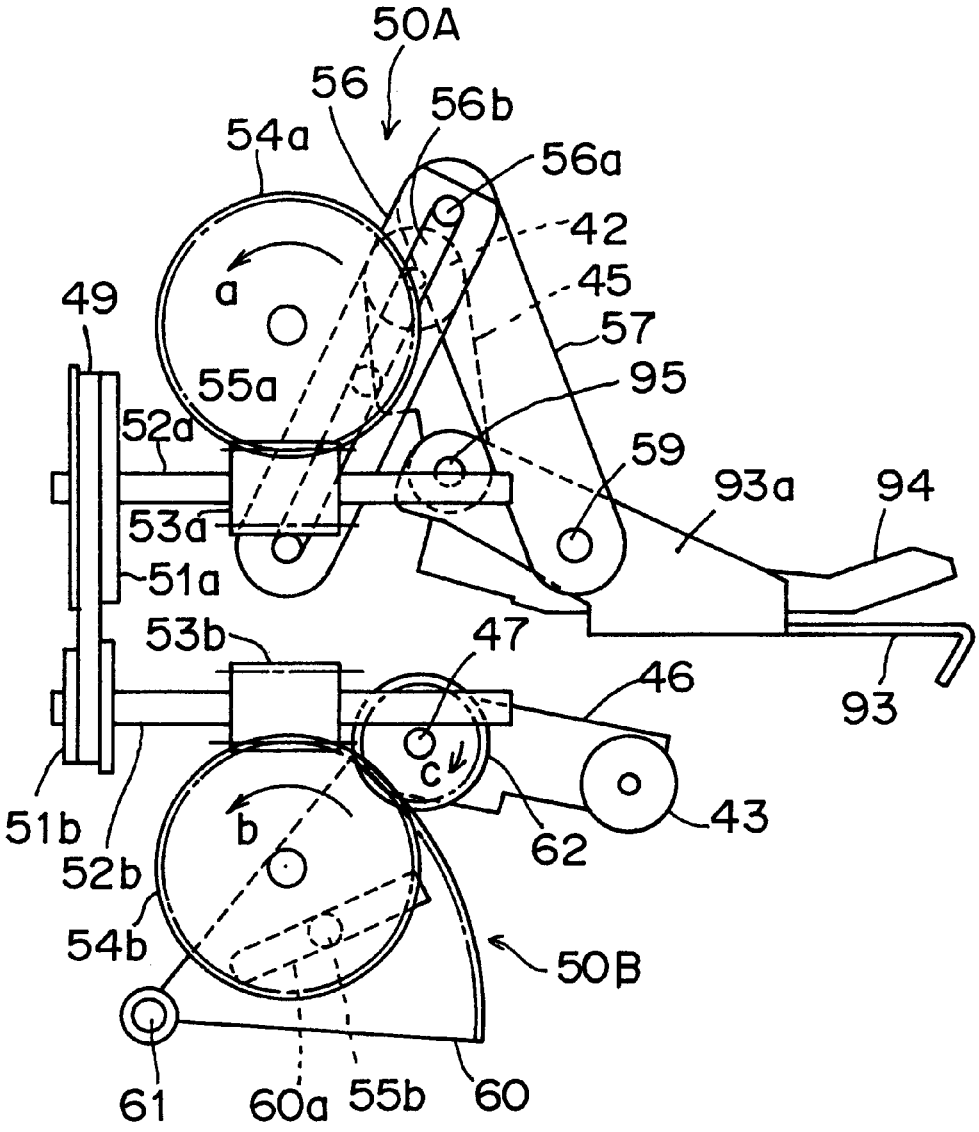
FIG. 7 is a front view of the driving system, showing a time of delivering a sheet into a bin.
Figure 8:
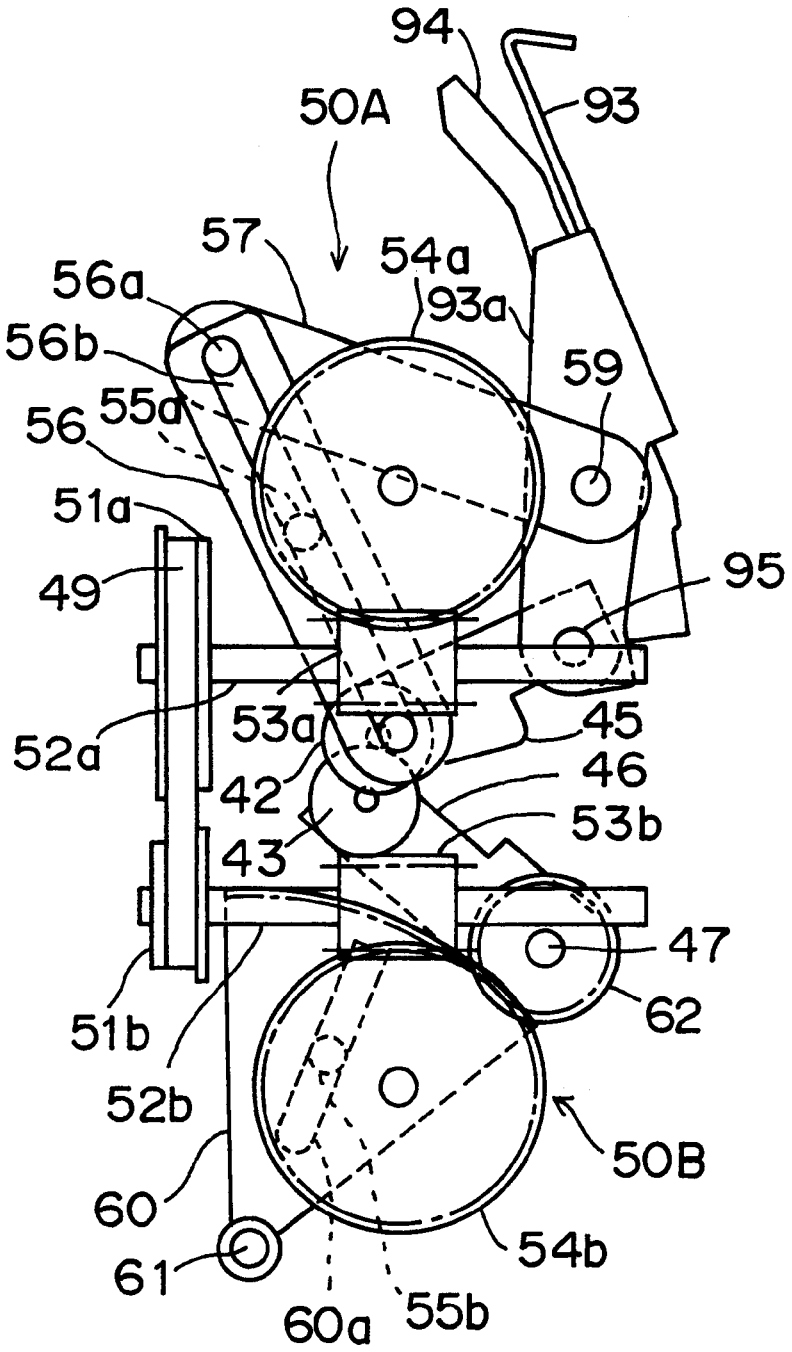
FIG. 8 is a front view of the driving system, showing a time of taking a set of sheets out of a bin.

More specifically, as FIGS. 6, 7 and 8 show, a belt 49 is stretched among an output pulley 48 of the motor M70 and one-way pulleys 51*a* and 51*b*. In the first driving system 50A, a worm gear 53*a*, which is fixed to a shaft 52*a* of the one-way pulley 51*a*, is in engagement with a worm wheel 54*a*. In the second driving system 50B, a worm gear 53*b*, which is fixed to a shaft 52*b* of the one-way pulley 51*b*, is in engagement with a worm wheel 54*b*.

Further, the first driving system 50A has levers 56 and 57 which are connected to each other by a boss 56*a*. The lever 56 is capable of pivoting on a shaft 58, and a pin 55*a* standing on the worm wheel 54*a* is in engagement with a groove 56*b* formed on the lever 56. The end of the other lever 57 is connected to a side wall 93*a* of the guide plate 93 via a pin 59. With forward rotation (in the direction of arrow "a") of the motor M70, the worm wheel 54*a* rotates in the direction of arrow "a" in FIG. 7, and the lever 56 pivots on the shaft 58 in the direction of arrow "a". Accordingly, the lever 57 and the second conveyer section 90 (the guide plates 93 and 94) pivot on the shaft 95 in the direction of arrow "a" (see FIG. 8). Simultaneously, the upper arm 45 pivots on the shaft 95 in the direction of arrow "a", and the upper roller 45 comes down onto a set of sheets S in a bin 31 set on the level $X_2$.

The second driving system 50B has a sector gear 60 which is capable of pivoting on a shaft 61. The sector gear 60 is in engagement with a gear 62, and the gear 62 is fitted to the lower arm 46 via a shaft 47. A pin 55*b* standing on the worm wheel 54*b* is in engagement with a groove 60*a* formed on the sector gear 60. With reverse rotation (in the direction of arrow "b") of the motor M70, the worm wheel 54*b* rotates in the direction of arrow "b", and the sector gear 60 pivots on the shaft 61 in the direction of arrow "b". Accordingly, the gear 62 rotates in the direction of arrow "c".

Simultaneously, the lower arm 46 pivots on the shaft 47 in the direction of arrow "c" (see FIG. 3), and the lower roller 43 comes to the set of sheets S in the bin 31 set on the level $X_2$ and holds up the set of sheets S.

With further forward or reverse rotation of the motor M70, the worm wheel 54*a* or 54*b* further rotates in the direction of arrow "a" or in the direction of arrow "b", and thus, the second conveyer section 90 and the upper roller 42, or the lower roller 43 return(s) from the position for take-out of sets of sheets from the bins 31 shown in FIG. 4 to the position for delivery of sheets into the bins 31 shown in FIG. 3.

As FIG. 3 shows, the guide plates 93 and 94 and the frame 96 of the second conveyer section 90 form a sheet transport path at a time of sheet delivery to the bins 31 in the sort mode and the group mode. The frame 96 is connected to a lever 64 via a pin 63, and the lever 64 is connected to a guide plate 66 via a pin 65. Further, the guide plate 66 is connected to the pin 59. Accordingly, when the second conveyer section 90 comes upright at a time of sheet set take-out from the bins 31, as shown in FIG. 4, a protruding portion 93*b* of the guide plate 93, the frame 96 and the guide plate 66 form a sheet transport path. At this time, the transport roller 91 comes upward to retreat from the sheet transport path.

As shown in FIG. 3, a sensor SE53 detects that the second conveyer section 90 is set in the position for sheet delivery to the bins 31, and a sensor SE54 detects that the second conveyer section 90 comes upright to the position for sheet set take-out from the bins 31. Also, a sensor SE55 detects that the lower arm 46 is in the retreating position, and a sensor SE56 detects that the lower arm 46 comes to the position to hold up a set of sheets.

Each of the bins 31 is provided with a stopper 34 at the lower end, and each stopper 34 has a protrusion 34*a* for preventing sheets from falling down from the bin 31 due to vibration caused by the upward/downward movement of the bins 31 (see FIGS. 2 and 3). Therefore, when the lower roller 43 holds up a set of sheets from a bin 31 for take-out of the set of sheets, it is necessary to prevent the edge of the set of sheets from scraping against the stopper 34 and from being caught in the protrusion 34*a*. For this purpose, the push-away lever 41 pushes the set of sheets slightly away from the stopper 34. This push-away lever 41 is capable of pivoting on the shaft 97 of the transport roller 92. The lever 41 hangs down by its own weight and leans on the lower arm 46. With rotation of the lower arm 46 in the direction of arrow "c" for sheet set take-out, a cam surface 46*a* formed on the lower arm 46 pushes the lever 41. Thereby, the lever 41 pivots on the shaft 97 in the direction of arrow "e" and pushes the set of sheets on the bin 31 away from the stopper 34. Each of the bins 31 has cutouts on the bottom so that the push-away lever 41, the lower roller 42 and the lower arm 46 can enter the bins 31 through the cutouts.

While the second conveyer section 90 is in the position for sheet delivery to the bins 31, the upper arm 45 holding the upper roller 42 is upright supported by a protruding portion 93*b* of the guide plate 93. When the second conveyer section 90 pivots in the direction of arrow "a" to move to the position for sheet set take-out from the bins 31, the protruding portion 93*b* releases the upper arm 45, and the upper arm 45 pivots on the shaft 95 in the direction arrow "a" to a position shown by the two-dot chain line in FIGS. 3 and 5 by its own weight. When the lower roller 43 holds up the set of sheets S from the bin 31, the upper roller 42 comes into contact with the set of sheets S from the above, and thus, the set of sheets S is nipped between the rollers 42 and 43. Then, with rotation of the rollers 42 and 43, the set of sheets S is taken out of the bin 31 in the direction of arrow "d" in FIG. 4. Thereafter, the set of sheets S is received by rollers 102 and 103 of the sheet set conveyer gate 100 which has been lowered to a take-out position.

Figure 9A:
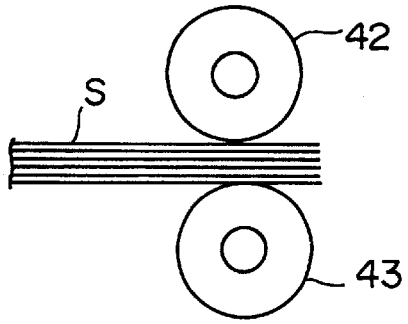
FIGS. 9*a* and 9*b* are illustrations which show a set of sheets being taken out of a bin.
Figure 9B:
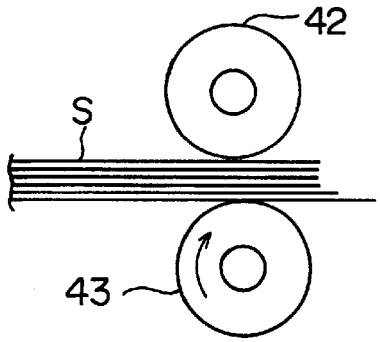
Figure 10:
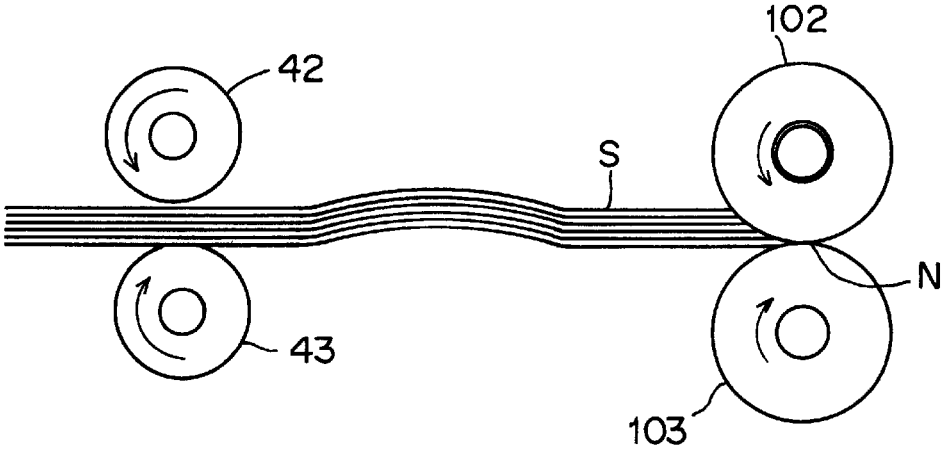
FIG. 10 is an illustration which shows a set of sheets being taken out of a bin.

During the transportation of the set of sheets S from the take-out rollers 42 and 43 to the gate rollers 102 and 103, if the sheets S are not stapled, the sheets S may become out of alignment when the rotation of the take-out rollers 42 and 43 is started or when the sheets S come between the gate rollers 102 and 103. More specifically, in the state that the set of sheets S is nipped between the rollers 42 and 43 as shown in FIG. 9*a*, when a driving force is applied to the lower roller 43, all the sheets S cannot follow the acceleration of the transporting speed applied from the lower roller 43, and the lower sheets are fed ahead from the upper sheets as shown in FIG. 9*b*. Also, when the leading edge of the set of sheets S comes between the gate rollers 102 and 103, the sheets near the nip portion are fed ahead.

In order to avoid the trouble, at least the following measures must be taken: (1) setting the transporting speed (circumferential speed) of the gate rollers 102 and 103 higher than that of the take-out rollers 42 and 43; (2) using a material with a low coefficient of friction for the take-out rollers 42 and 43; and (3) setting the nipping force of the take-out rollers 42 and 43 larger than that of the gate rollers 102 and 103.

Specifically, the take-out rollers 42 and 43 are made of silicone rubber (its coefficient of friction is 0.3), and the gate rollers 102 and 103 are made of EPDM (ethylene-propylene-diene-methylene rubber) (its coefficient of friction is 1.1). The take-out rollers 42 and 43 have a nipping force of approximately 350 gf, and the gate rollers 102 and 103 have a nipping force of approximately 100 gf. The transporting speed of the take-out rollers 42 and 43 is approximately 350 mm/sec, and that of the gate rollers 102 and 103 is approximately 450 mm/sec. These values are only examples.

Next, the sheet set conveyer gate 100 is described.

Figure 11:
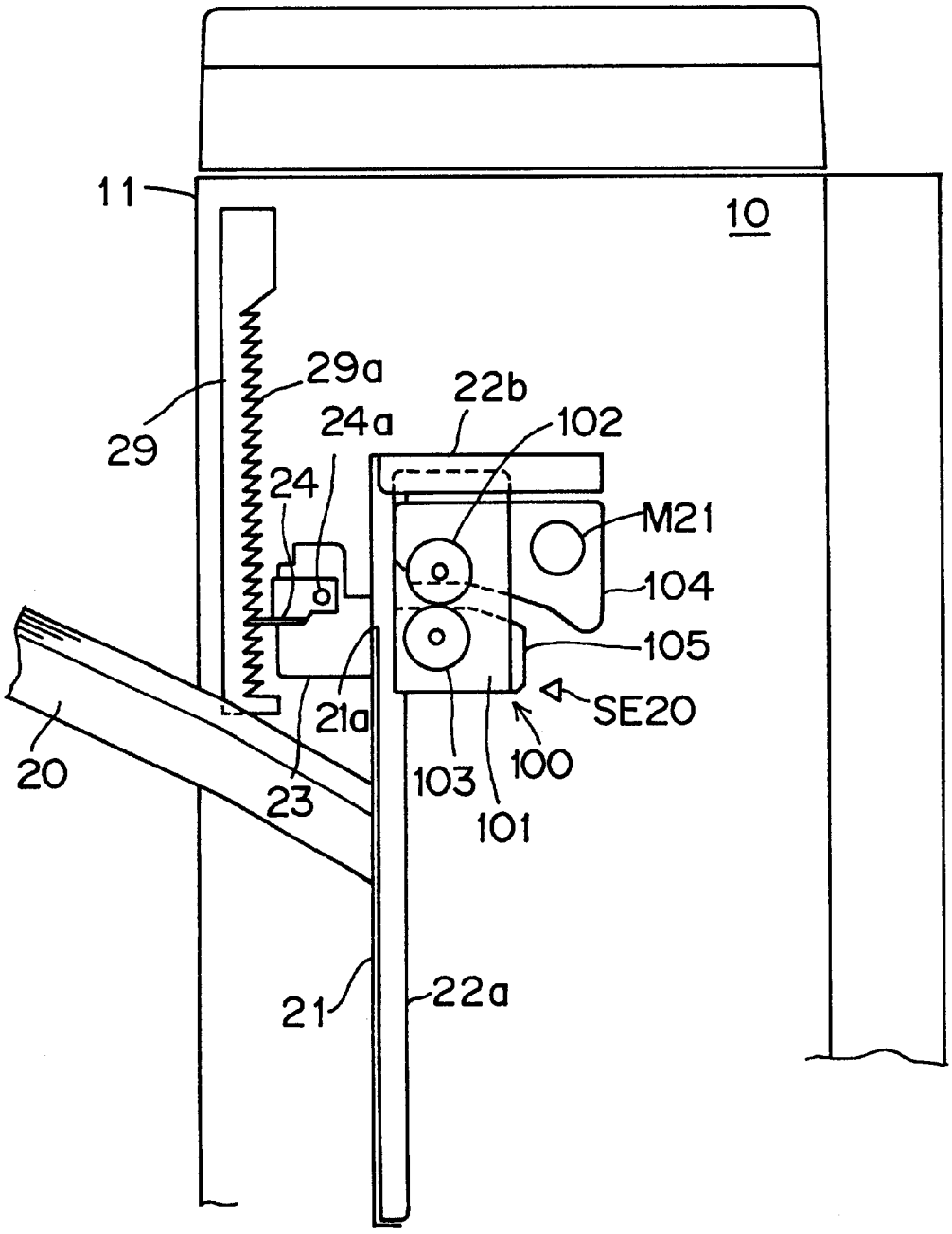
FIG. 11 is an elevational view of the upper portion of the staple-sorter, showing a home position of a sheet set conveyer gate.

The sheet set conveyer gate 100, as shown in FIGS. 2 and 11, has a pair of gate rollers 102 and 103 and guide plates 104 and 105 in a box 101. The rollers 102 and 103 are driven to rotate forward and in reverse by a motor M21. The sheet set conveyer gate 100 is movable up and down along a guide member (not shown), and the driving source of this vertical movement is a motor M20. The sheet set conveyer gate 100 is initially in a home position shown by the solid line in FIG. 2, and in this home position, the gate 100 transports sheets which have been sent from the receiving rollers 81 and guided by the upper surface of the diverter 82 to the left in FIG. 2 and conveys the sheets onto the non-sort tray 20 with rotation of the rollers 102 and 103.

Figure 13A:
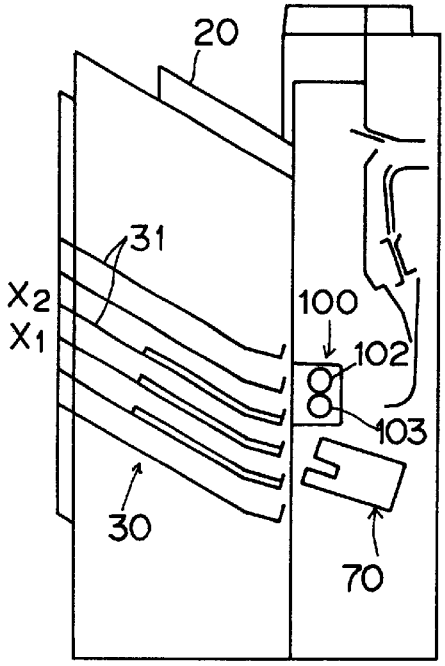
FIGS. 13*a* through 13*f* are illustrations which show the operation of the staple-sorter for stapling/take-out/stacking of a set of sheets.
Figure 13B:
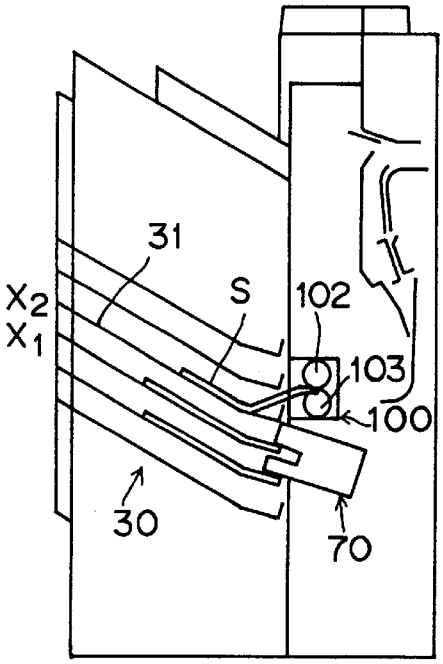
Figure 13C:
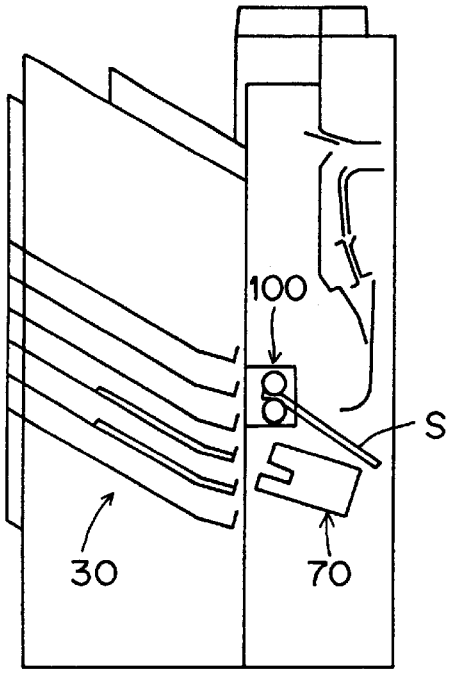

Also, the sheet set conveyer gate 100 moves down to a take-out position around the level $X_2$ to receive a stapled or unstapled set of sheets from a bin 31 set on the level $X_2$ (see FIG. 13*a*). In the take-out position, the gate 100 nips the set of sheets S which has been taken out of the bin 31 by the take-out rollers 42 and 43 with the rollers 102 and 103 (see FIG. 13*b*) and takes the set S inside with forward rotation of the rollers 102 and 103 (see FIG. 13*c*). When the set of sheets S are taken in the gate 100 completely, the forward rotation of the rollers 102 and 103 is stopped, and the gate 100 moves upward (see FIG. 13*d*). The gate 100 comes up to a specified level (delivering position), the rollers 102 and 103 are rotated in reverse to discharge the set of sheets S onto the non-sort tray 20 (FIG. 13*e*). Then, the gate 100 moves down to the take-out position again (see FIG. 13*f*) to repeat this transport/stack process.

Figure 13D:
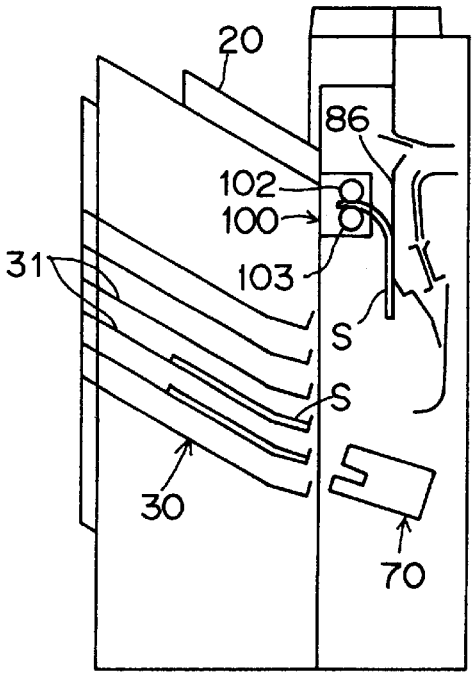
Figure 13E:
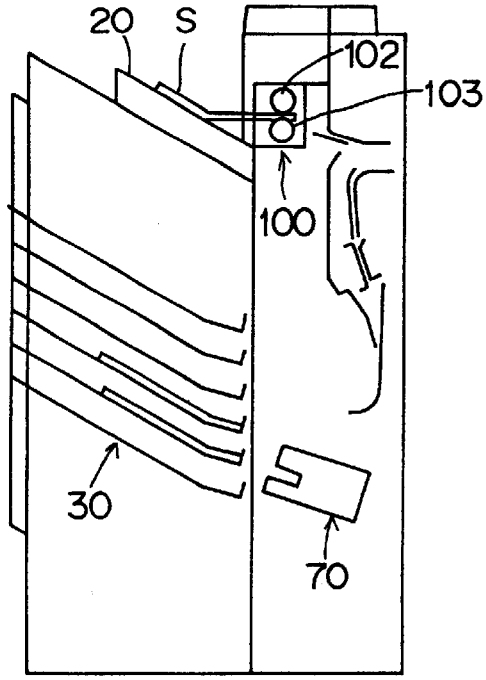
Figure 13F:
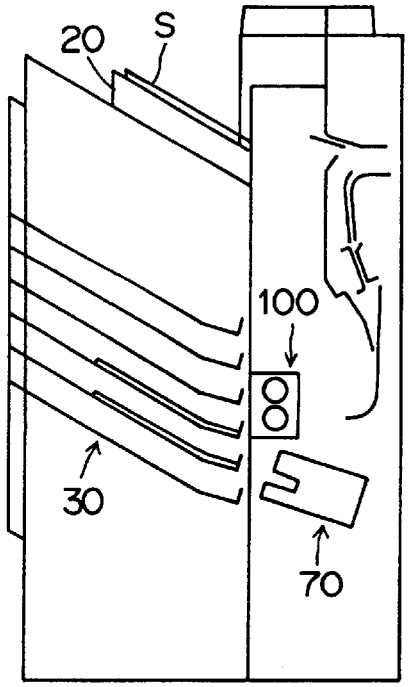

As FIG. 13*d* shows, while the set of sheets S is transported upward nipped between the rollers 102 and 103, the set of sheets S hangs down, and the hanging-down portion of the set S is guided by the guide plate 86. With this arrangement, only a small space is necessary for the upward transportation of the set of sheets S, which is an efficient usage of the internal space of the sorter 10. Further, by locating the staple unit 70 under the gate 100 and the guide plate 86, the space for the upward transportation of a set of sheets and the space for the staple unit 70 can be saved.

In this embodiment, a set of sheets stored in a bin 31 is stapled at the trailing portion with respect to the direction of sheet delivery to the bin 31, and the stapled set of sheets is lifted by the gate 100 with the leading portion with respect to the direction of sheet delivery to the bin 31 nipped between the rollers 102 and 103. Then, when the stapled set of sheets is delivered to the non-sort tray 20, the leading portion with respect to the direction of sheet delivery to the bin 31 (unstapled portion) first enters the non-sort tray 20. Accordingly, stapled sets of sheets are stored in the non-sort tray 20 with the stapled portions at the lower portion of the tray 20. Therefore, there is no possibility that the leading edge of a stapled set of sheets which is being delivered to the non-sort tray may be caught by the stapled portion of the previously delivered set, and thus, stacking of stapled sets of sheets on the non-sort tray can be carried out smoothly.

The sheet set conveyer gate 100 functions as a path of a sheet to the non-sort tray 20 and also as a path of a set of sheets to the tray 20. Therefore, the guide plates 104 and 105 are disposed at an interval which is sufficient to allow a set of sheets to pass through. The movable guide plate 79 of the first conveyer section 83 is pushed up by a set of sheets S which has been lifted by the gate 100, and the guide plate 79 pivots upward on the shaft 78.

Figure 14:
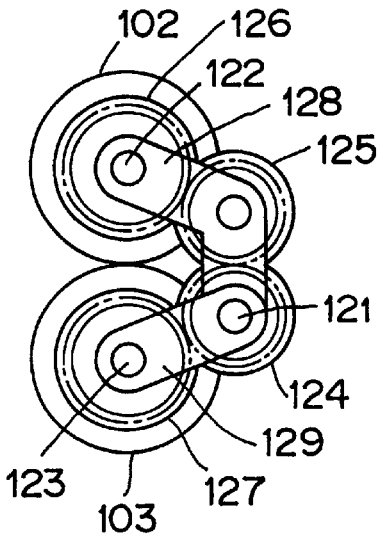
FIG. 14 is a side view of gate rollers.
Figure 15:
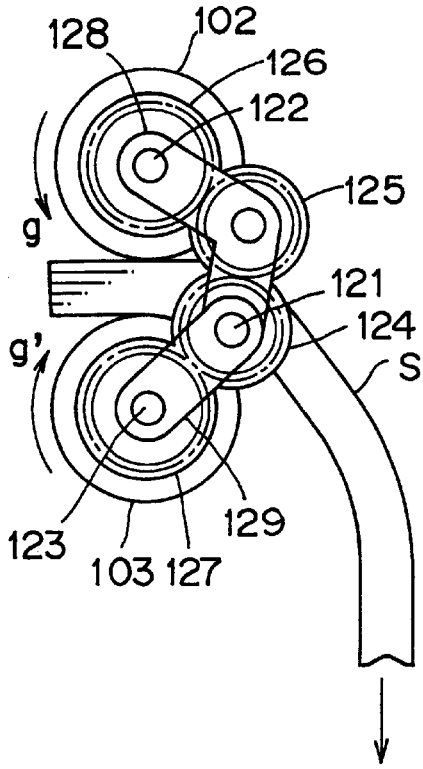
FIG. 15 is an illustration which shows operation of the gate rollers.

As FIG. 14 shows, a driving force is transmitted from a gear 124 to the gate roller 102 via gears 125 and 126 and to the gate roller 103 via a gear 127. A link 128 which holds the roller 102 and a link 129 which holds the roller 103 are connected via a shaft 121 which supports the gear 124. Therefore, when the rollers 102 and 103 nip a set of sheets, the links 128 and 129 pivot on the shaft 121, so that the rollers 102 and 103 separate from each other at a distance in accordance with the thickness of the set of sheets. When the set of sheets S hangs down in the right of the rollers 102 and 103 as shown in FIG. 15, the transmission of the driving force to the rollers 102 and 103 is stopped. (This is the time to start the upward transportation of the set of sheets S from the take-out position to the non-sort tray 20.) In this state, because of the weight of the set of sheets S, the rollers 102 and 103 are provided with forces to rotate in the directions of arrow "g" and arrow "g" respectively. At this time, the links 128 and 129 are provided with forces to pivot on the shaft 121 downward and upward respectively, and with these forces, the rollers 102 and 103 can nip the set of sheets S more strongly. Thereby, a slip of the set of sheets S while being transported upward can be prevented, and especially if the set of sheets S is not stapled, it is efficiently prevented that the sheets S may become out of alignment or slip down from the rollers 102 and 103.

Figure 16:
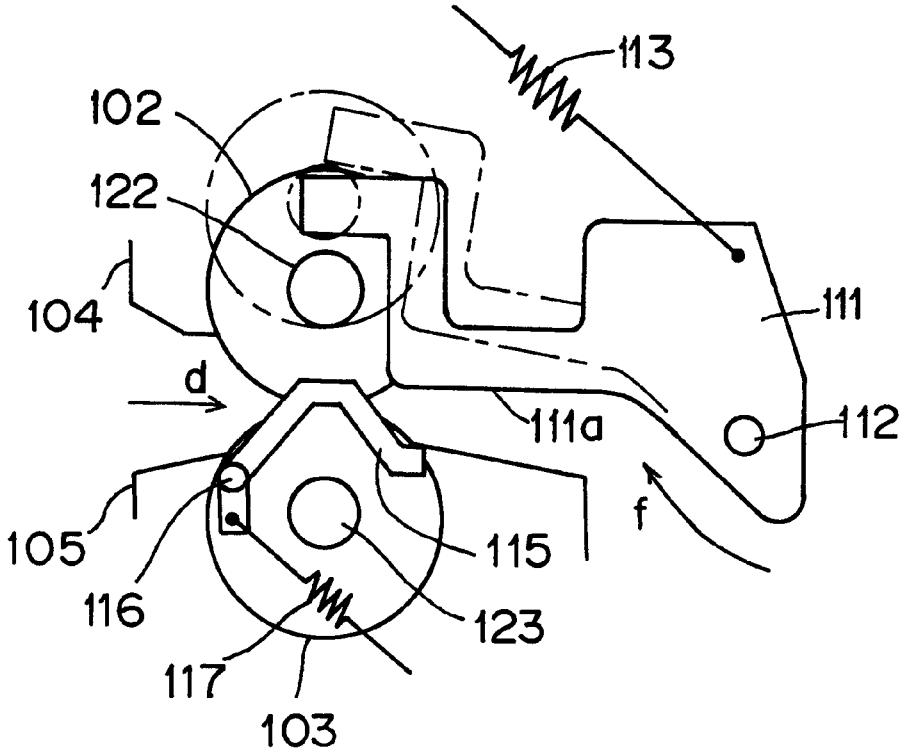
FIG. 16 is a side view of guide plates attached to the gate rollers.

The rollers 102 and 103 are capable of separating from each other and coming closer to each other as described above. Further, as FIG. 16 shows, a guide plate 111 extends between wheels of the upper roller 102, and a guide plate 115 is provided between wheels of the lower roller 103. The guide plate 111 is capable of pivoting on a shaft 112 and is pulled in the counterclockwise direction in FIG. 16 by a coil spring 113 and regulated to stop at the position shown by the solid line in FIG. 16. The guide plate 111, in the non-sort mode, guides a sheet which is traveling in the direction of arrow "f" to the nip portion between the rollers 102 and 103 with its lower surface 111*a*. On the other hand, at a time of sheet set take-out, the guide plate 111, together with the upper roller 42, is pushed up by a set of sheets which is coming between the rollers 102 and 103 in the direction of arrow "d". At this time, first, the wheels of the upper roller 42 are pushed up by the set of sheets, and the shaft 122 pushes up the guide plate 111 against the force of the coil spring 113. In this way, the plate 111 retreats upward from the set of sheets, and although the guide plate 111 has a function of guiding the set of sheets, it does not offer resistance to the set of sheets.

Figure 17:
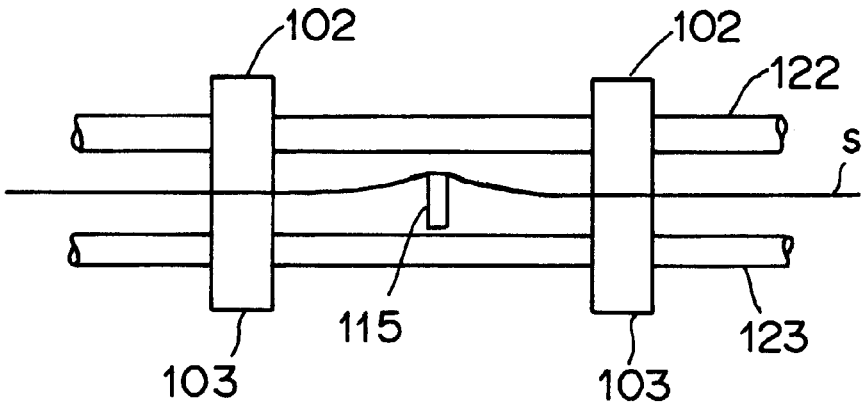
FIG. 17 is an illustration which shows a sheet being transported by the gate rollers.
Figure 18:
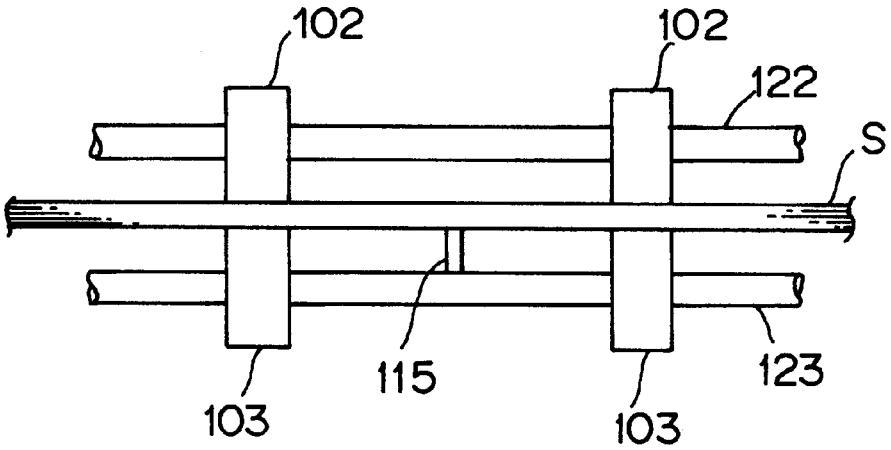
FIG. 18 is an illustration which shows a set of sheets being transported by the gate rollers.

The other guide plate 115 is capable of pivoting on a shaft 116 and is pulled in the counterclockwise direction by a coil spring 117 and regulated to stop at the position shown in FIG. 16. As FIG. 17 shows, in the non-sort mode, the guide plate 115 offers resistance with a strength corresponding to the force of the spring 117 to a sheet s, so that the sheet s is delivered onto the non-sort tray 20 while being stretched. On the other hand, at a time of sheet set take-out, because the force of the coil spring 117 is smaller than the weight of a set of sheets, as FIG. 18 shows, when a set of sheets S comes between the rollers 102 and 103, the guide plate 115 pivots downward on the shaft 116. The force of the coil spring 117 is sufficiently large so that the guide plate 115 will not be pushed down by a sheet in the non-sort mode even if the sheet is unordinary paper such as thick paper, OHP paper or the like.

Further, when unstapled sets of sheets are transported to and stacked on the non-sort tray 20 by use of the sheet set conveyer gate 100, the sets of sheets $S_1$, $S_2$, $S_3$ . . . are placed on the tray 20 so as to shift alternately from one another in a direction perpendicular to the direction in which the gate 100 delivers a set of sheets to the tray 20. This shift is realized by shifting the gate rollers 102 and 103 by a distance W (see FIG. 20) while the gate 100 is transporting a set of sheets in an even number in the order from the take-out position up to the delivering position nipping the set of sheets between the rollers 102 and 103.

Figure 19:
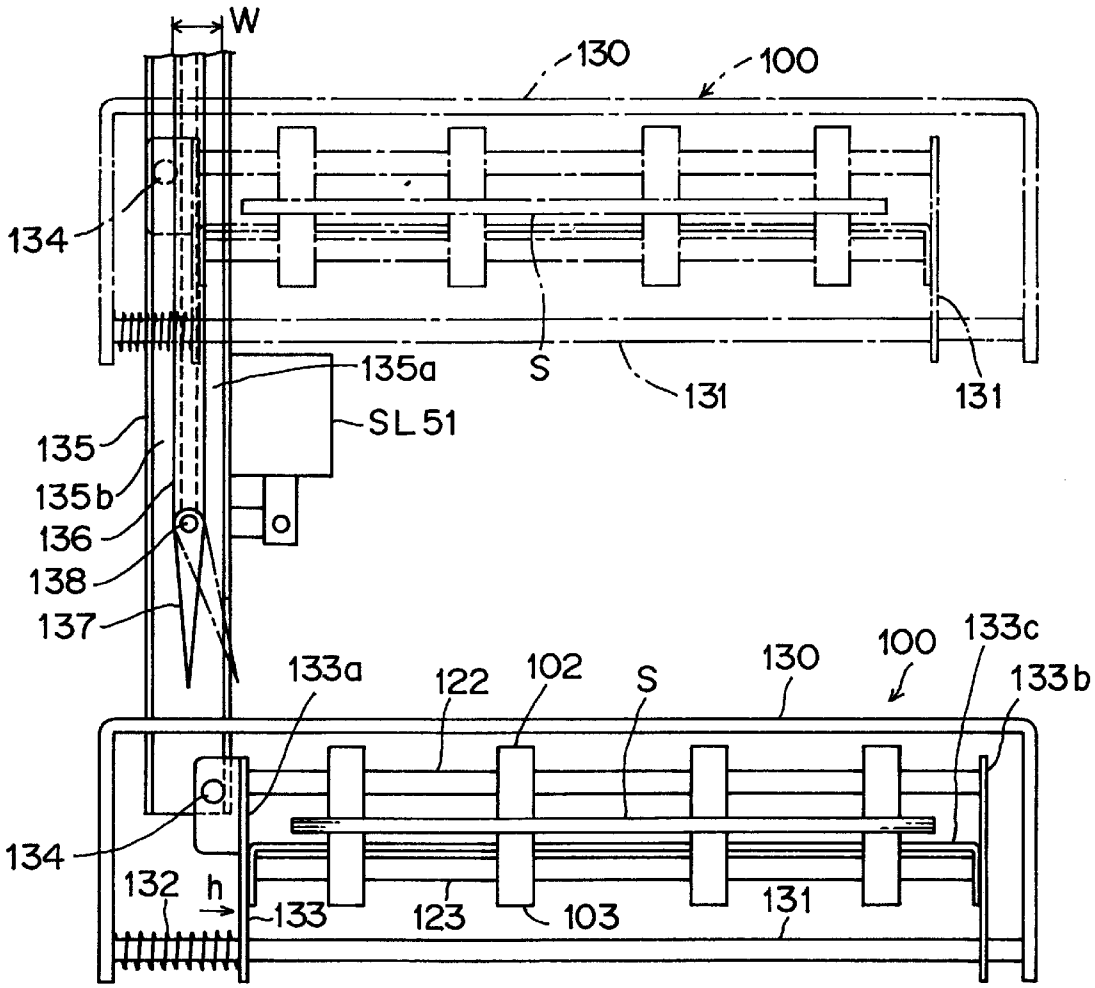
FIG. 19 is an elevational view of a gate roller shifting mechanism.

For the shift, as shown in FIG. 19, a fixed frame 130 and a movable frame 133 which supports the rollers 102 and 103 are provided in the gate 100. The fixed frame 130 is fixed inside the box 101. The movable frame 133 has side walls 133*a* and 133*b* which are connected to each other by a connecting board 133*c*, and the roller shafts 122 and 123 are supported by the side walls 133*a* and 133*b*. The side walls 133*a* and 133*b* of the movable frame 133 are capable of sliding along a guide shaft 131 supported by the fixed frame 130, and the movable frame 133 is pulled in the direction of arrow "h" with the side wall 133*a* pressed by a coil spring 132.

Further, on the locus of the upward/downward movement of the sheet set conveyer gate 100, a guide member 135 which has a concave cross section is provided, and by providing a rail 136 in the center of the guide member 135, two guide grooves 135*a* and 135*b* which extend vertically are formed in the guide member 135. A diverter 137 is fitted to the lower end of the rail 136 via a pin 138 and is capable of swinging, and the diverter 137 is connected to a solenoid SL51. While the solenoid SL51 is off, the diverter 137 is in a position in the center of the guide member 135 as shown by the solid line in FIG. 19. When the solenoid SL 51 is turned on, the diverter 137 swings to the right and comes to a position shown by the two-dot chain line. A pin 134 is fixed on the side wall 133*a* of the movable frame 133. The pin 134 is in the guide member 135 and is movable in the guide grooves 135*a* and 135*b*.

Figure 20:
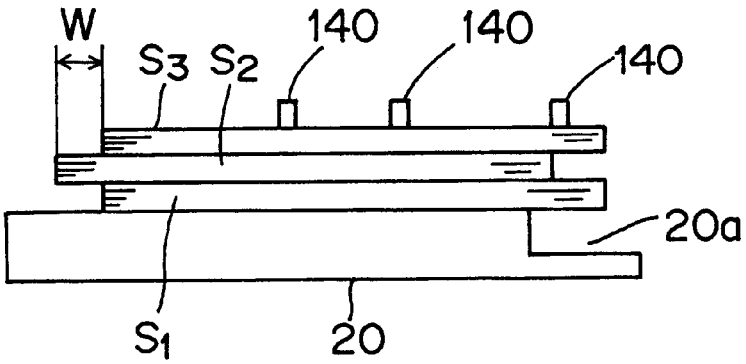
FIG. 20 is an illustration which shows sets of sheets stacked on a non-sort tray.

In the structure, the solenoid SL51 is usually off, and the gate 100 moves up and down while the movable frame 133 is pulled by the coil spring 132 so that the pin 134 is in engagement with the guide groove 135*a*. In this state, the movable frame 133 is not shifted. On the other hand, when the gate 100 moves up holding an unstapled set of sheets S in an even number between the rollers 102 and 103, the solenoid SL51 is turned on. Thereby, the diverter 137 swings to the right, and the pin 134 enters the guide groove 135*b* in the middle of the upward movement, guided by the diverter 137. Thus, the movable frame 133 and accordingly the rollers 102 and 103 are shifted by the distance W. The gate 100 moves up to the delivering position keeping this state, and delivers the set of sheets to the tray 20. When the gate 100 transports unstapled sets of sheets in odd numbers, the solenoid SL51 is kept off. In this way, as FIG. 20 shows, unstapled sets of sheets $S_1$, $S_2$, $S_3$ . . . are stacked on the non-sort tray 20 in a state of shifting in right and left alternately by the distance W.

In this embodiment, this shift stacking of sets of sheets on the non-sort tray 20 is carried out when the sets of sheets are unstapled. However, needless to say, the shift stacking may be carried out also when stapled sets of sheets are stacked on the tray 20.

Figure 21:
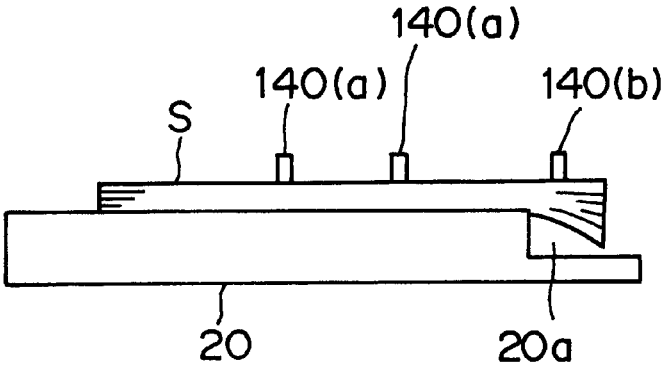
FIG. 21 is an illustration which shows sets of sheets stacked on the non-sort tray.
Figure 23A:
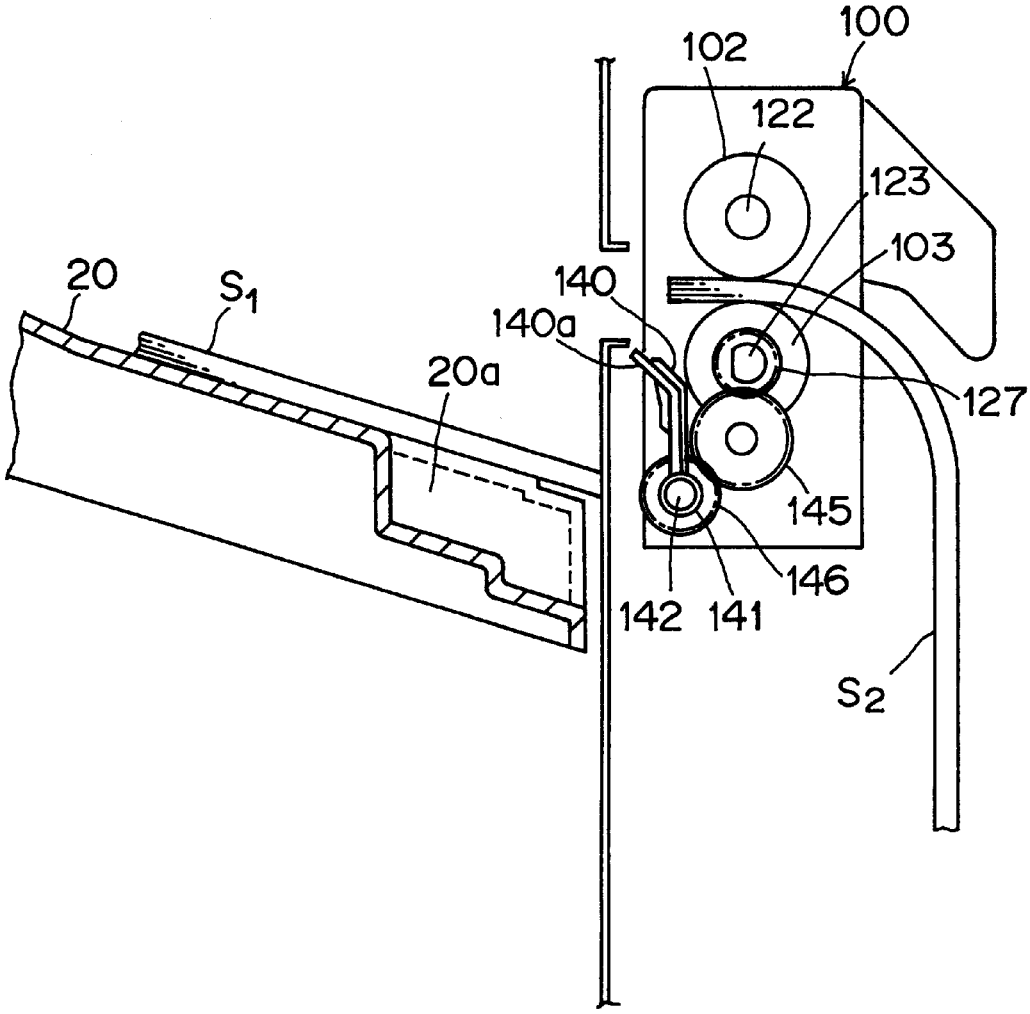
FIGS. 23*a*, 23*b* and 23*c* are illustrations which show operation of the sheet pressing sticks.

Next, pressing sticks 140 which press sheets stacked on the non-sort tray 20 at the trailing portion are described. The pressing sticks 140 are located in a position as shown in FIG. 21 with respect to the delivering direction, and as shown in FIG. 23*a*, when a set of sheets $S_2$ is to be delivered to the non-sort tray 20, the sticks 140 pivot in the direction of arrow "i" to press down a set of sheets $S_1$ on the non-sort tray 20 at its trailing portion. When the set of sheets $S_2$ is delivered to the non-sort tray 20 on the set of sheets $S_1$, the set of sheets $S_2$ which is provided with a force by the gate rollers 102 and 103 may push the set of sheets $S_1$ forward. In this embodiment, it is possible to stack unstapled sets of sheets on the non-sort tray 20, and in this case, it is more likely to occur that upper sheets in an unstapled set on the tray 20 are pushed forward. In order to avoid such trouble, the pressing sticks 140 are provided.

Figure 22:
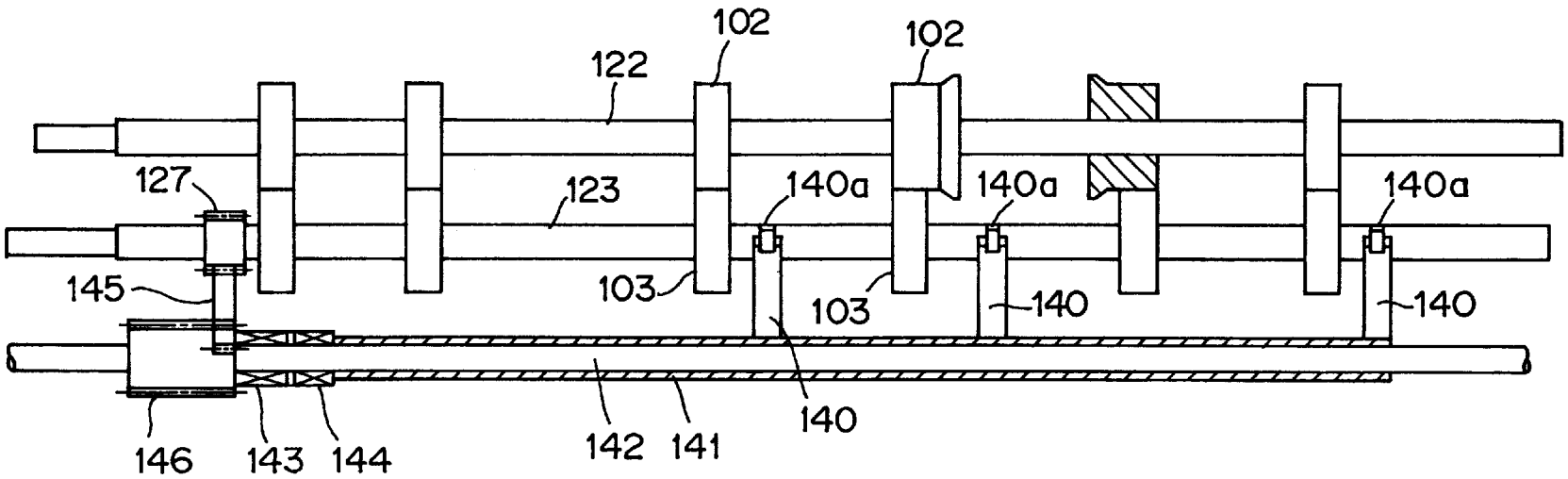
FIG. 22 is a sectional view of a structure for arranging of sheet pressing sticks.

Referring to FIGS. 22 and 23*a*, the structure of the pressing sticks 140 is described. Each of the pressing sticks 140 has a rubber member 140*a* which has a large coefficient of friction on its end. The pressing sticks 140 stand on a pipe 141 which extends in parallel to the roller shafts 122 and 123, and a shaft 142 is inserted in the pipe 141. The pipe 141 and the shaft 142 rotates freely from each other and are connected to each other via torque limiters 143 and 144. A gear 146 fixed to the shaft 142 is in engagement with a gear 127 fixed to the lower roller shaft 123 via an idle gear 145.

Figure 23B:
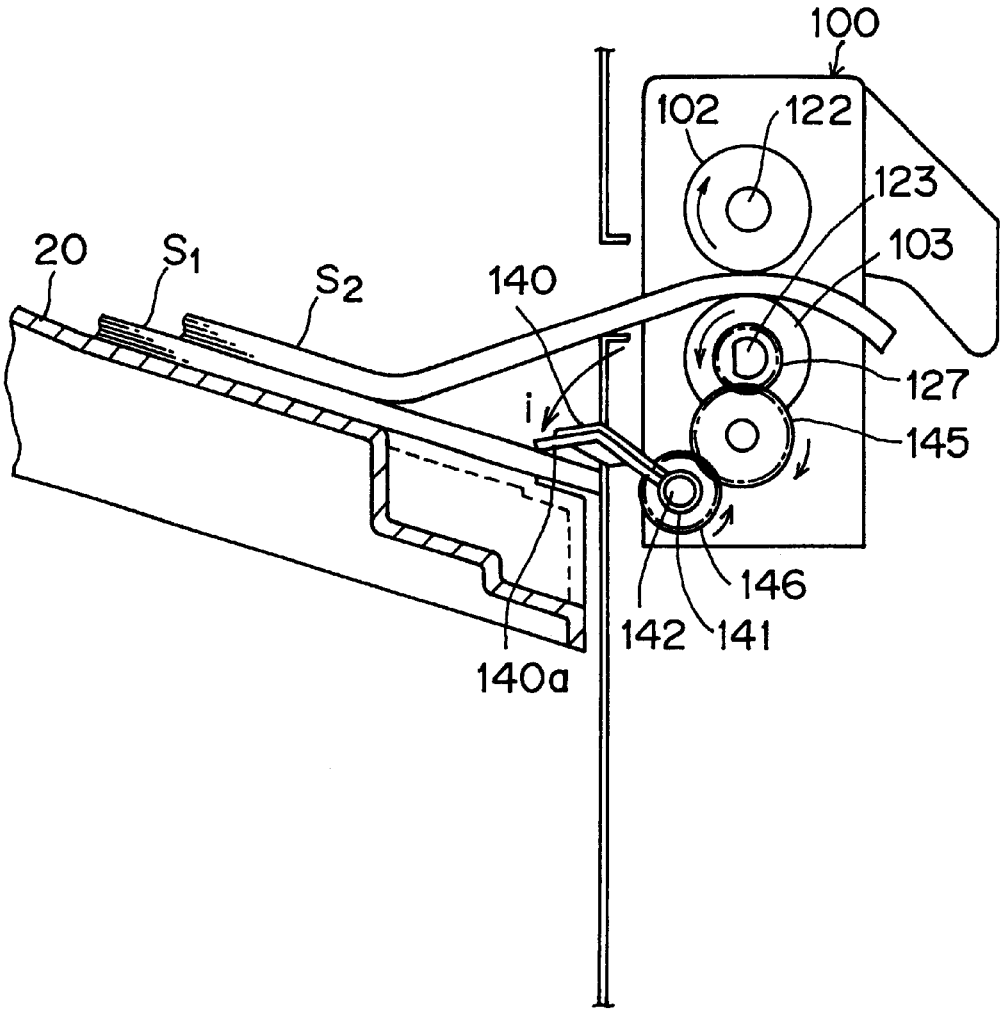

The pressing sticks 140 are usually upright as shown in FIG. 23*a*. When the gate rollers 102 and 103 are driven to rotate for delivery of the set of sheets $S_2$ to the non-sort tray 20, as shown in FIGS. 22 and 23*b*, the rotating force is transmitted to the pipe 141 from the gear 127 via the idle gear 145, the gear 126, the shaft 142 and the torque limiter 143. Then, the pressing sticks 140 pivot in the direction of arrow "i" with rotation of the pipe 141, and the rubber members 140*a* press down the set of sheets $S_1$ on the tray 20 at the trailing portion. Thereafter, the gate rollers 102 and 103 keep rotating to deliver the set of sheets $S_2$ onto the tray 20, and accordingly, the gear 146 and the shaft 142 keep rotating, whereas the pressing sticks 140 stay in the pressing position regulated by the torque limiter 143. In this way, it is prevented that the set of sheets $S_1$ may be pushed forward by the set of sheets $S_2$.

Figure 23C:
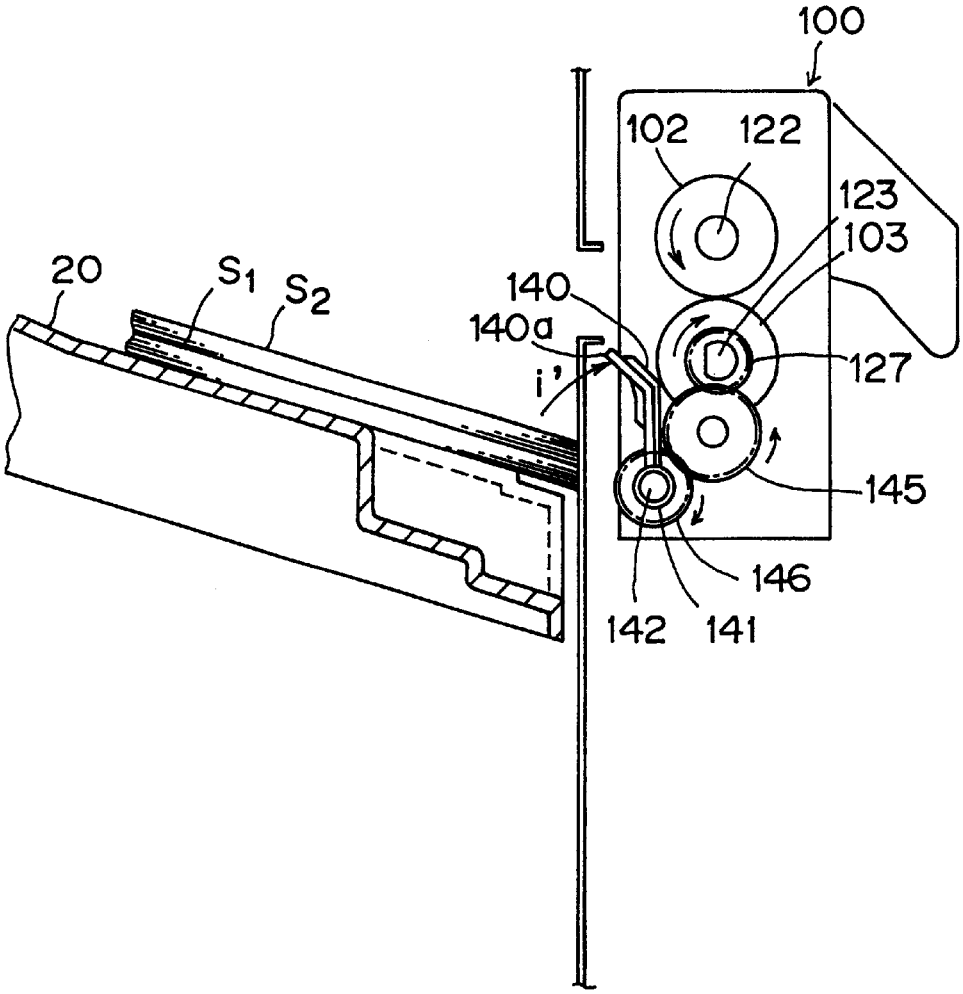

After delivering the set of sheets $S_2$ onto the non-sort tray 20, the gate rollers 102 and 103 are rotated in the reverse direction to the direction for the delivery for a short time. In this moment, the rotating force is transmitted to the pipe 141 from the gear 147 via the other torque limiter 144, and as shown in FIG. 23*c*, the pressing sticks 140 pivot in the direction of "i" with rotation of the pipe 141 to release the set of sheets $S_1$. When the pressing sticks 140 come upright to the position shown in FIG. 23*c*, the pressing sticks 140 are stopped from pivoting in the direction of arrow "i" by a stopper (not shown) to stay in the upright position.

In the non-sort mode, the torque limiter 143 is kept off, and the pressing sticks 140 are not operated and stay in the upright position.

Among the pressing sticks 140, two sticks 140(*a*) in the center (see FIG. 21) especially function as a prevention against push-out of a set of sheets. A pressing stick 140(*b*) at the right end in FIG. 21 presses a set of sheets S at a corner into a recess 20*a* formed on the non-sort tray 20. When sets of sheets each of which has been stapled at a corner are stacked on the non-sort tray 20, the staples are laid one upon another over the recess 20*a*, and the stack of the sheet sets is more voluminous in this portion. By pressing the stack of the sheet sets at the stapled portion into the recess 20*a*, the upper surface of the stack can be made flat at a time of delivery of a set of sheets onto the tray 20, whereby interference among the sets of sheets can be prevented, thereby securing alignment of the sets of sheets on the tray 20.

By the way, in the take-out/transportation/stacking of sets of sheets, the bin assembly 30 moves up pitch by pitch. The transportation/stacking of a stapled set of sheets onto the non-sort tray 20 is carried out while sheets in a bin 31 set on the level $X_1$ are stapled.

In the non-sort mode, the sheet set conveyer gate 100 is in the home position shown in FIG. 11 and delivers sheets onto the non-sort tray 20 one by one. In the modes where the gate 100 transports sets of sheets from the bin assembly 30 to the non-sort tray 20 one by one, the gate 100 is first set in a second position shown by the solid line in FIG. 12 to deliver a set of sheets onto the tray 20. The tray 20 has a large capacity, and therefore, the gate 100 can be set on any level within a range from the second position to an upper limit position shown by the dashed line in FIG. 12 for delivery of a set of sheets onto the tray 20 so that sets of sheets stacked on the tray 20 can be kept in alignment. The delivering position where the gate 100 is stopped for delivery of a set of sheets onto the tray 20 is such a position as to keep a constant distance between the gate rollers 102 and 103 and the upper surface of the stack of sheet sets on the tray 20. In other words, for delivery of a set of sheets onto the tray 20, the gate 100 is set on such a level to drop the set of sheets on the uppermost set of sheets on the tray 20 by a specified height.

The following is the reason why the second position where the gate 100 is set for delivery of the first set of sheets onto the tray 20 is located under the home position where the gate 100 is set for delivery of sheets onto the tray 20 in the non-sort mode. In this embodiment, in the non-sort mode, the position of the gate 100 is fixed. Therefore, in order to secure a sufficient capacity in the tray 20 for sheets, it is necessary to set a sufficient height from the tray 20 to the gate 100. On the other hand, when a set of sheets is delivered onto the tray 20, the set of sheets is likely to bend, and it is preferred that the height by which a set of sheets falls down onto the tray 20 from the gate rollers 102 and 103 is small. Therefore, the second position is located under the home position, and the gate 100 is gradually stopped on higher levels as the volume of sets of sheets on the tray 20 is increasing.

In order to realize the movement of the gate 100, as shown in FIG. 2, a sensor SE33 which detects the presence or absence of a sheet on the non-sort tray 20 and a sensor SE23 which detects the upper surface of a stack of sheets on the tray 20 (the upper surface of the tray 20 if no sheets are on the tray 20) are provided. Also, a sensor SE20 which detects that the gate 100 is in the home position and a sensor SE22 which detects the presence or absence of a set of sheets in the gate 100 are provided. Further, a sensor SE24 which detects that the gate 100 has moved up to the upper limit is provided (see FIG. 12).

Figure 12:
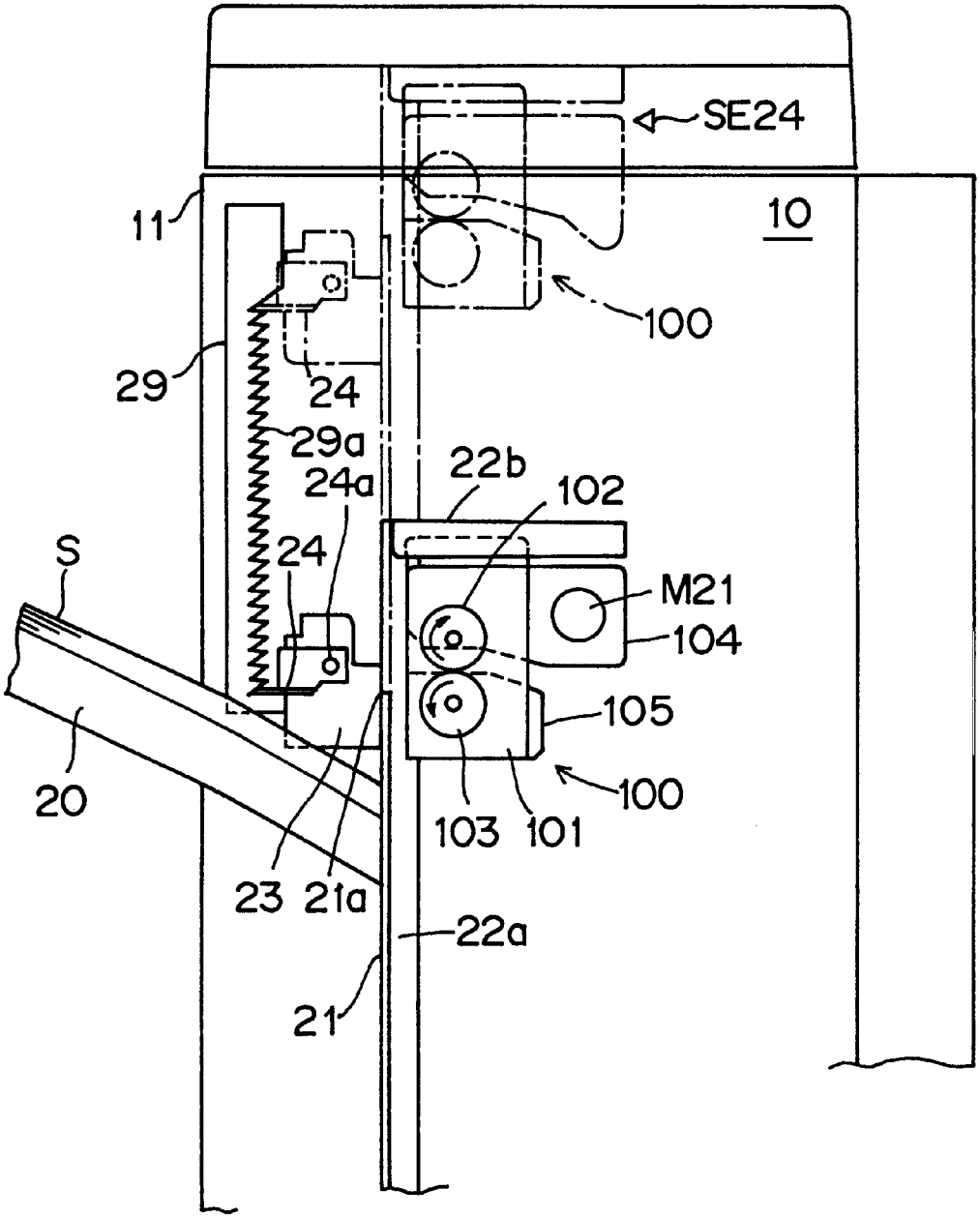
FIG. 12 is an elevational view of the upper portion of the staple-sorter, showing a second position of the sheet set conveyer gate.

As shown in FIGS. 11 and 12, a cover 21 is provided at a position facing the lower end of the non-sort tray 20. The cover 21 is to regulate the trailing edge of a set of sheets delivered onto the tray 20. The cover 21 is movable upward together with the gate 100, whereas the cover 21 stays in the upper position while the gate 100 is moving down to the bin assembly 30. The cover 21 is supported by a frame having a vertical portion 22*a* and a horizontal portion 22*b*, and the cover 21, together with the frame, is movable up and down guided by a guide member (not shown). On the body frame 11 of the staple-sorter 10, a frame 20 with a ratchet 29*a* is fixed, and a pawl 24 which is fitted to the cover 21 via a bracket 23 is in engagement with the ratchet 29*a*. The pawl 24 is capable of pivoting on a pin 24*a* freely in the counterclockwise direction and within a limited rage in the clockwise direction.

When the sheet set conveyer gate 100 is in the second position, the cover 21 is in a position (lowest position) shown by the solid line in FIG. 12, and the pawl 24 is in engagement with the lowest tooth of the ratchet 29*a*. When the volume of sets of sheets on the tray 20 increases, the gate 100 moves up, and simultaneously, the box 100 pushes up the horizontal frame portion 22*b*, resulting in an upward movement of the cover 21. During the upward movement, the pawl 24 pivots counterclockwise on the pin 24*a* and goes over the teeth of the ratchet 29*a*. When the gate 100 stops moving up, the pawl 24 comes into engagement with the tooth opposite thereto, and therefore, the cover 21 stays in the position when the gate 100 moves down afterwards. In this way, whenever the gate 100 delivers a set of sheets onto the tray 20, the upper end 21*a* of the cover 21 is at a specified distance from the nip portion of the rollers 102 and 103.

The highest position of the cover 21 is shown by the dashed line in FIG. 12. When the operator has taken the sets of sheets out of the non-sort tray 20, the pawl 24 is released from the limitation of clockwise pivot (for example, a regulating member retreats from its regulating position with turning-on of a solenoid), and the cover 21 moves down to the lowest position.

Figure 24:
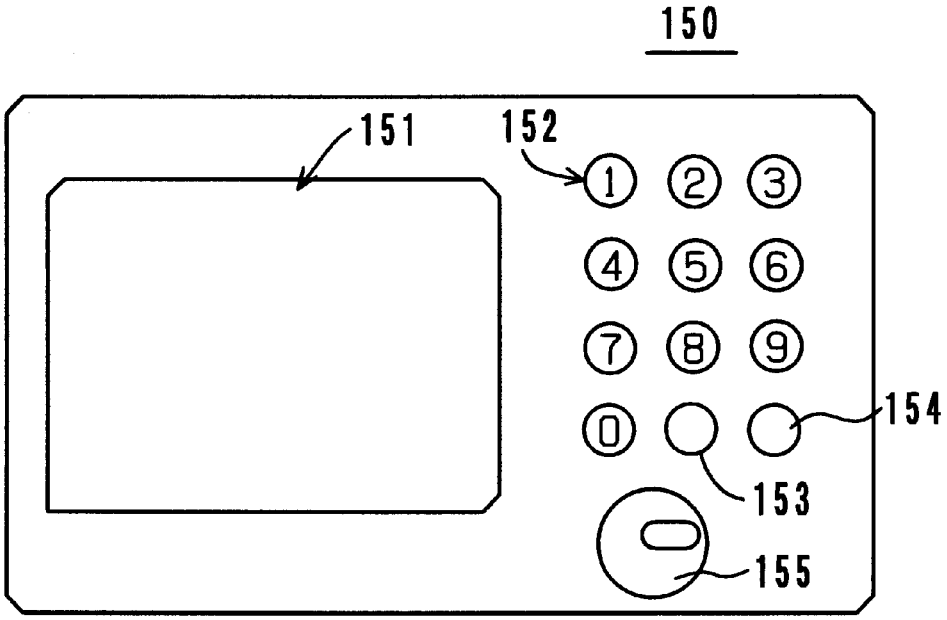
FIG. 24 is a plan view of an operation panel of the copying machine.

FIG. 24 shows the main part of an operation panel 150 provided on the copying machine 1. On the operation panel 150, there are provided a liquid crystal display type touch panel 151, a ten-key 152 for inputting the number of copies to be made (registered number), a reset key 153, an interruption key 154, a copy start key 155 and so on.

Figure 25:
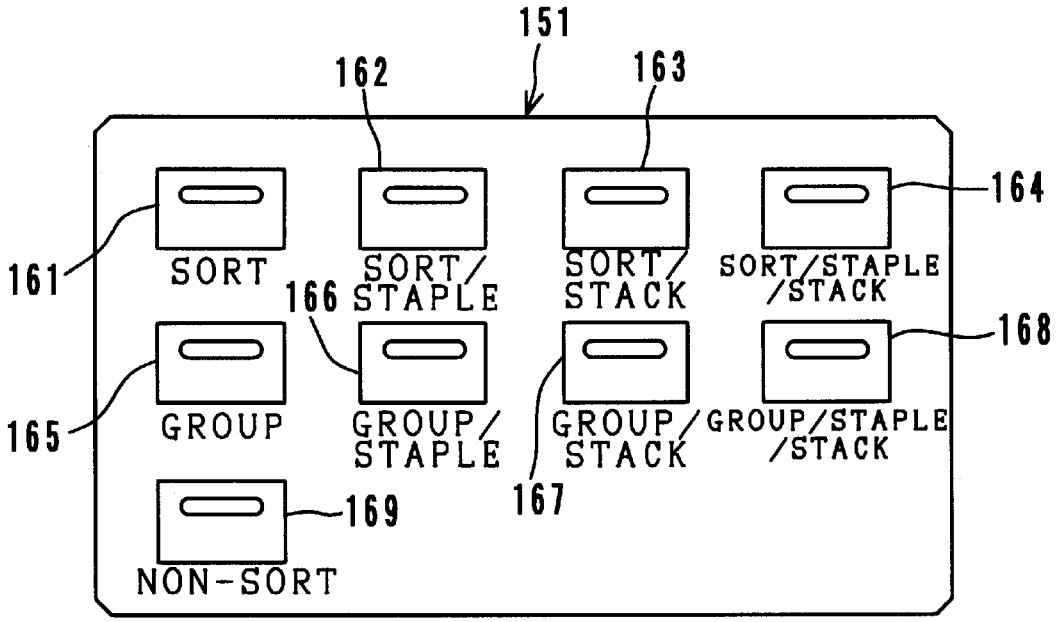
FIG. 25 is a plan view of a screen displayed on a touch panel of the operation panel.

FIG. 25 illustrates a screen displayed on the touch panel 151. There are displayed a sort mode sector key 161, a sort/staple mode selector key 162, a sort/stack mode selector key 163, a sort/staple/stack mode selector key 164, a group mode selector key 165, a group/staple mode selector key 166, a group/stack mode selector key 167, a group/staple/stack mode selector key 168 and a non-sort mode selector key 169.

Figure 26:
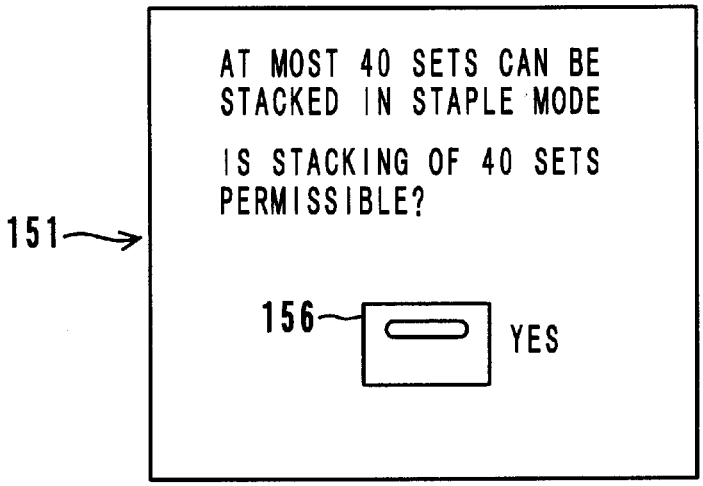
FIG. 26 is a plan view of another screen displayed on the touch panel.

FIG. 26 illustrates another screen displayed on the touch panel 151. On the screen, there is displayed a key 156 which limits the number of copy sets to be made and stacked in the staple/stack mode to 40.

Figure 27:
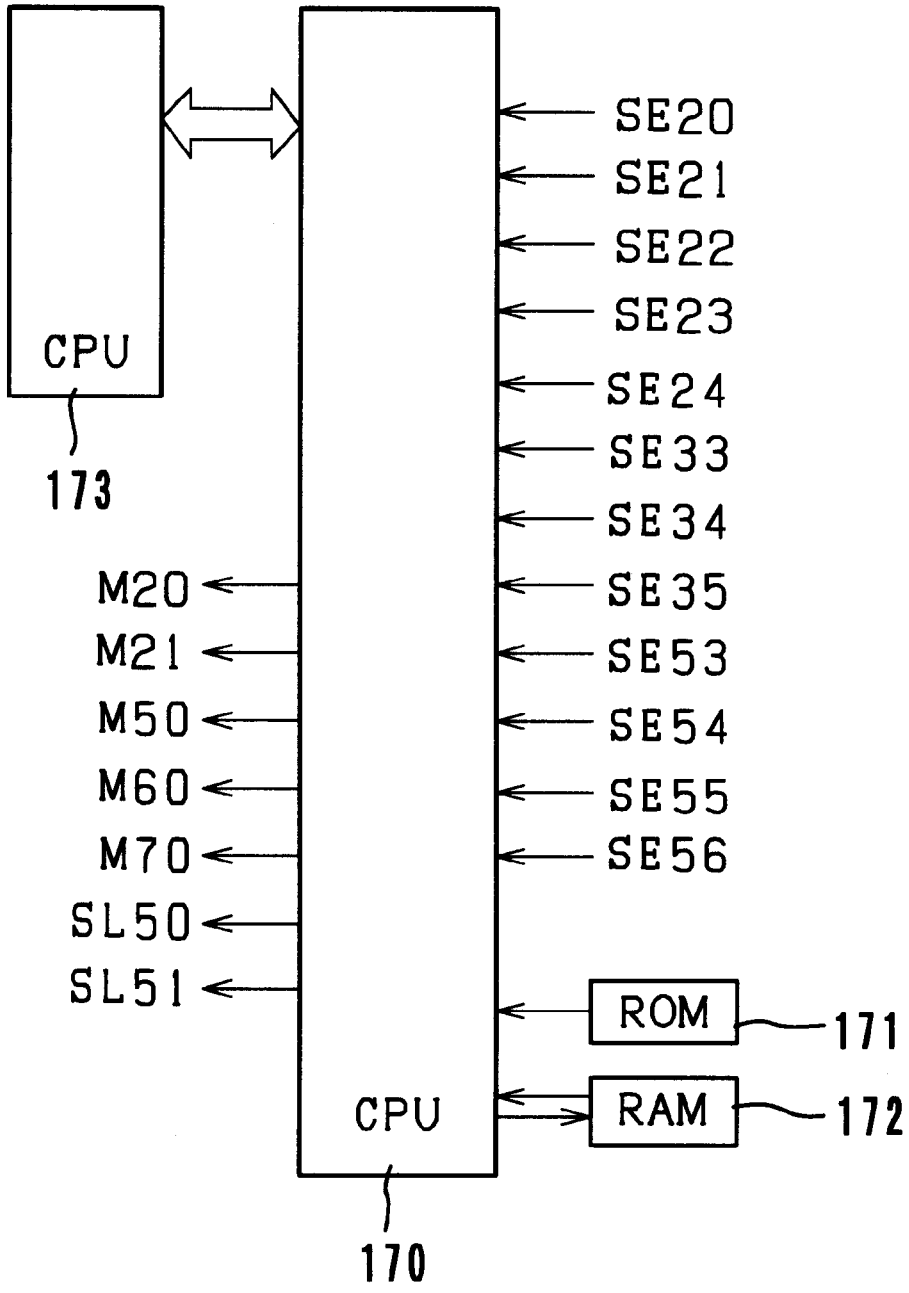
FIG. 27 is a block diagram which shows the control circuit of the copying machine and the staple-sorter.

FIG. 27 shows the control circuit of the copying machine 1 and of the staple-sorter 10. The center of the control circuit is a CPU 170 with a ROM 171 and a RAM 172, and the CPU controls the motors M20, M21, M50, M60 M70, the solenoids SL50, SL51, the staple unit shift motor, the staple unit drive motor, etc. according to a program stored in the ROM 171. Meanwhile, detection signals are inputted into the CPU 170 from the above-described various sensors. Further, the CPU 170 communicates with other CPUs, for example, with a CPU 173 which controls the automatic document feeder 5 to exchange necessary data.

Referring to flowcharts of FIGS. 28 through 38, the control procedure of the CPU 170 is hereinafter described.

First, various flags and counters shown in the flowcharts are described.

A sort flag F1 indicates that the sort mode has been established.

A group flag F2 indicates that the group mode has been established.

A staple flag F3 indicates that the staple mode has been established.

A stack flag F4 indicates that the stack mode in which sets of sheets stored in the bins 31 are transported to and stacked on the non-sort tray 20 is established.

An initial gate operation flag F5 indicates that the sheet set conveyer gate 100 is in its home position.

A staple unit operation flag F6 permits the staple unit 70 to perform stapling.

A take-out flag F7 permits the take-out unit 40 and the sheet set conveyer gate 100 to perform take-out/transportation/stacking of a set of sheets.

A take-out unit operation flag F8 permits the take-out unit 40 to perform take-out of a set of sheets.

A one-bin take-out completion flag F9 indicates the take-out/transportation/stacking of a set of sheets from one bin has been completed by the take-out unit 40 and the sheet set conveyer gate 100.

A registered number counter A stores the number of copies to be made registered by the operator.

A job counter B counts the number of times of circulation of documents in the automatic document feeder 5. Because there are only twenty bins, if the registered number is more than 20 in the sort mode, documents are circulated a plurality of times, and twenty copies of each document are made in each circulation. For example, if the registered number is "50", in the first circulation of documents, twenty copies of each document are made and distributed among the bins $\mathbf{31}_1$ through $\mathbf{31}_{20}$. This is defined as "one job", and the counter B is set to 1. After the completion of one job, the twenty sets of sheets stored in the bins 31 are sequentially stapled if necessary and transported and stacked onto the non-sort tray 20 by the sheet set conveyer gate 100. Thereafter, in the second circulation of the documents, twenty copies of each document are made and distributed among the bins $\mathbf{31}_2$, through $\mathbf{31}_{20}$, and then, these twenty sets are sequentially transported and stacked onto the non-sort tray 20. Further, in the third circulation of the documents, ten copies of each document are made and distributed among the bins $\mathbf{31}_1$ through $\mathbf{31}_{10}$, and then, these ten sets are sequentially transported and stacked onto the non-sort tray 20.

A bin counter C indicates the number of bins to be used in one job. For example, if the registered number is "30", the counter C indicates "20" in the first job and indicates "10" in the second job.

A take-out bin counter D indicates the number of bins which sheets have not been taken out of, in the stack mode.

A travel summation counter E counts the travel distance of the vertical movement of the gate 100 in the stack mode.

A first travel constant counter F counts the travel distance (a constant) of the gate 100 from the home position to the take-out position for receiving a set of sheets from a bin.

A second travel constant counter G counts the travel distance (a constant) of the gate 100 from the home position to the second position.

A total travel counter H counts the travel distance of the gate 100 from the take-out position to a delivering position to deliver a set of sheets to the non-sort tray 20.

A stapled-bin counter I counts the number of bins where stapling has been performed.

A group storing bin counter J counts the number of bins which have been stored with sheets in the group mode. The value of this counter depends on the number of documents.

A stacking start position counter K counts the travel distance of the gate 100 from the take-out position to a position where the first set of sheets is delivered from the gate 100 to the non-sort tray 20.

In the following description, the term "on-edge" means a moment when a sensor, a signal or the like is switching from off to on, and the term "off-edge" means a moment when a sensor, a signal or the like is switching from on to off.

Figure 28:
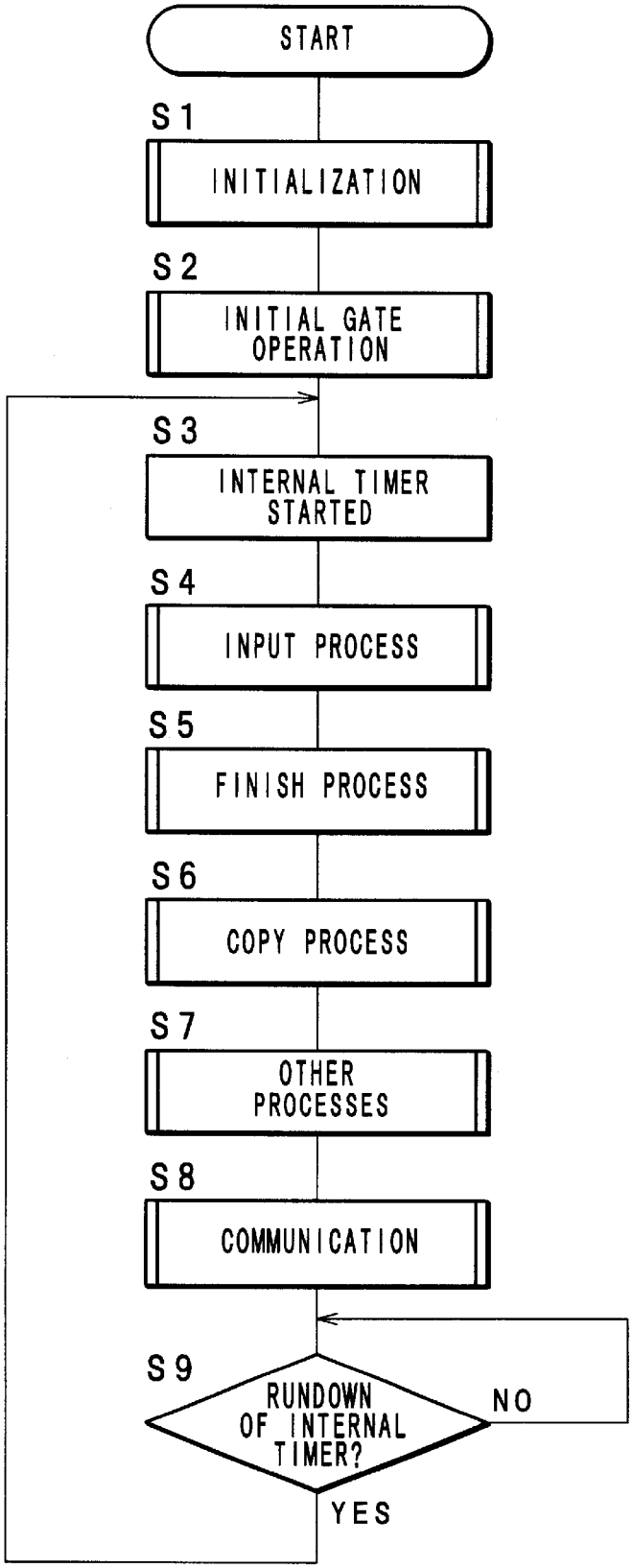
FIG. 28 is a flowchart which shows the main routine of a CPU of the control circuit.

FIG. 28 shows the main routine of the CPU 170.

When the system is powered on and the program starts, first at step S1, control parameters and devices are initialized, and at step S2, an initial gate operation is carried out. Next, an internal timer is started at step S3. The internal timer is to determine the time for one routine, and the value has been previously set in the timer at step S1. Subsequently, subroutines are called at steps S4, S5, S6, S7 and S8 to perform necessary processes. When the end of the internal timer is confirmed at step S9, the program returns to step S3.

Figure 29:
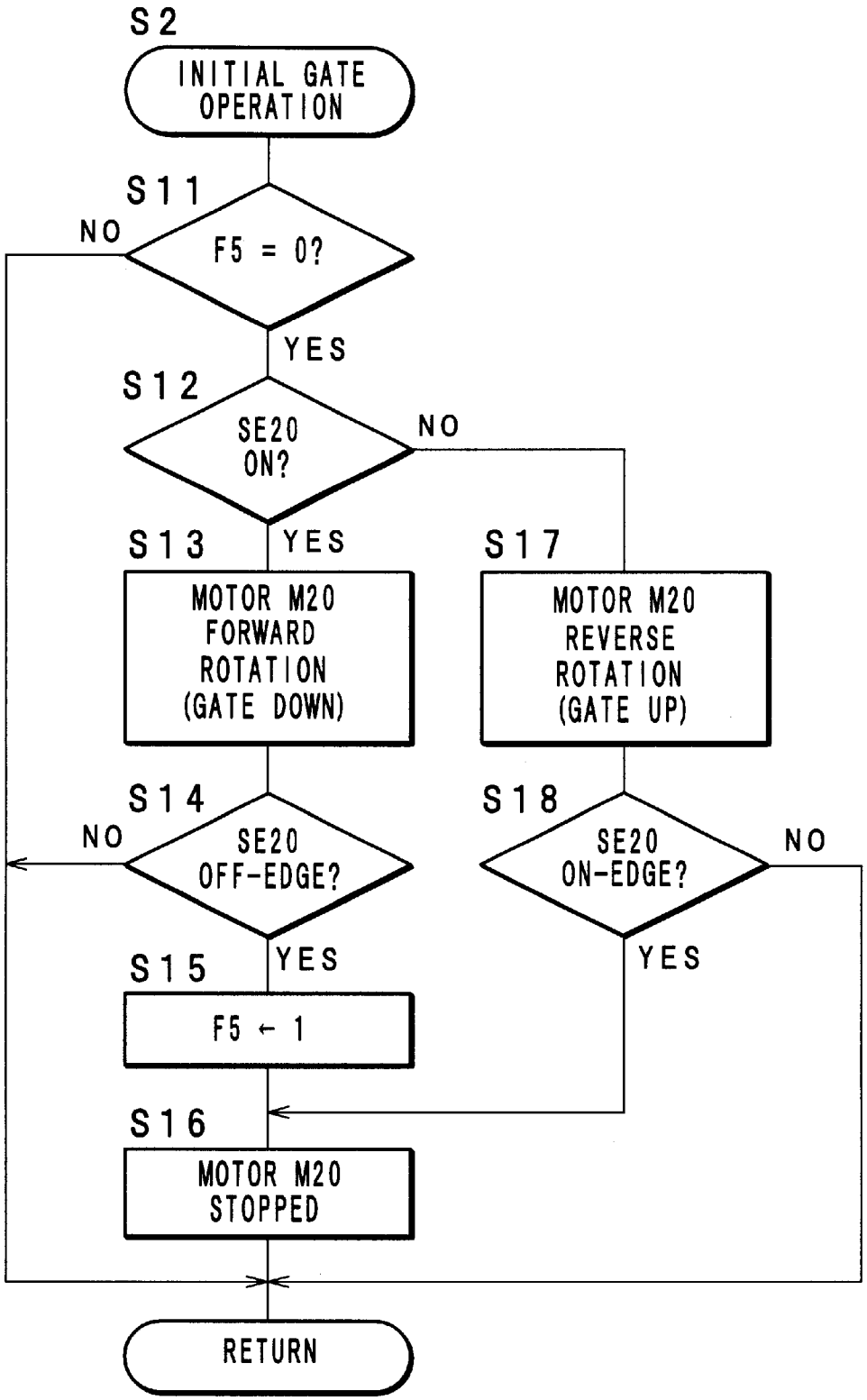
FIG. 29 is a flowchart which shows a subroutine for initial gate operation.

FIG. 29 shows a subroutine for the initial gate operation which is carried out at step $S_2$ of the main routine. In this subroutine, the sheet set conveyer gate 100 is set in the home position.

First, the initial gate operation flag F5 is checked at step S11. If the flag F5 is "0", the sensor SE20 is checked at step S12. The sensor SE20 is on while the gate 100 is above the home position and off while the gate 100 is below the home position. Therefore, if the sensor SE20 is on at step S12, the gate up/down motor M20 is rotated forward at step S13. Thereby, the gate 100 starts moving down. Next, an off-edge of the sensor SE20 is checked at step S14. At an off-edge of the sensor SE20, that is, when the gate 100 has reached the home position, the flag F5 is set to "1" at step S15, and the motor M20 is stopped at step S16. On the other hand, when the sensor SE20 is off at step S12, which means that the gate 100 is below the home position, the motor M20 is rotated in reverse at step S17. Thereby, the gate 100 starts moving up. Next, an on-edge of the sensor SE20 is checked at step S18. At an on-edge of the sensor SE20, the motor M20 is stopped at step S16. Thereafter, the gate 100 is set in the home position through the steps S12 to S16.

Figure 30:
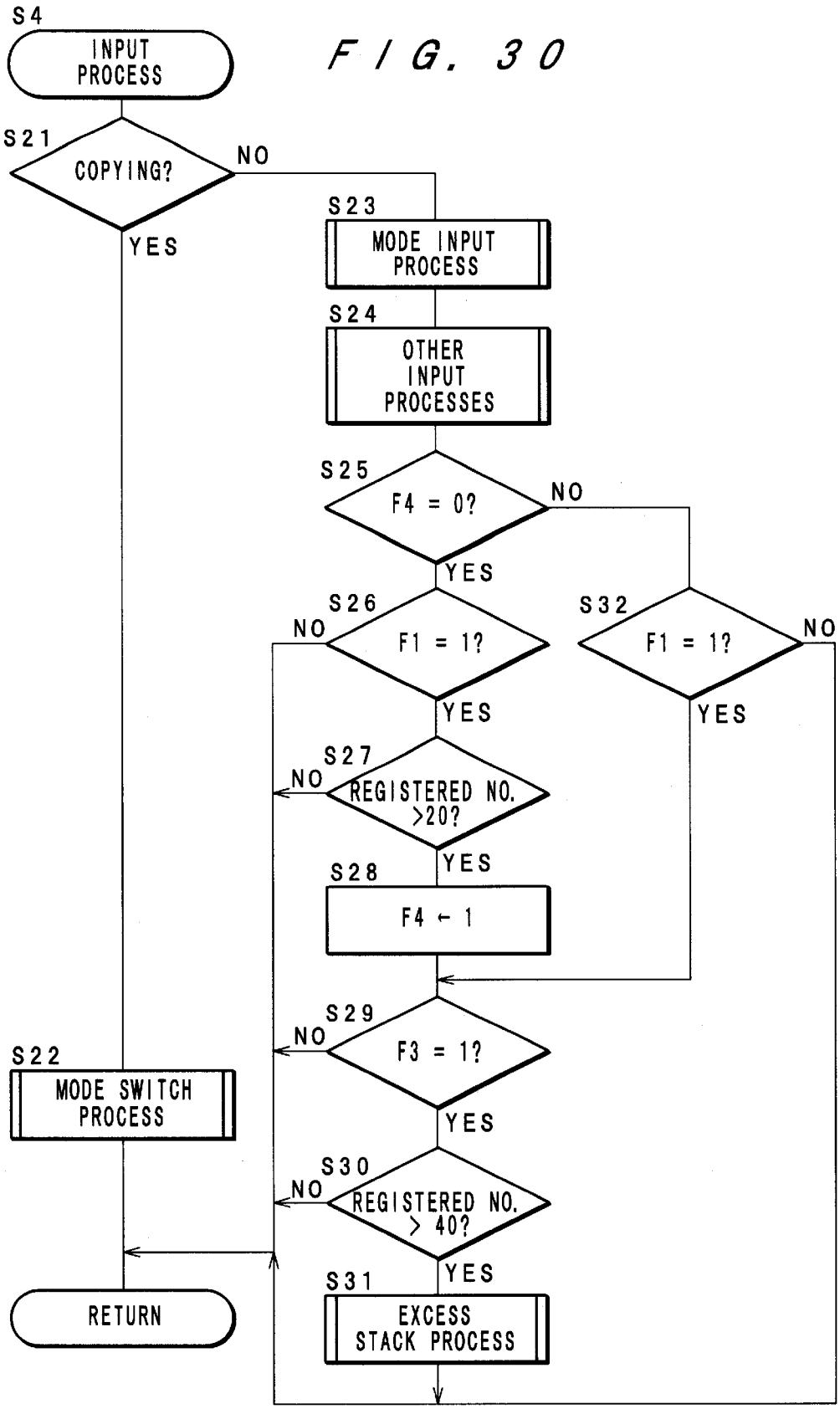
FIG. 30 is a flowchart which shows a subroutine for an input process.

FIG. 30 shows a subroutine for an input process which is carried out at step S4 of the main routine. In this subroutine, information on mode selection inputted by an operator with the operation panel 150 is put into the CPU 170.

First at step S21, it is judged whether the machine is in operation for copying, and if it is in the middle of copying, a mode switch process is executed at step S22. If it is not in the middle of copying, a mode input process is executed at step S23, and other input processes, for example, input of a number registered by the operator on the ten-key 152 into the CPU 170, are executed at step S24. Next, it is judged at step S25 whether or not the stack flag F4 is "0"; it is judged at step S26 whether or not the sort flag is "1"; and it is judged at step S27 whether or not the registered number is larger than 20. If the judgments at all the steps S25, S26 and S27 are "YES", the stack flag F4 is set to "1" at step S28. In this case, because the registered number is over the number of bins, this copying operation cannot be completed in one job. Therefore, in order to automatically transport/stack sets of sheets from the bins 31 onto the non-sort tray 20 after one job, the flag F4 is set to "1". In this way, even if the operator has not selected the stack mode, the stack mode is automatically established so that the operation in the sort mode to make 21 or more copy sets can be continuously carried out.

Next, the staple flag F3 is checked at step S29. If the flag F3 is "1" and if the registered number is judged to be more than 40 at step S30, an excess stack process is executed at step S31. If a large number of stapled sets of sheets are stacked on the non-sort tray 20, the stack of sheet sets will be voluminous especially at the stapled portion, and the stapled portion may have a height over the capacity of the non-sort tray 20. In order to avoid this trouble, a limit is set to the number of sheet sets to be stacked on the tray 20 in the staple/stack mode. This limit is "40" in this embodiment.

If the stack mode has been selected by the operator ("NO" at step S25) and if the sort flag F1 is "1" at step S32, processes at the steps S29 and S30 are executed in the above-described way. Then, if the number of sheet sets to be stacked on the tray 20 is more than 40, the excess stack process is executed at step S31.

Thus, in the sort/staple/stack mode, if the number of sheet sets to be stacked on the tray 20 is more than 40, the registered number is automatically changed to "40". However, after stacking 40 stapled sets of sheets on the tray 20, it is possible to make more copy sets in the sort/staple mode. Therefore, the system can be so structured that the stacking is discontinued when 40 sets have been stacked on the tray 40, while copying in the sort/staple mode thereafter to make not more than 20 sets is permitted.

Figure 31:
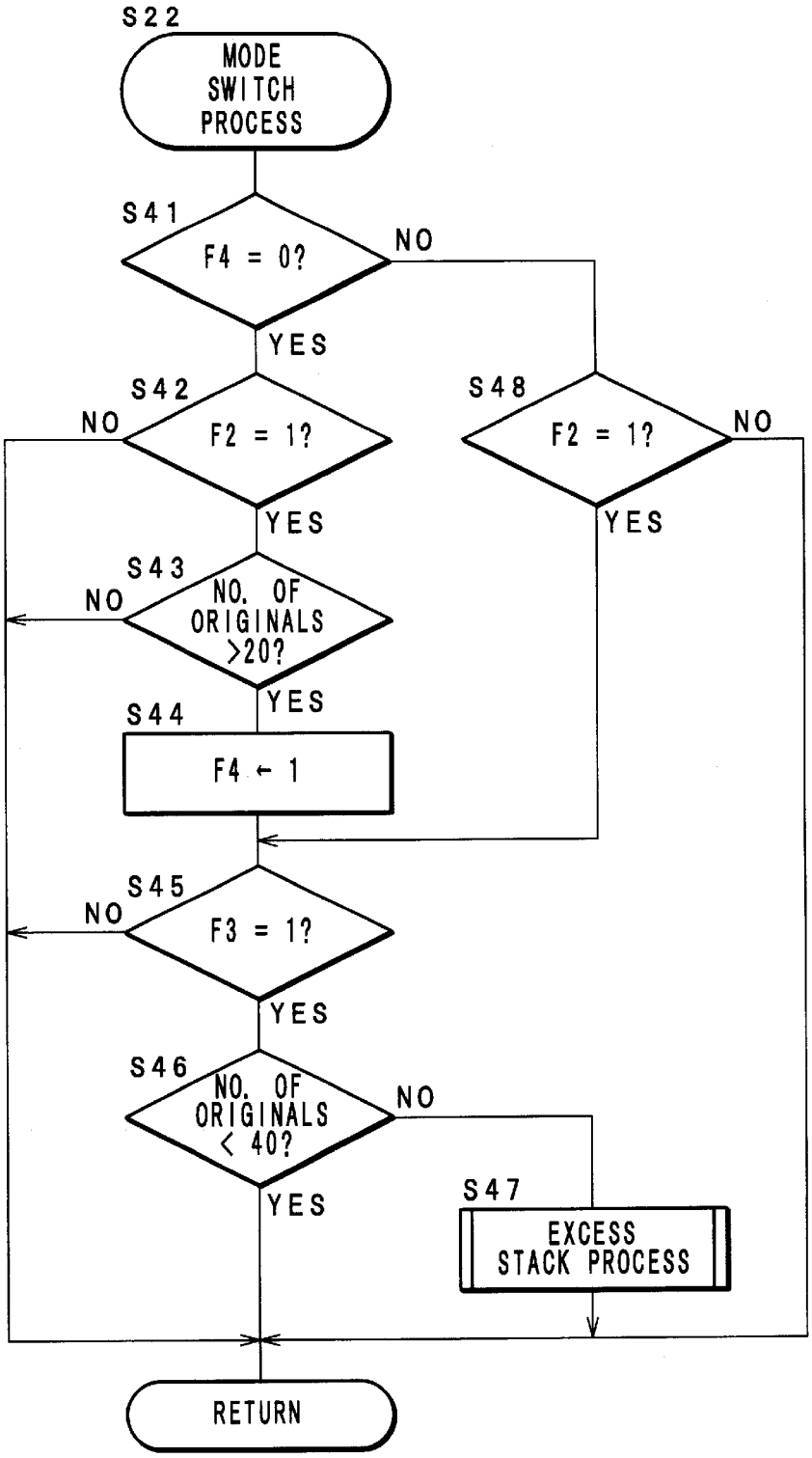
FIG. 31 is a flowchart which shows a subroutine for a mode switch process.

FIG. 31 shows a subroutine for the mode switch process which is carried out at step S22.

If the stack flag F4 is judged to be "0" at step S41 and if the group flag F2 is judged to be "1" at step S42, it is judged at step S43 whether or not the number of documents is more than 20. The number of documents is counted every time the automatic document feeder 5 feeds a document onto the platen glass. Specifically, the presence or absence of a document on the document tray of the document feeder 5 is checked during copying of the nineteenth document, and if there is a document on the tray at this time, the document is the twenty-first document. Accordingly, in this case, the judgment at step S43 is "YES". Because there are only twenty bins, copies of the twenty-first document cannot be delivered to any bin 31. Therefore, the stack flag F4 is set to "1" at step S44. Thereby, sets of sheets stored in the bins 31, sheets in each set having the same page, are transported and stacked onto the non-sort tray 20 by the sheet set conveyer gate 100, so that copying of the twenty-first and succeeding documents becomes possible.

Next, the staple flag F3 is checked at step S45. If the staple flag F3 is "1" and if the number of documents is judged to be more than 40, the excess stack process is executed at step S47. As in the case where the number of copy sets to be made is judged to be more than 40 at step S30, in order to avoid trouble that the height of the stack of sheet sets on the non-sort tray 20 may be over the capacity of the tray 20, the number of stapled sets to be stacked on the tray 20 is limited.

On the other hand, if the stack mode has been selected ("NO" at step S41) and if the group flag F2 is judged to be "1" at step S48, the program goes to steps S45 and S46. Then, if the number of sheet sets to be stacked on the tray 20 is more than 40, the excess stack process is executed at step S47. In the group/staple/stack mode, if the number of sheet sets to be stacked on the tray 20 is more than 40, stacking of the forty-first and succeeding sets is cancelled.

Figure 32A:
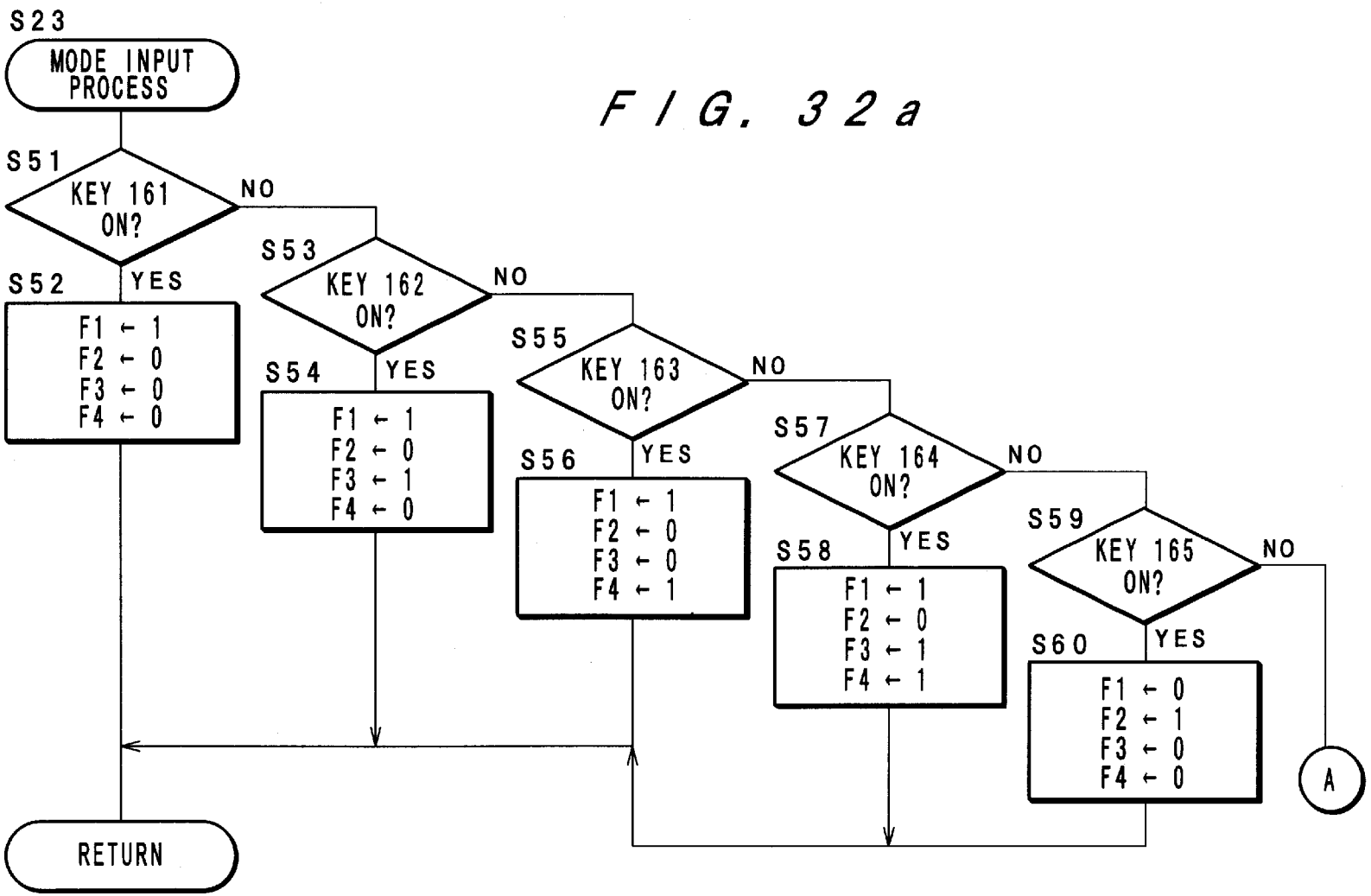
FIGS. 32*a* and 32*b* are flowcharts which show a subroutine for a mode input process.
Figure 32B:
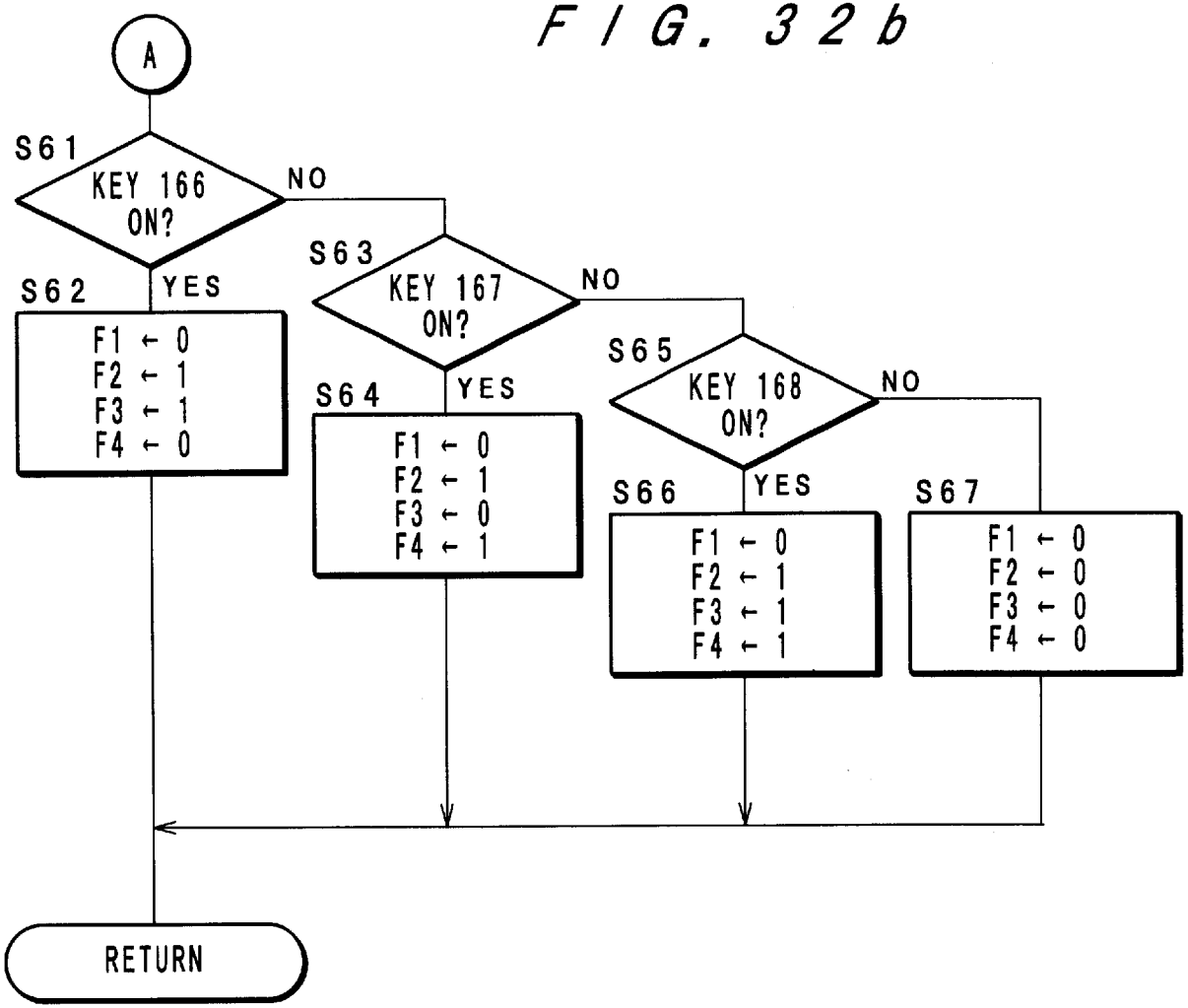

FIGS. 32*a* and 32*b* show a subroutine for the mode input process which is carried out at step S23.

In this subroutine, the on/off states of the mode selector keys 161 through 169 on the touch panel 151 are judged at steps S51, S53, S55, S57, S59, S61, S63 and S65 respectively, and in accordance with the turned-on keys of the keys 161 through 166, the flags F1 through F4 are set/reset to "1" or "0" at corresponding steps of S52, S54, S56, S58, S60, S62, S64, S66 and S67. Initially, the non-sort mode is established.

Figure 33:
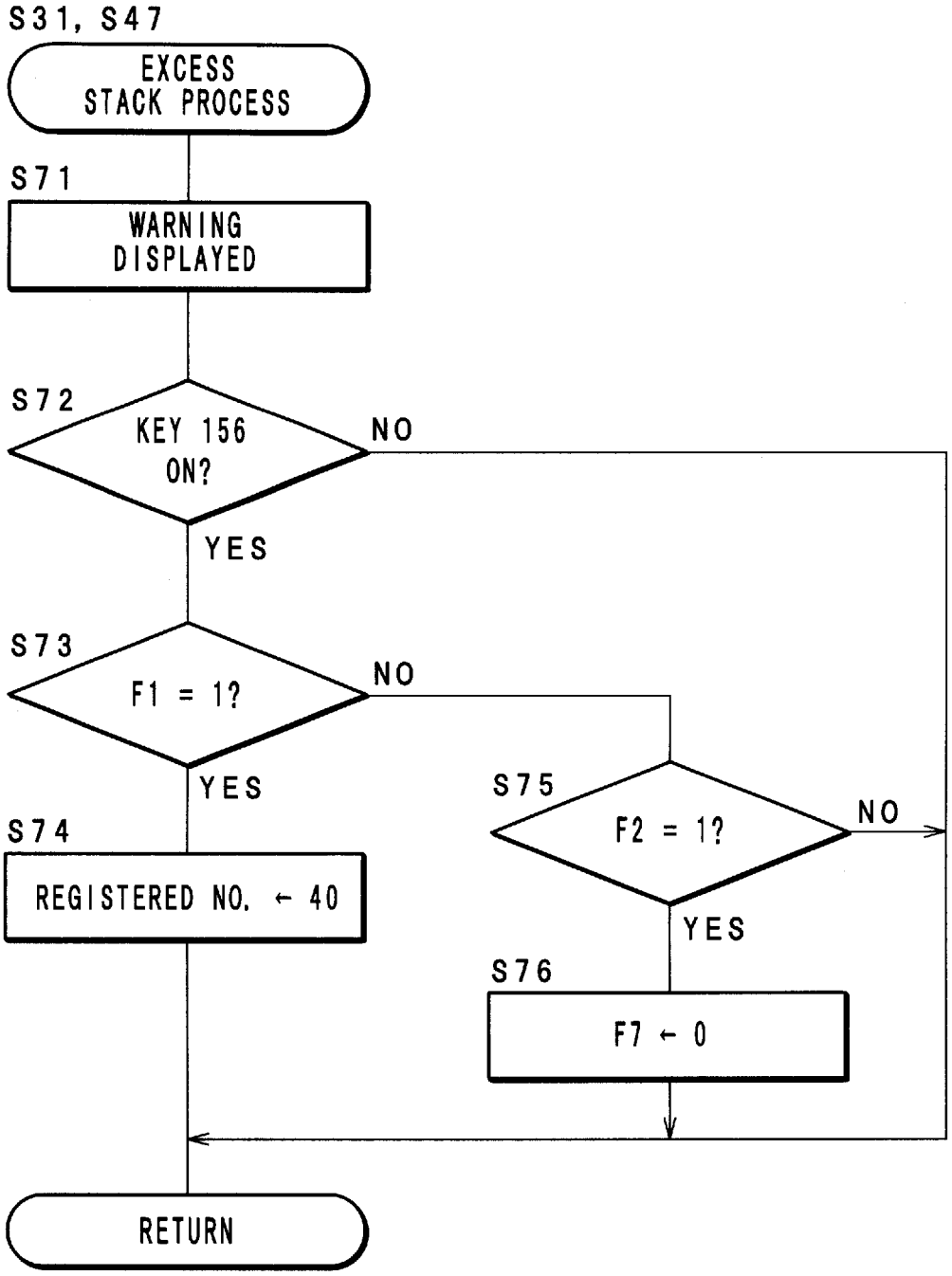
FIG. 33 is a flowchart which shows a subroutine for an excess stack process.

FIG. 33 shows a subroutine for the excess stack process which is carried out at steps S31 and S47.

This subroutine is carried out when the registered number is more than 40 in the sort/staple/stack mode (see steps S28, S29, S30 and S32) or when the number of documents is more than 40 in the group/staple/stack mode (see steps S44, S45, S46 and S48).

First, a warning display is presented on the touch panel 151 at step S71. As shown in FIG. 26, the warning display comprises text which indicates that at most 40 sets can be stacked in the staple mode and asks the operator whether stacking of only 40 copy sets on the tray 20 is permissible, and a key 156. If it is judged at step S72 that the operator has turned on the key 156, the sort flag F1 and the group flag F2 are checked at steps S73 and S75. If the sort mode is set, the registered number is changed to 40 at step S74, and if the group mode is set, the take-out flag F7 is reset to "0".

Figure 34:
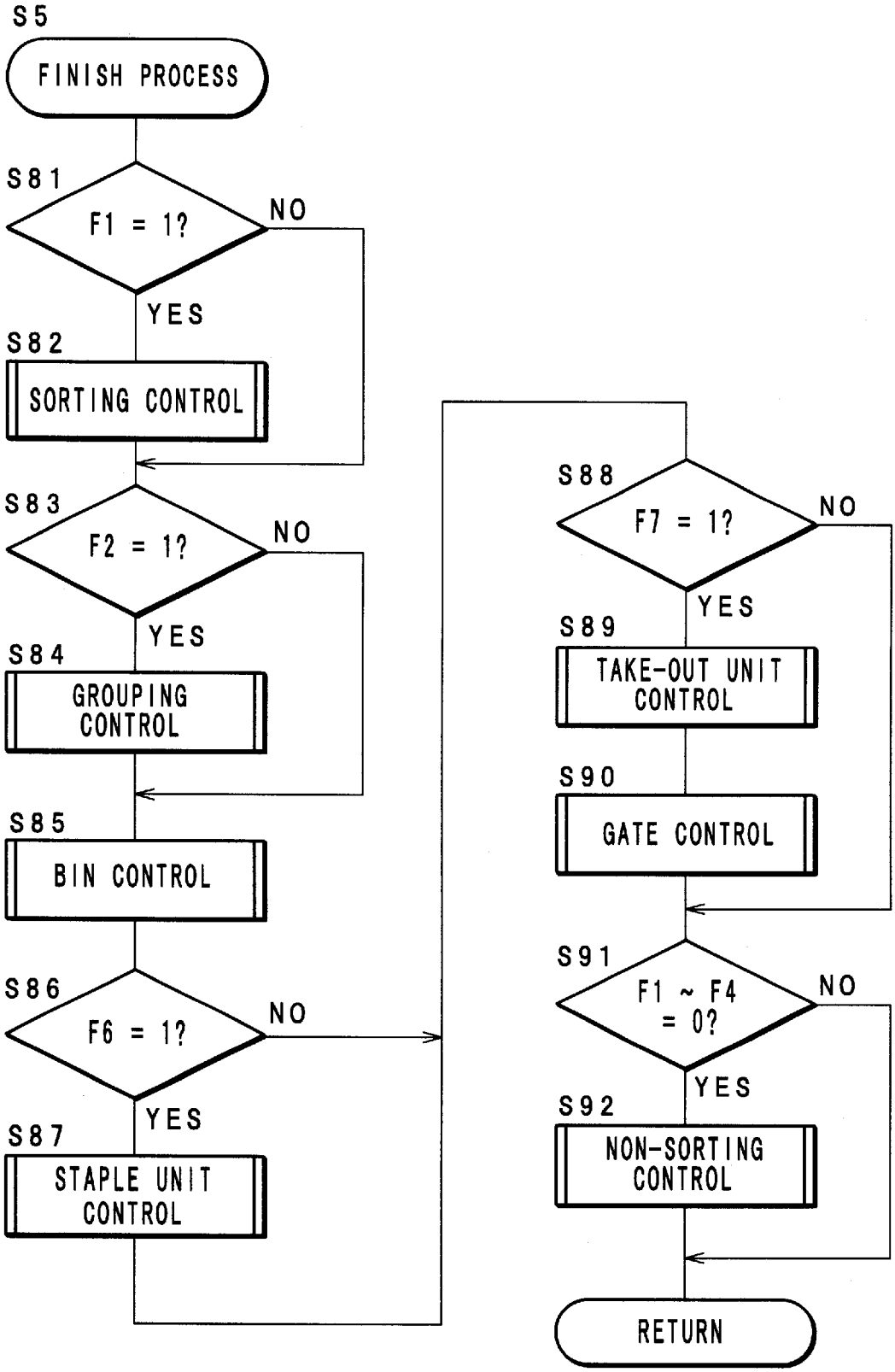
FIG. 34 is a flowchart which shows a subroutine for a finish process.
Figure 35A:
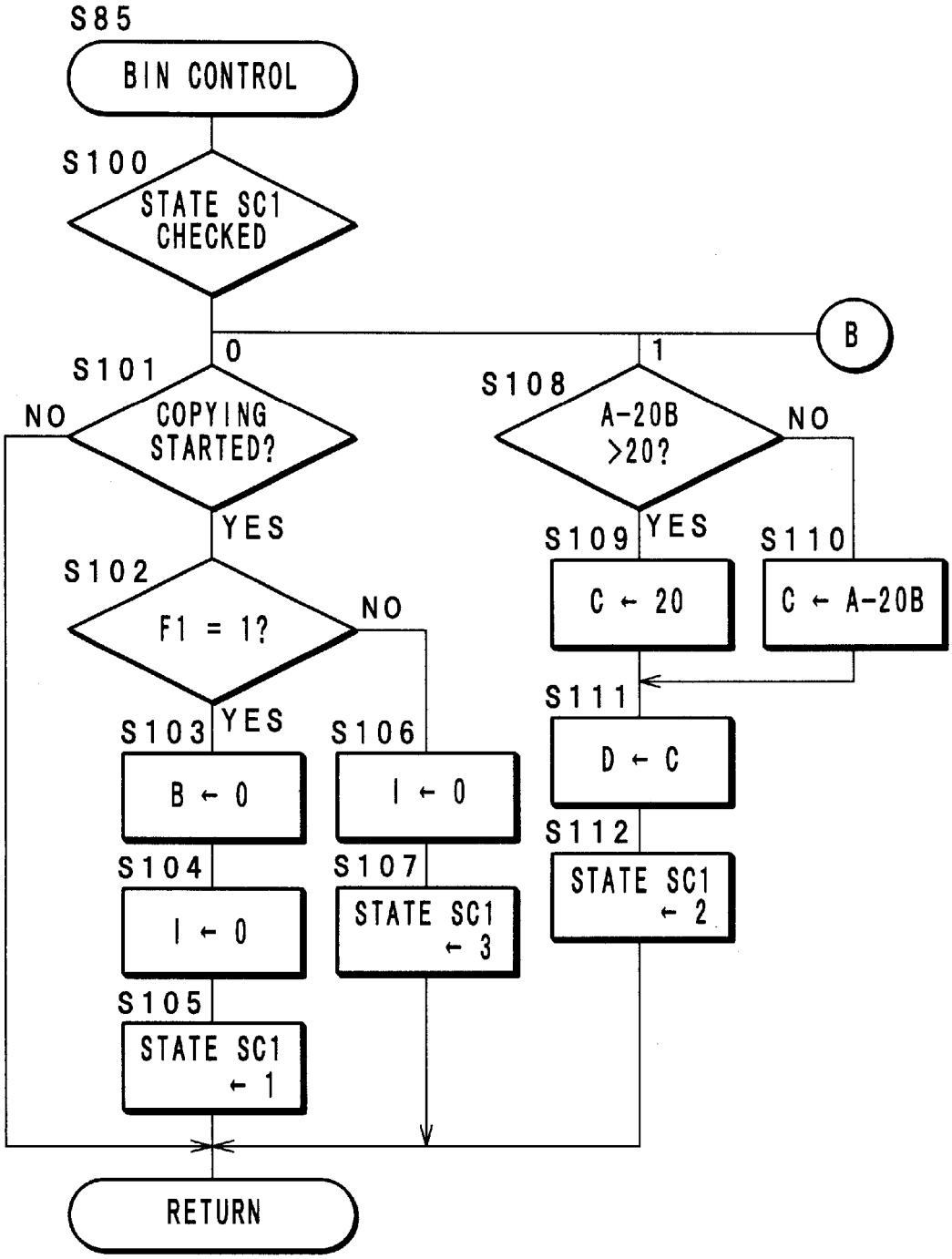
FIGS. 35*a* through 35*g* are flowcharts which show a subroutine for control of the bins.
Figure 35B:
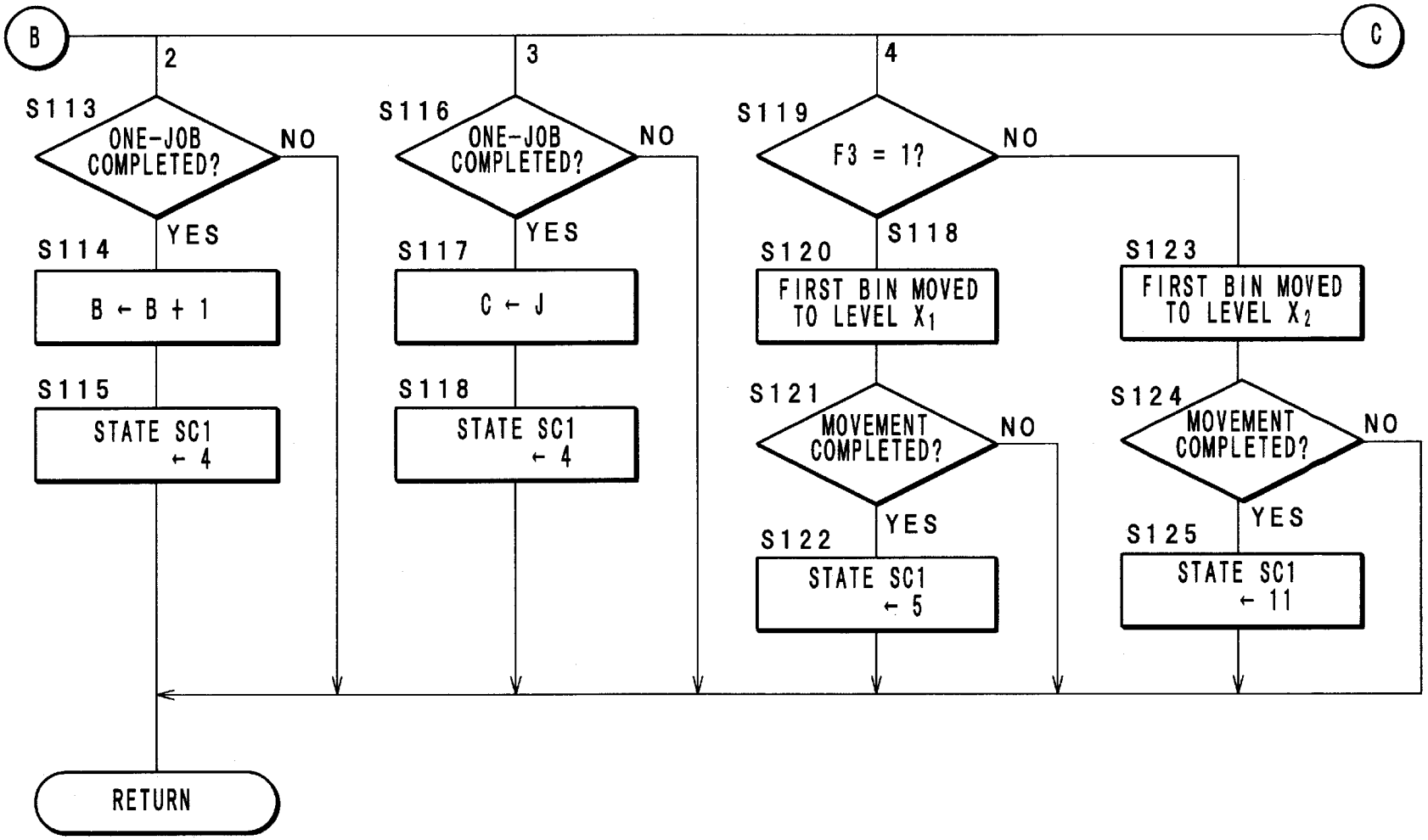
Figure 35C:
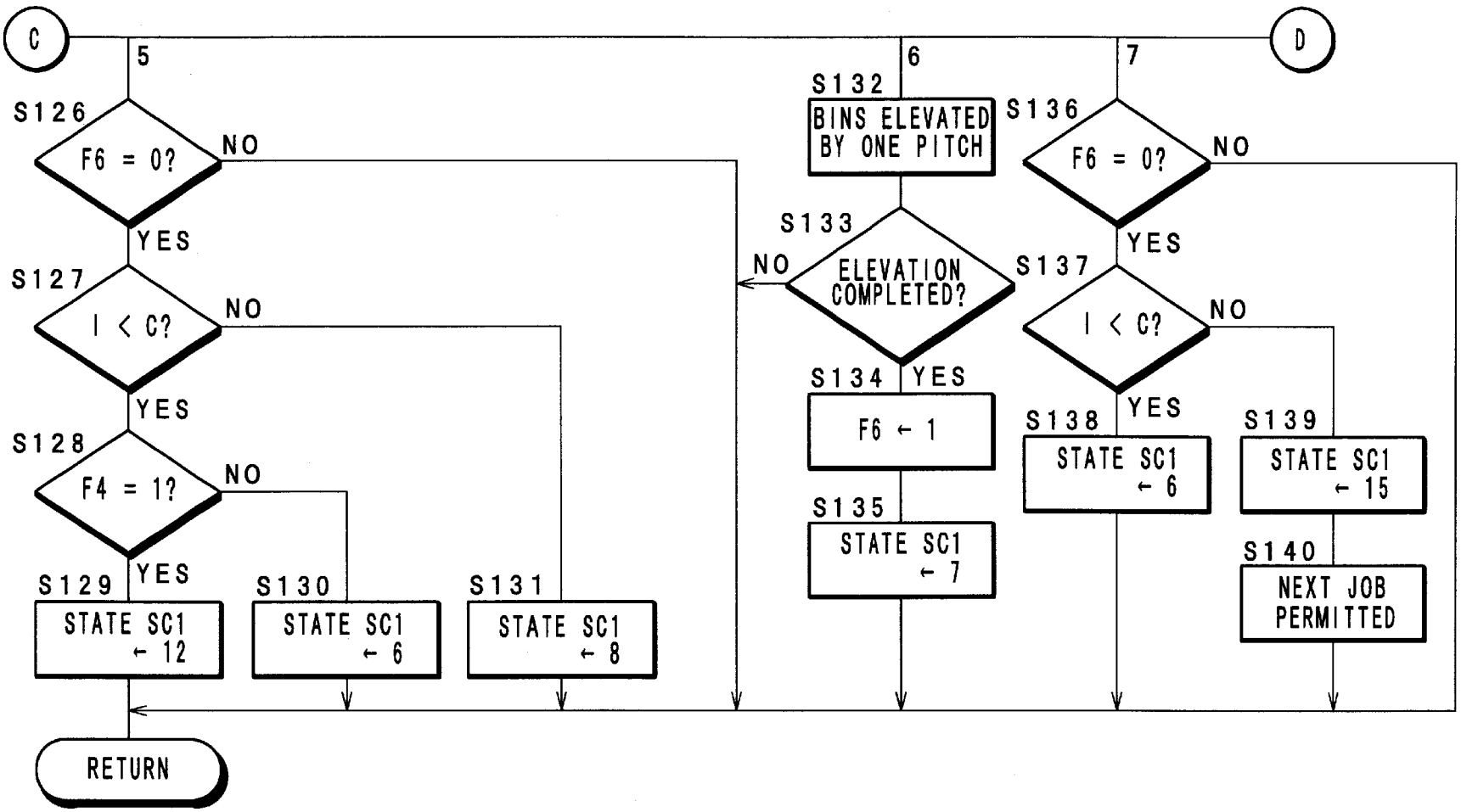
Figure 35D:
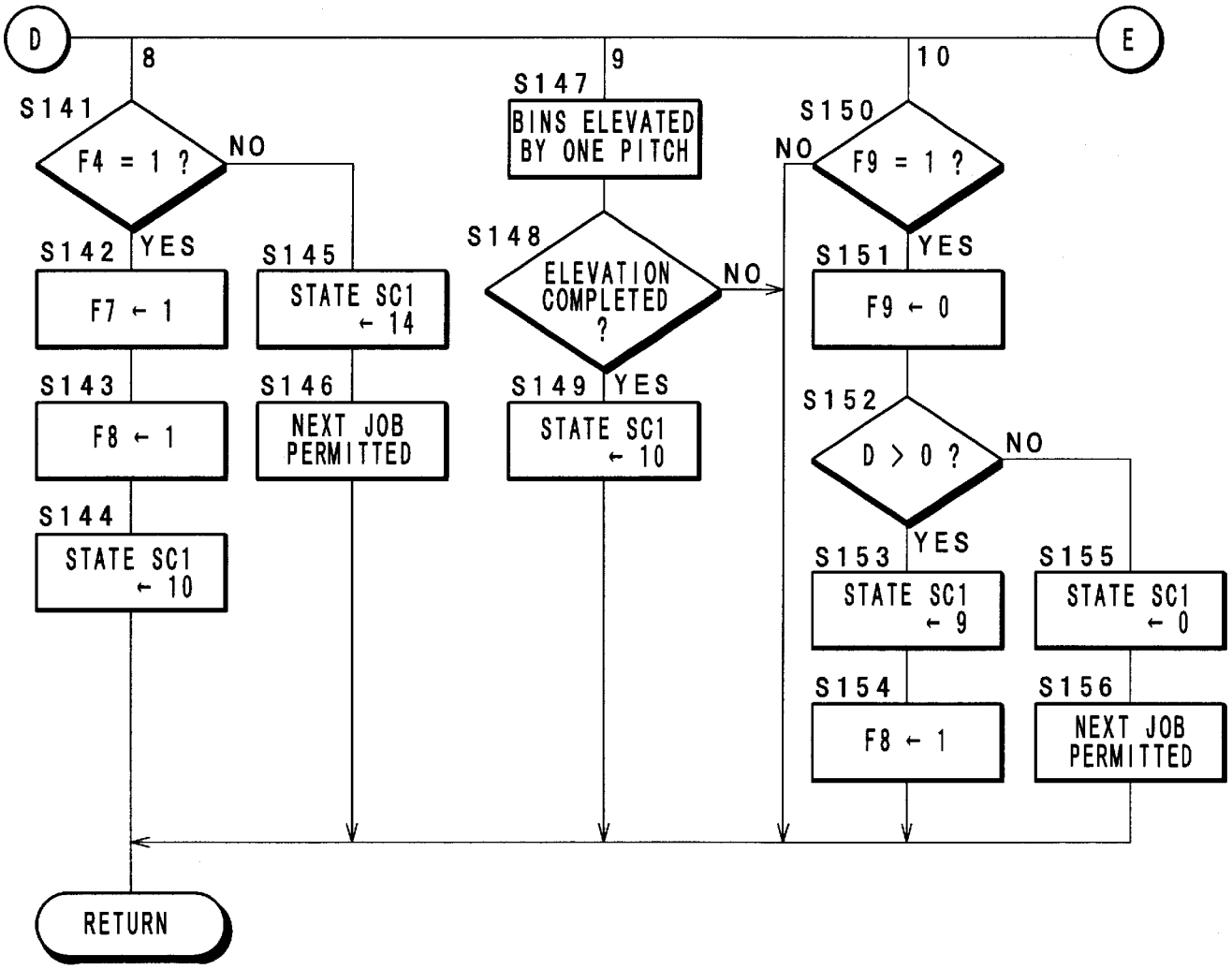
Figure 35E:
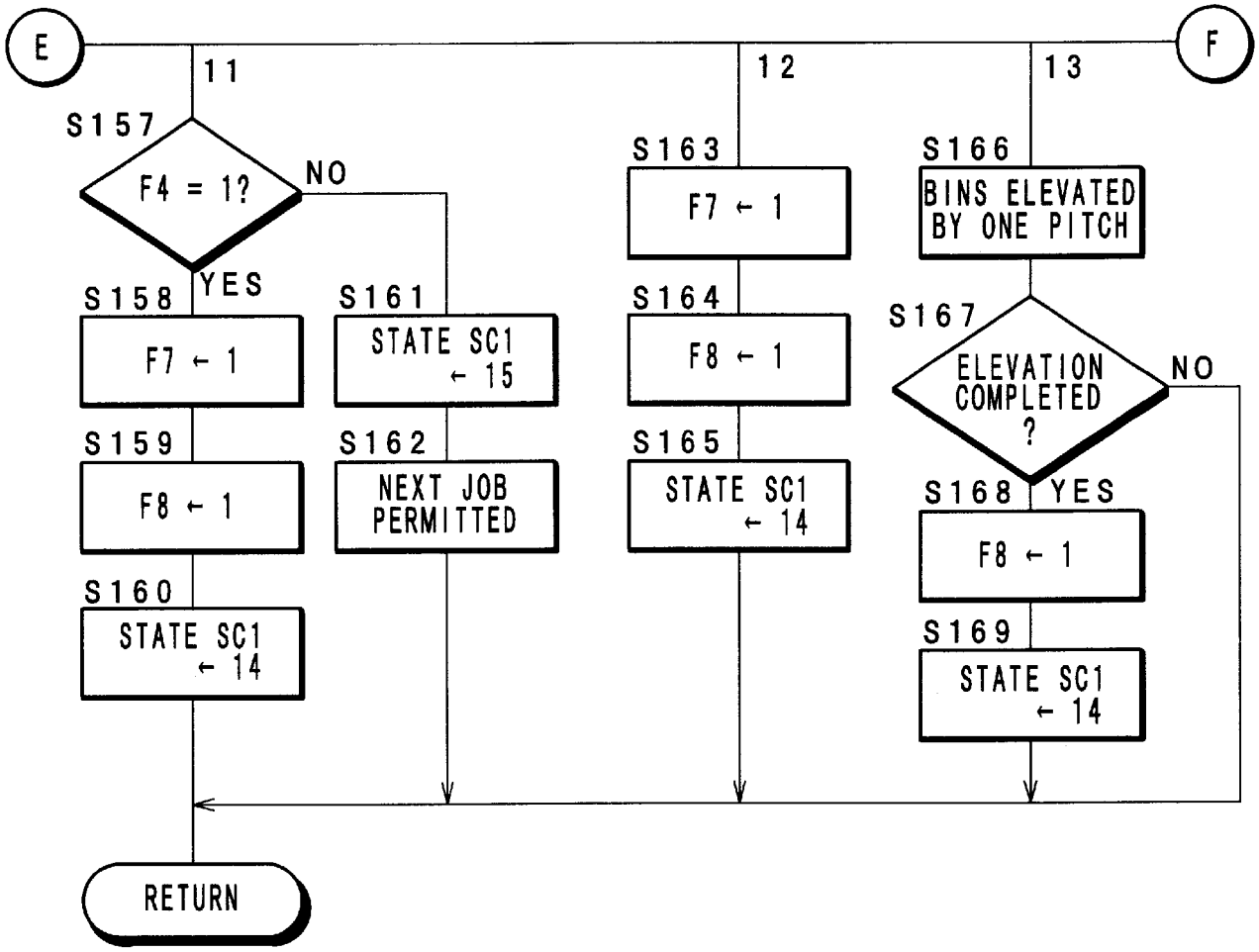
Figure 35F:
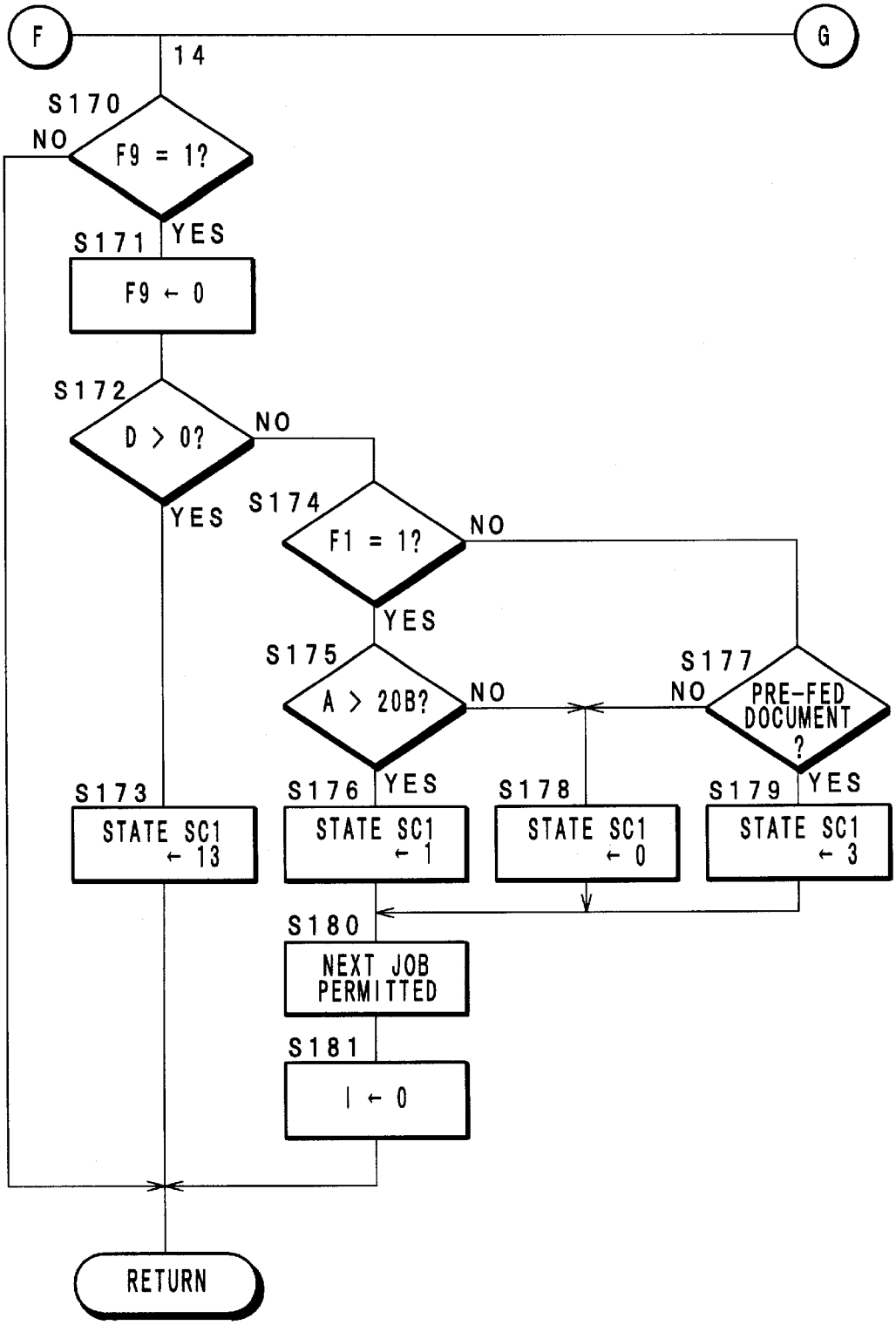
Figure 35G:
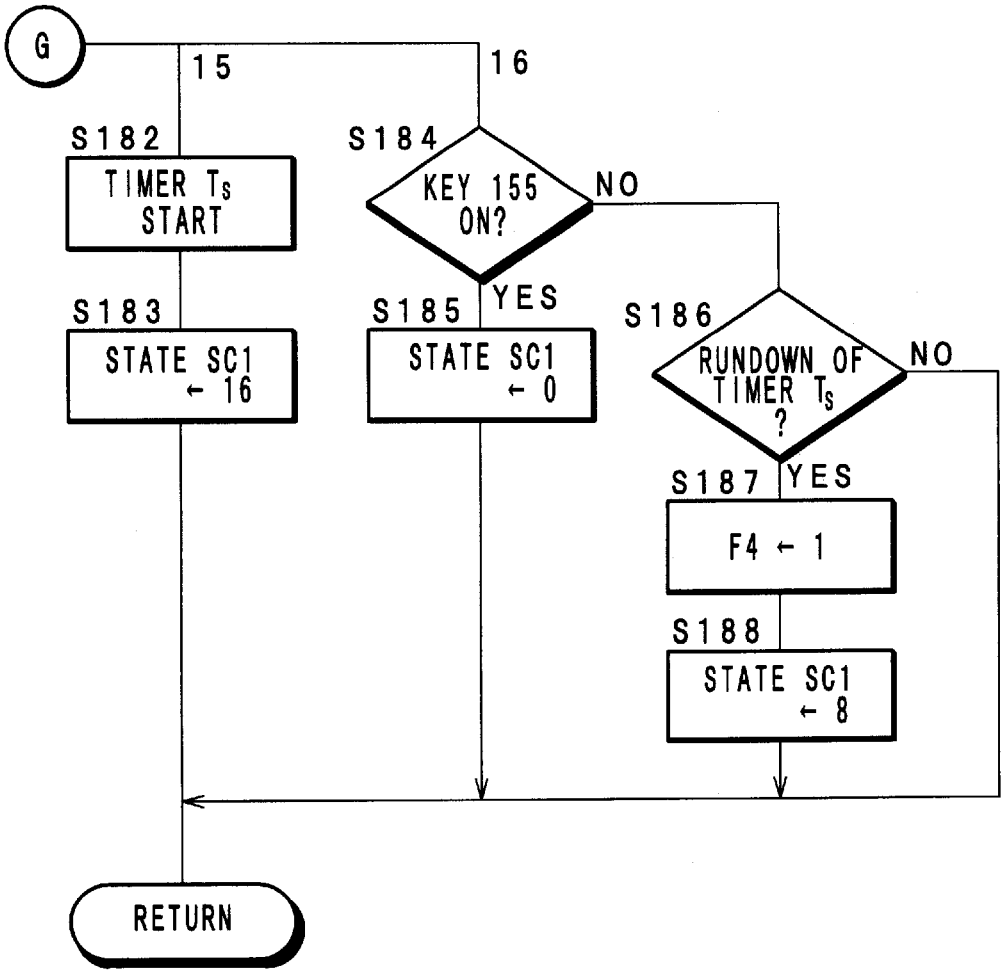

FIG. 34 shows a subroutine for a finish process which is carried out at step S5 of the main routine. In this subroutine, processes specified by the flags are executed.

If the sort flag F1 is "1" at step S81, control for sorting is executed at step S82. If the group flag F2 is "1" at step S83, control for grouping is executed at step S84. At step S85, control for the vertical movement of the bins 31 is executed. Further, if condition "A–20B>20". In other words, it is judged whether or not the number of copy sets to be made is more than 20. If "YES" at step S108, the value of the bin counter C is set to 20 at step S109. If "NO" at step S108, the value of the bin counter C is set to "A–20B". With this process at step S109 or S110, the number of bins to be used in the currently starting job is set in the bin counter C, and the same value is set in the take-out bin counter D at step S111. Then, the state counter SCI is set to "2".

When the state counter SC1 is "2", the completion of one job is confirmed at step S113. Then, the value of the job counter B is increased by one at step S114, and the state counter SC1 is set to "4".

When the state counter SC1 is "3", the completion of one job is confirmed at step S116. Then, the value of the group storing bin counter J is set in the bin counter C at step S117, and the state counter SC1 is set to "4" at step S118.

When the state counter SC1 is "4", the staple flag F3 is checked at step S119. If the flag F3 is "1", the first bin $\mathbf{31}_1$ is moved to the level $X_1$ at step S120. At this step, the first bin $\mathbf{31}_1$ is set in a stapling position, and the bins 31 are prepared to be sequentially subjected to stapling. Then, the completion of the movement of the bin $\mathbf{31}_1$ is confirmed at step S121, and the state counter SC1 is set to "5" at step S122.

On the other hand, if the staple flag F3 is "0", the first bin $\mathbf{31}_1$ is moved to the level $X_2$. At this step, the first bin $\mathbf{31}_1$ is set in a take-out position, and the bin 31 are prepared to be sequentially the staple unit operation flag F6 is "1" at step S86, the staple unit 70 is controlled at step S87. If the take-out flag F7 is "1" at step S88, the take-out unit 40 is controlled at step S89, and the sheet set conveyer gate 100 is controlled at step S90. If it is judged at step S91 that the flags F1 through F4 are all "0", control for non-sorting is executed at step S92.

Since the control for sorting and the control for grouping executed at steps S82 and S84 are well known as control for distributing copies among the bins 31, the descriptions thereof are omitted. Also, the control of the staple unit 70 executed at step S87 is well known as control for striking a staple into a set of sheets, the description thereof is omitted.

FIGS. 35*a* through 35*g* show a subroutine for the control of the bins 31 which is executed at step S85. In this subroutine, the value of a state counter SC1 is checked at step S100, and the program proceeds according to the value.

When the state counter SC1 is "0", the start of copying is confirmed at step S101, and the sort flag F1 is checked at step S102. If the sort flag F1 is "1", the job counter B is reset to "0" at step S103, the stapled-bin counter I is reset to "0" at step S104, and the state counter SC1 is set to "1" at step S105. On the other hand, if the sort flag F1 is "0" ("NO" at step S102), the counter I is reset to "0" at step S106, and the state counter SC1 is set to "3" at step S107.

When the state counter SC1 is "1", it is judged at step S108 whether or not the values of the counters A and B satisfy the subjected to take-out. Then, the completion of the movement of the first bin $\mathbf{31}_1$ is confirmed at step S124, and the state counter SC1 is set to "11".

When the state counter SC1 is "5", the staple unit operation flag F6 is checked at step S126. When the flag F6 is reset to "0", the value of the stapled-bin counter I is compared with the value of the bin counter C at step S127. If the value of the counter I is smaller than the value of the counter C, the stack flag F4 is checked at step S128. If the flag F4 is "1", the state counter SC1 is set to "12" at step S129. If the flag F4 is "0", the state counter SC1 is set to "6" at step S130. On the other hand, if the value of the counter I is not smaller than the value of the counter C ("NO" at step S127), that is, when all sets of sheets stored in the bins 31 have been subjected to stapling, the state counter SC1 is set to "8" at step S131.

When the state counter SC1 is "6", the bins 31 are moved up by one pitch at step S132. When the completion of the upward movement of the bins 31 is confirmed at step S133, the staple unit operation flag F6 is set to "1" at step S134. Then, the state counter SC1 is set to "7" at step S135.

When the state counter SC1 is "7", the staple unit operation flag F6 is checked at step S136. When the flag F6 is reset to "0", the value of the stapled-bin counter I is compared with the value of the bin counter C at step S137. If the value of the counter I is smaller than the value of the counter C, the state counter SC1 is set to "6" at step S138. On the other hand, if the value of the counter I is not smaller than the value of the counter C, that is, when all sets of sheets stored in the bins 31 have been subjected to stapling, the state counter SC1 is set to "15" at step S139, and the start of the next job is permitted at step S140.

When the state counter SC1 is "8", the stack flag F4 is checked at step S141. If the flag F4 is "1", the take-out flag F7 is set to "1" at step S142, and the take-out unit operation flag F8 is set to "1" at step S143. These steps are preparatory steps for take-out of sets of sheets from the bins 31 and transportation/stacking of the sets of sheets onto the non-sort tray 20. Then, the state counter SC1 is set to "10" at step S144. On the other hand, if the stack flag F4 is "0" ("NO" at step S141), the state counter SC1 is set to "14" at step S145, and the start of the next job is permitted at step S146.

When the state counter SC1 is "9", the bins 31 are moved up by one pitch at step S147. When the completion of the upward movement of the bins 31 is confirmed at step S148, that is, when one of the bins 31 is set in the take-out position on the level $X_2$, the state counter SC1 is set to "10" at step S149.

When the state counter SC1 is "10", the one-bin take-out completion flag F9 is checked at step S150. When the flag F9 is confirmed to be "1" at step S150, the flag 9 is reset to "0" at step S151. Next, the value of the take-out bin counter D is checked at step S152. If the value of the counter D is larger than 0, the state counter SC1 is set to "9" at step S153 so that the next bin 31 can be moved to the level $X_2$. Further, the take-out unit operation flag F8 is set to "1" at step S154. If the value of the counter D is 0, that is, when all sets of sheets stored in the bins 31 have been taken out thereof, the state counter SC1 is reset to "0" at step S155, and the start of the next job is permitted at step S156.

When the state counter SC1 is "11", the stack flag F4 is checked at step S157. If the flag F4 is "1", the take-out flag F7 is set to "1" at step S158, and the take-out unit operation flag F8 is set to "1" at step S159. These steps are preparatory steps for take-out of sets of sheets from the bins 31 and transportation/stacking of the sets of sheets onto the non-sort tray 20. Then, the state counter SC1 is set to "14" at step S160. On the other hand, if the stack flag F4 is "0" ("NO" at step S157), the state counter SC1 is set to "15" at step S161, and the start of the next job is permitted at step S162.

When the state counter SC1 is "12", the take-out flag F7 is set to "1" at step S163, and the take-out unit operation flag F8 is set to "1" at step S164. These steps are preparatory steps for take-out of stapled sets of sheets from the bins 31 and transportation/stacking of the sets of sheets onto the non-sort tray 20. Then, the state counter SC1 is set to "14".

When the state counter SC1 is "13", the bins 31 are moved up by one pitch at step S166. When the completion of the upward movement of the bins 31 is confirmed at step S167, that is, when the next bin 31 is set in the take-out position on the level $X_2$, the take-out unit operation flag F8 is set to "1" at step S168. Then, the state counter SC1 is set to "14" at step S169.

When the state counter SC1 is "14", the one-bin take-out completion flag F9 is checked at step S170. When the flag F9 is confirmed to be "1" at step S170, the flag F9 is reset to "0" at step S171. Next, the value of the take-out bin counter D is checked at step S172. If the value of the counter D is larger than 0, the state counter SC1 is set to "13" at step S173 so that the next bin 31 can be moved to the level $X_2$. If the value of the counter D is 0, that is, when all sets of sheets have been taken out of the bins 31, the sort flag F1 is checked at step S174. If the flag F1 is "1", it is judged at step S175 whether or not the value of the registered number counter A and the value of the job counter B satisfy the condition "A>20B". If the counter values satisfy the condition, that is, if the registered number of copy sets have not been made, the state counter SC1 is set to "1" at step S176. If the counter values do not satisfy the condition, that is, when the registered number of copy sets have been made, the state counter SC1 is reset to "0" at step S178.

On the other hand, if the sort flag F1 is "0" ("NO" at step S174), it is judged at step S177 whether or not there is a pre-fed document. Here, the pre-fed document means the twenty-first document which has been fed to a position right before the platen glass by the automatic document feeder 5. If there is a pre-fed document, the state counter SC1 is set to "3" at step S179, and if there is no pre-fed document, the state counter SC1 is reset to "0" at step S178.

Then, the start of the next job is permitted at step S180, and the stapled-bin counter I is reset to "0" at step S181.

When the state counter SC1 is "15", a timer Ts is started at step S182, and the state counter SC1 is set to "16" at step S183. The timer Ts is to automatically start transportation/stacking of sets of sheets from the bins 31 onto the non-sort tray 20 if some sets of sheets are left in the bins 31 even when a specified time has passed.

When the state counter SC1 is "16", the copy start key 155 is checked at step S184. If the key 155 is on, that is, if the next copying has been started, the state counter SC1 is reset to "0" at step S185. If the key 155 is not on, that is, if the next copying has not been started, the timer Ts is checked at step S186. When the end of the timer Ts is confirmed at step S186, the stack flag F4 is set to "1" at step S187, and the state counter SC1 is set to "8" at step S188. Thereby, sets of sheets left in the bins 31 are transported and stacked onto the non-sort tray 20.

Figure 36A:
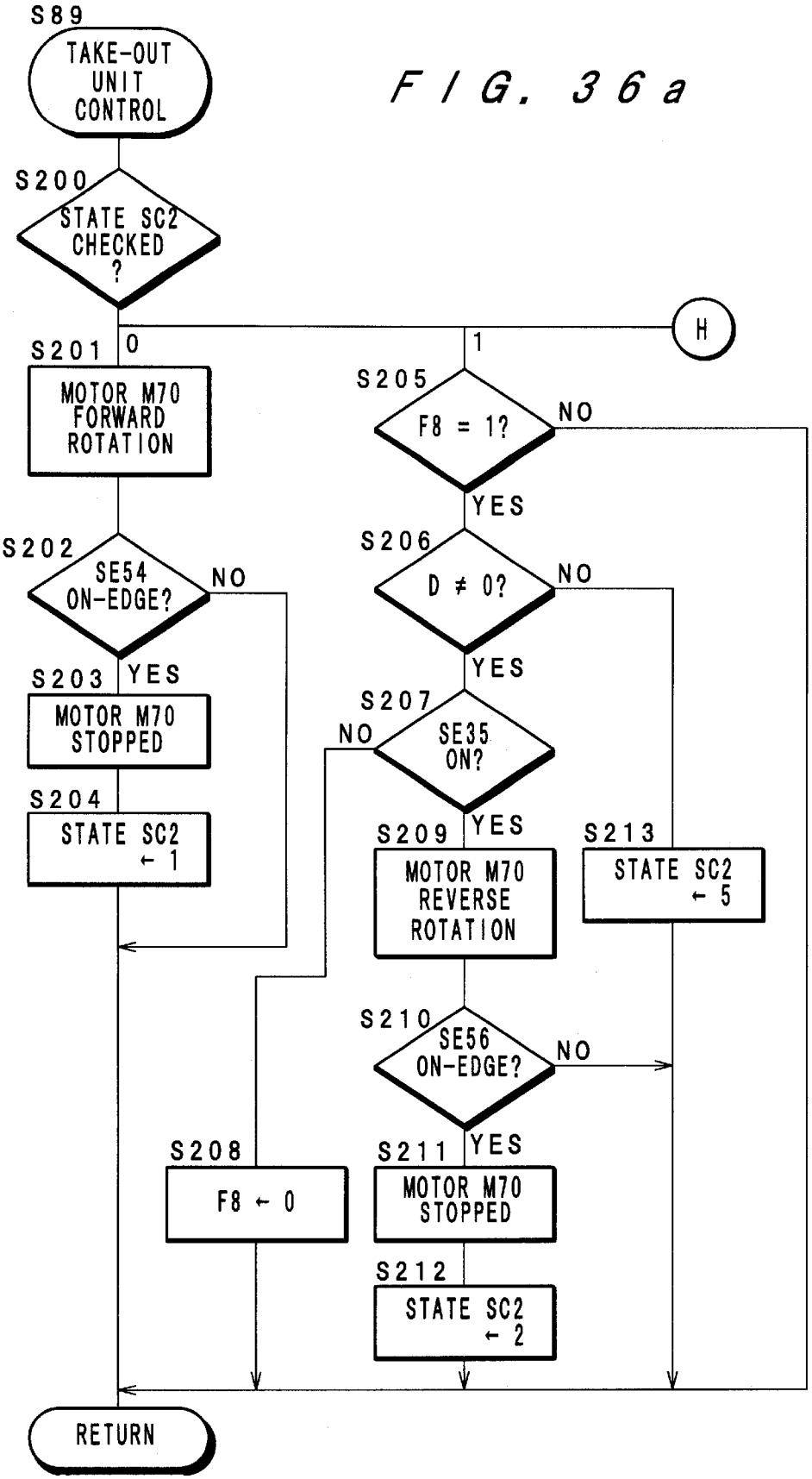
FIGS. 36*a* and 36*b* are flowcharts which show a subroutine or control of the take-out unit.
Figure 36B:
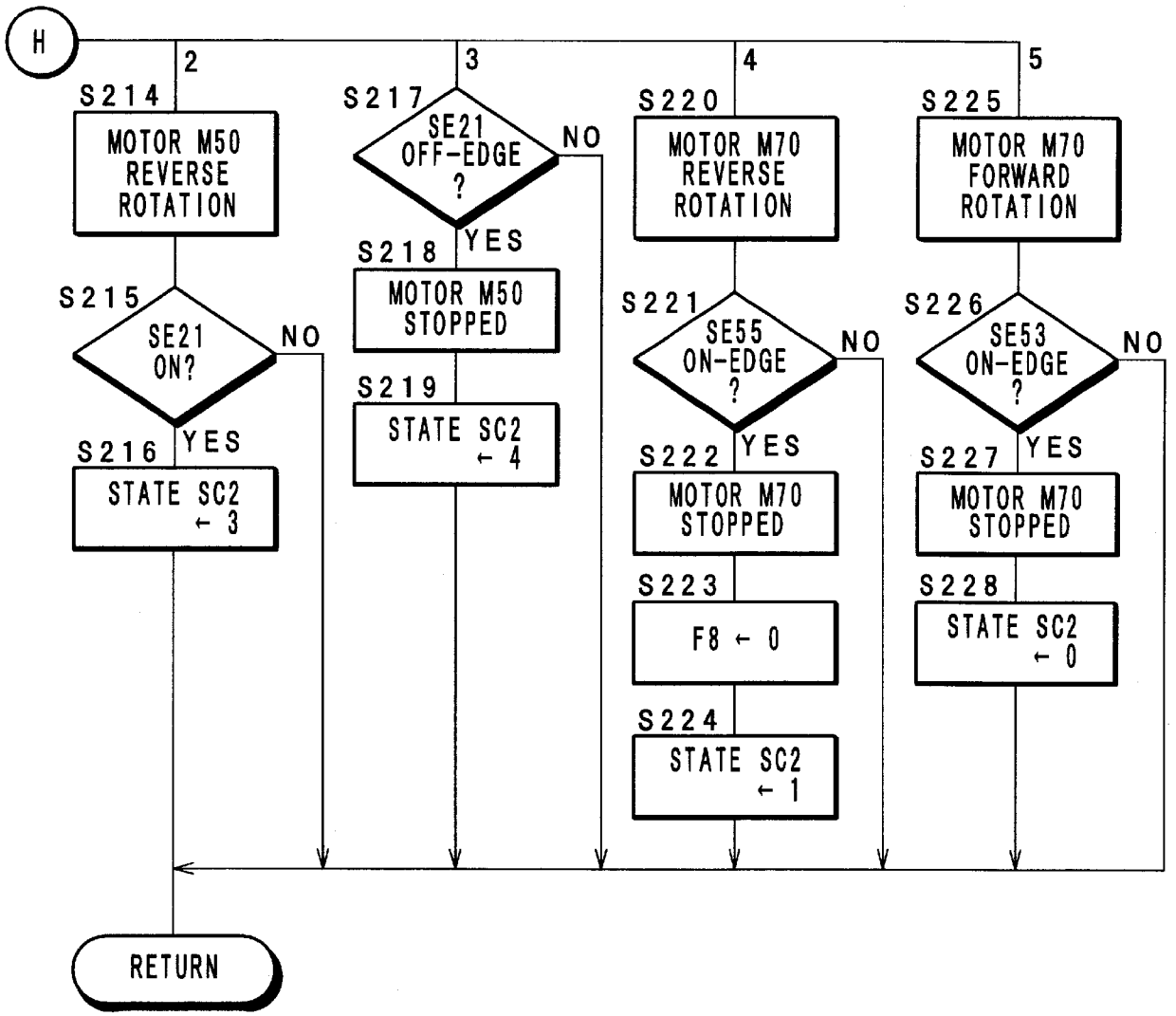
Figure 37A:
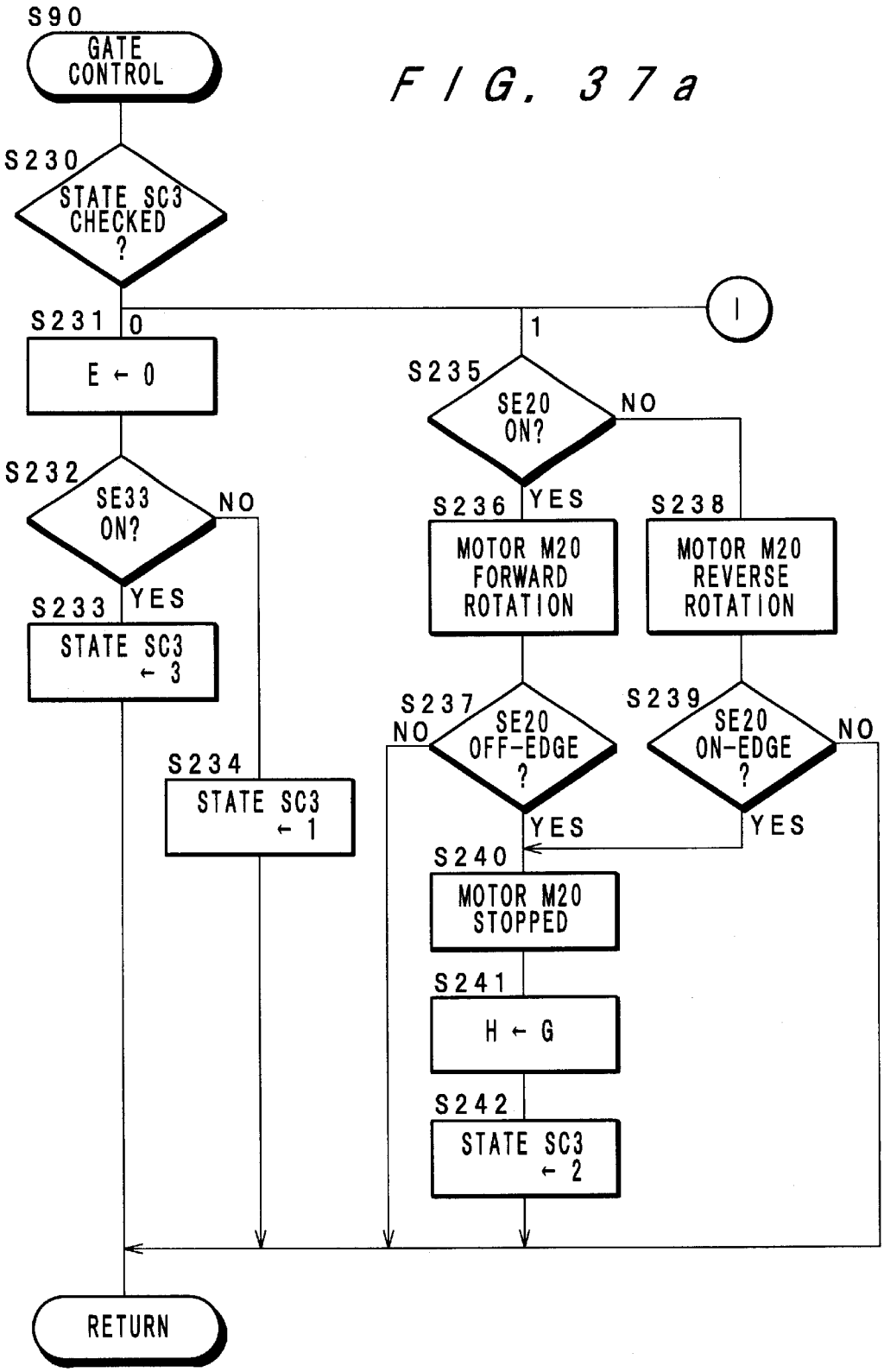
FIGS. 37*a* through 37*h* are flowcharts which show a ubroutine for control of the sheet set conveyer gate.
Figure 37B:
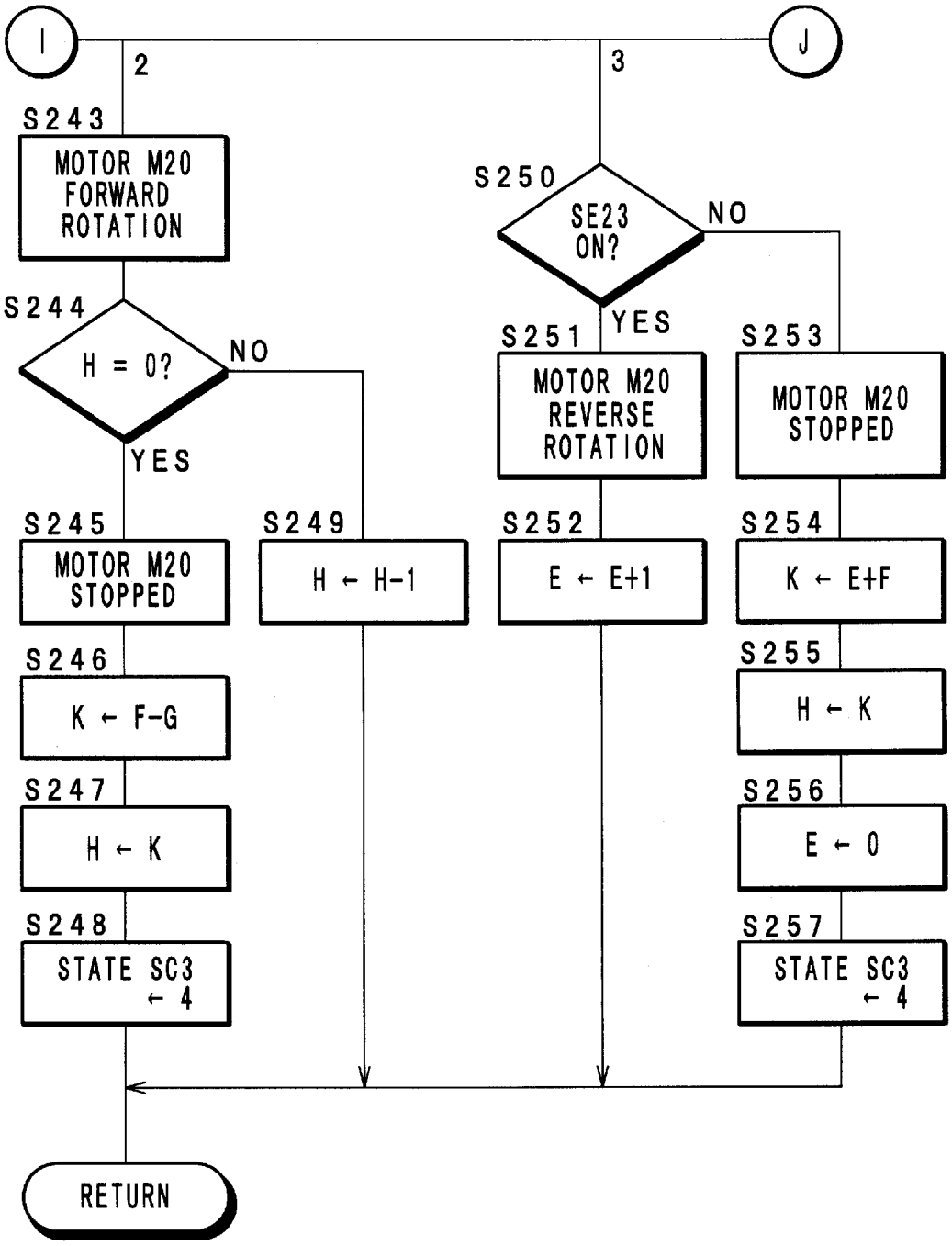
Figure 37C:
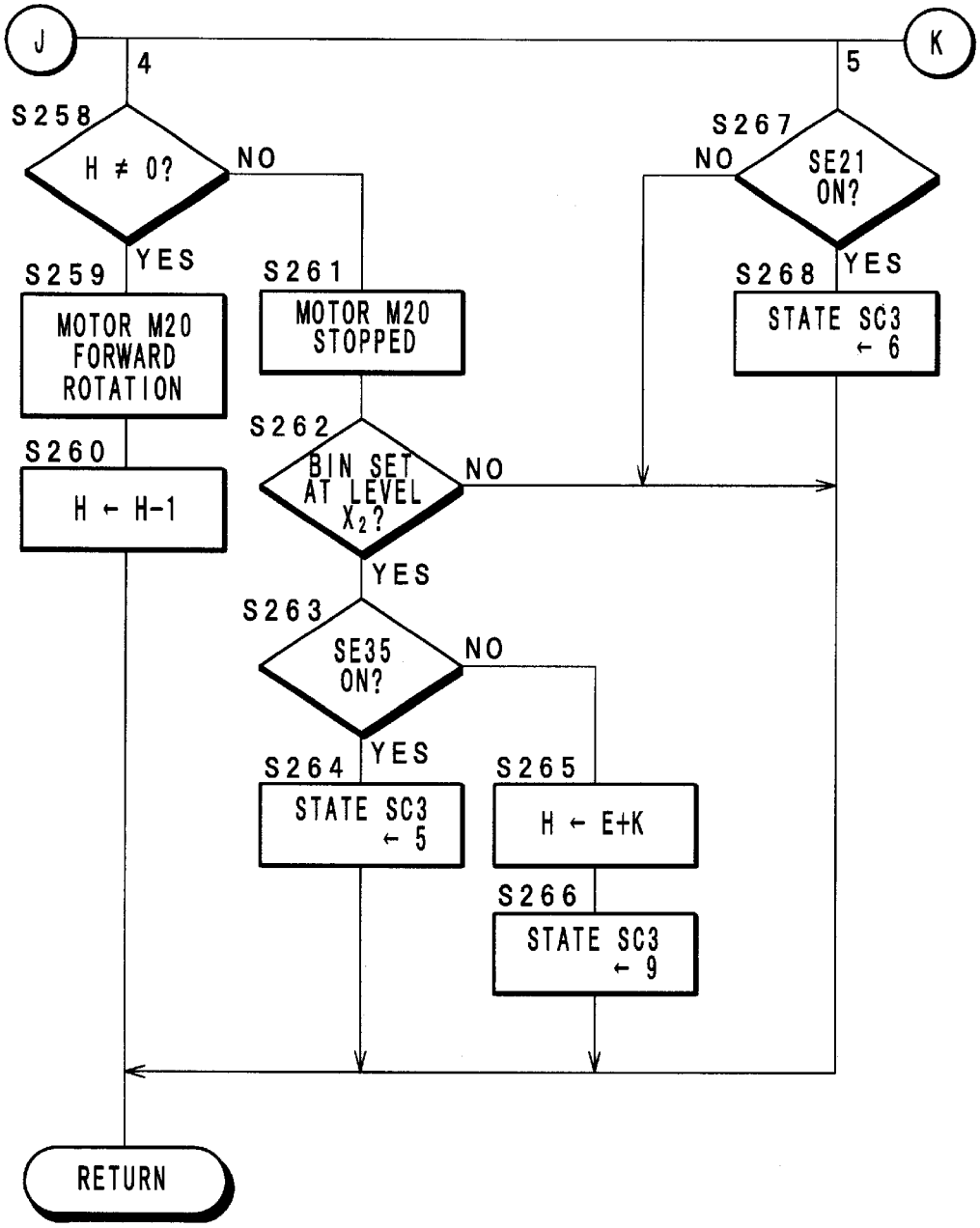
Figure 37D:
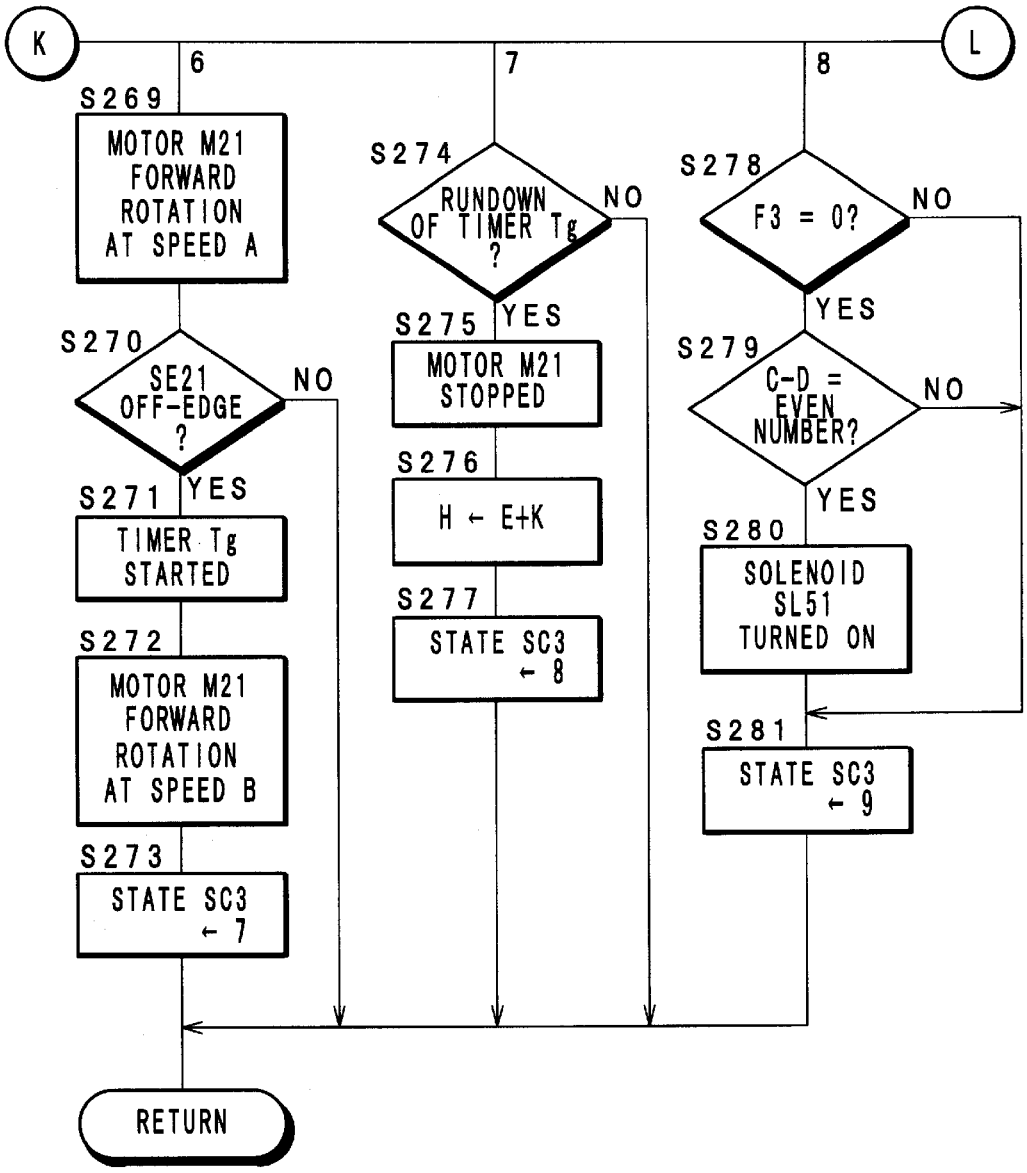
Figure 37E:
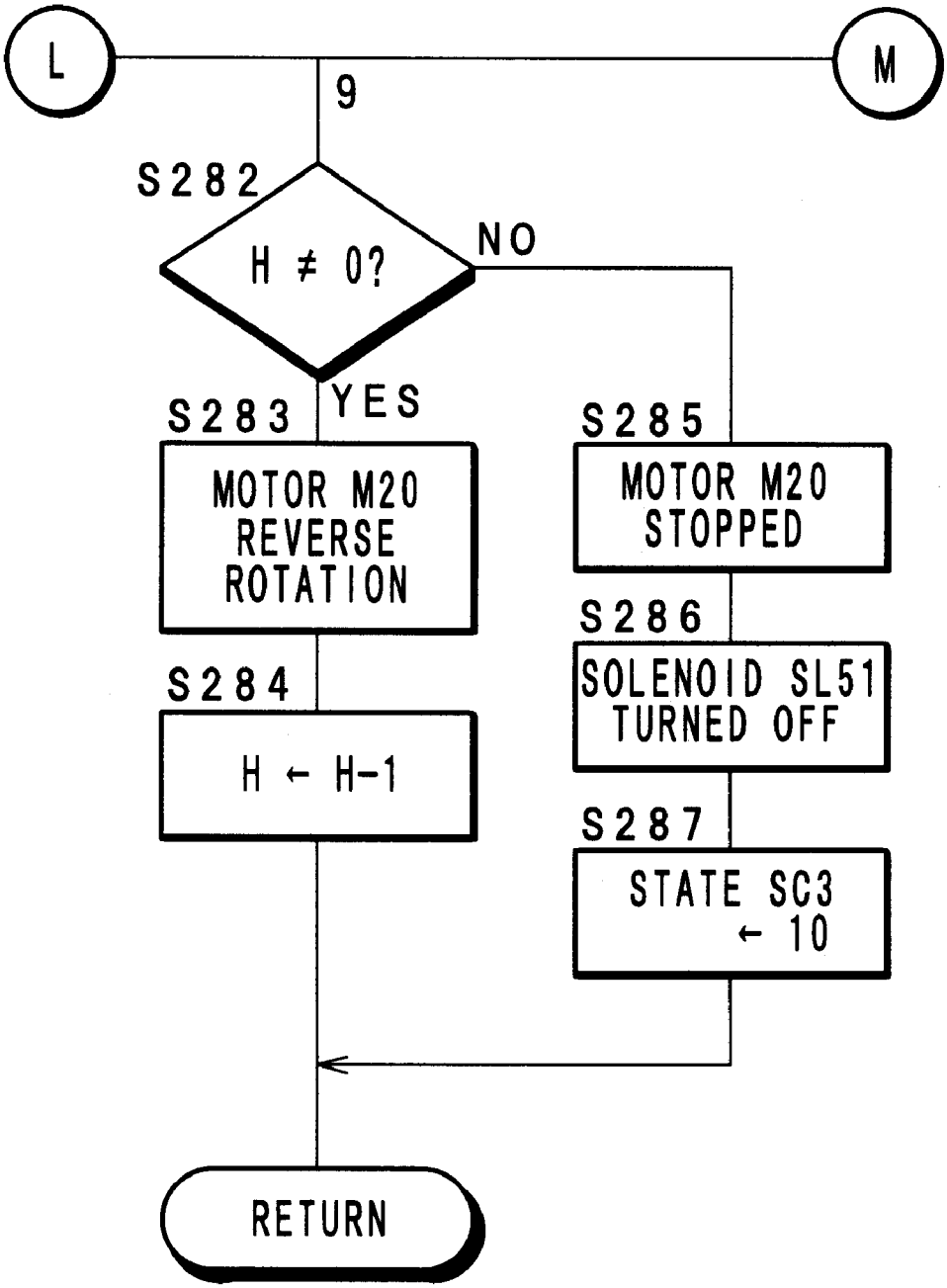
Figure 37F:
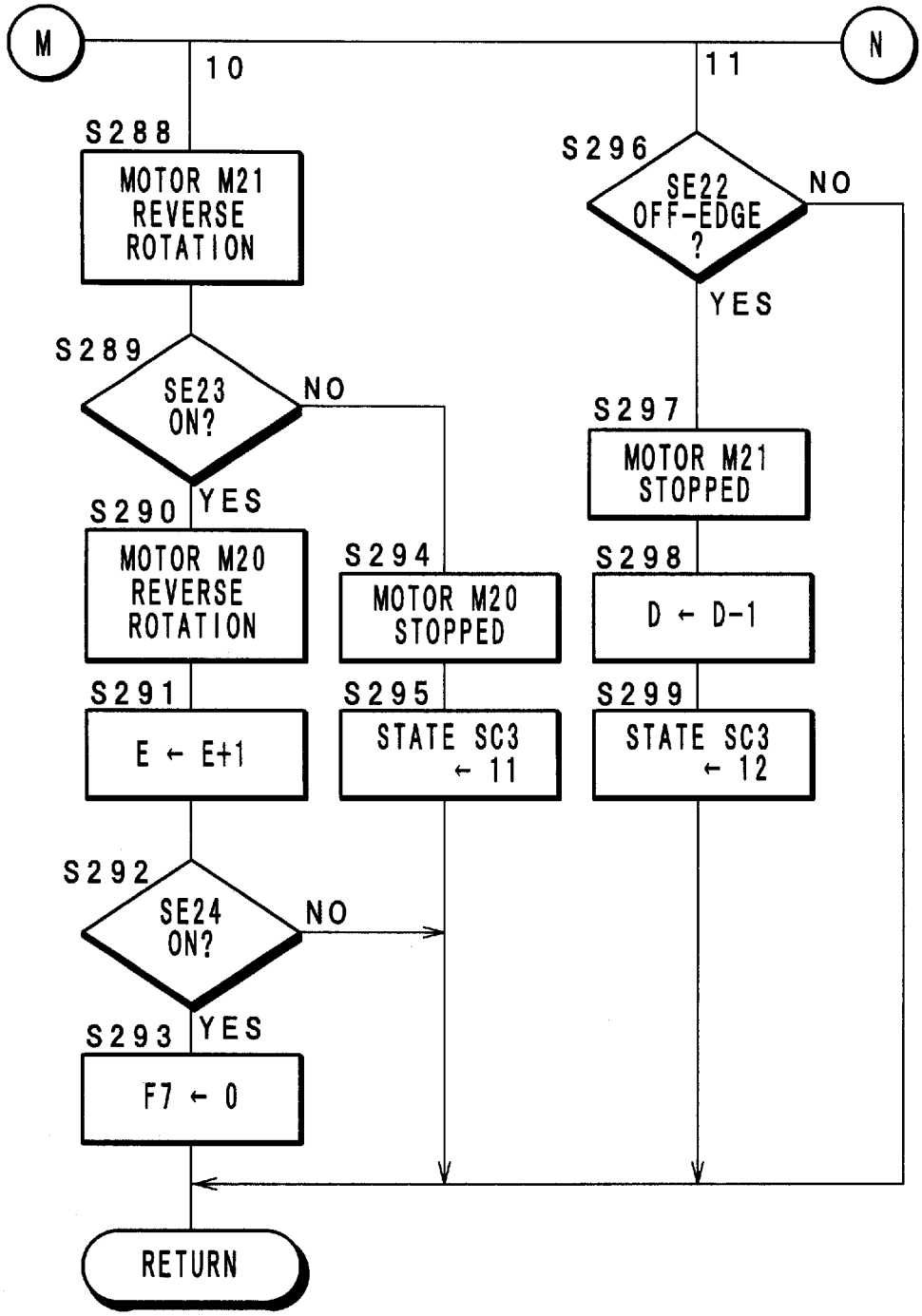
Figure 37G:
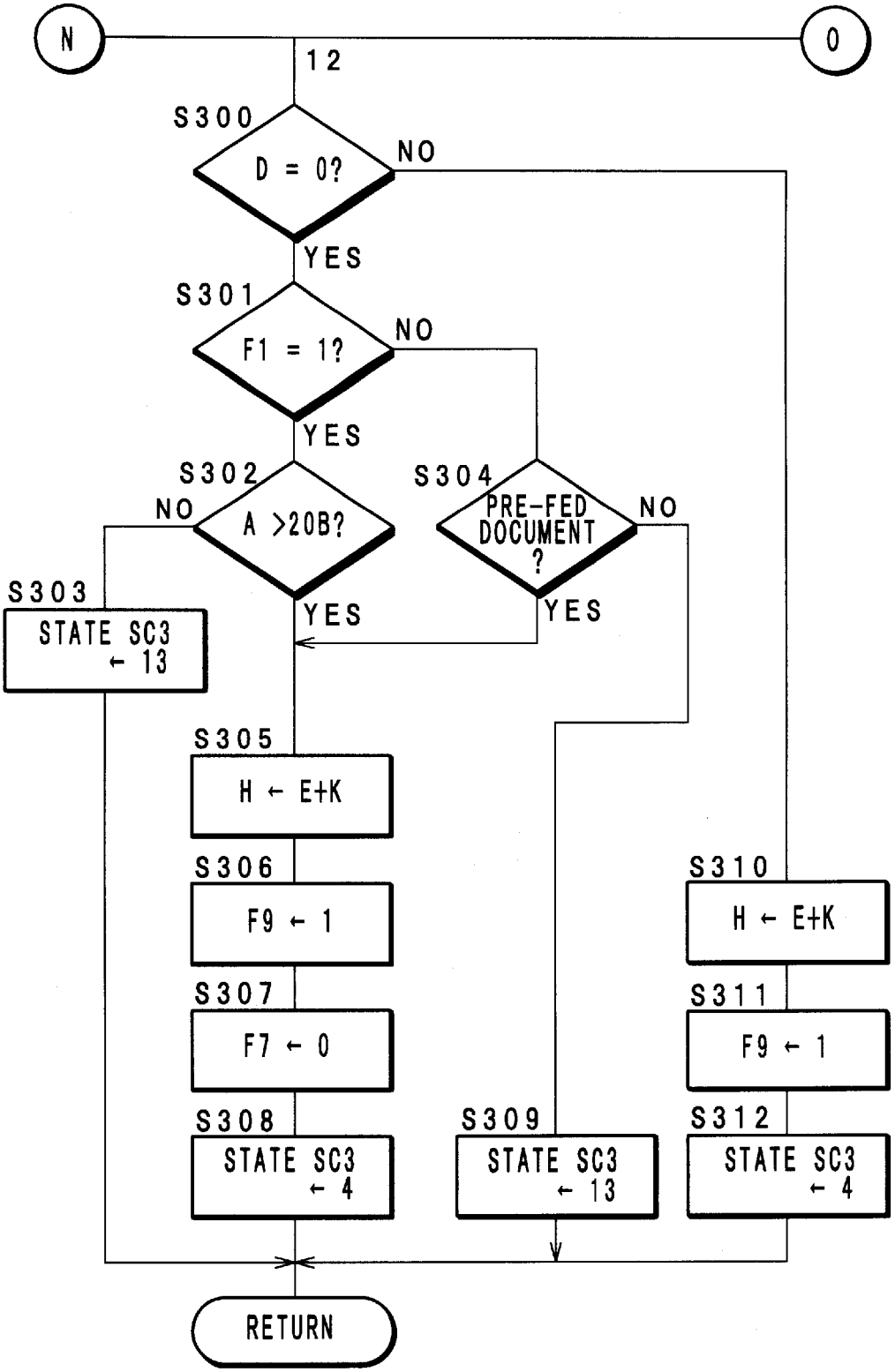
Figure 37H:
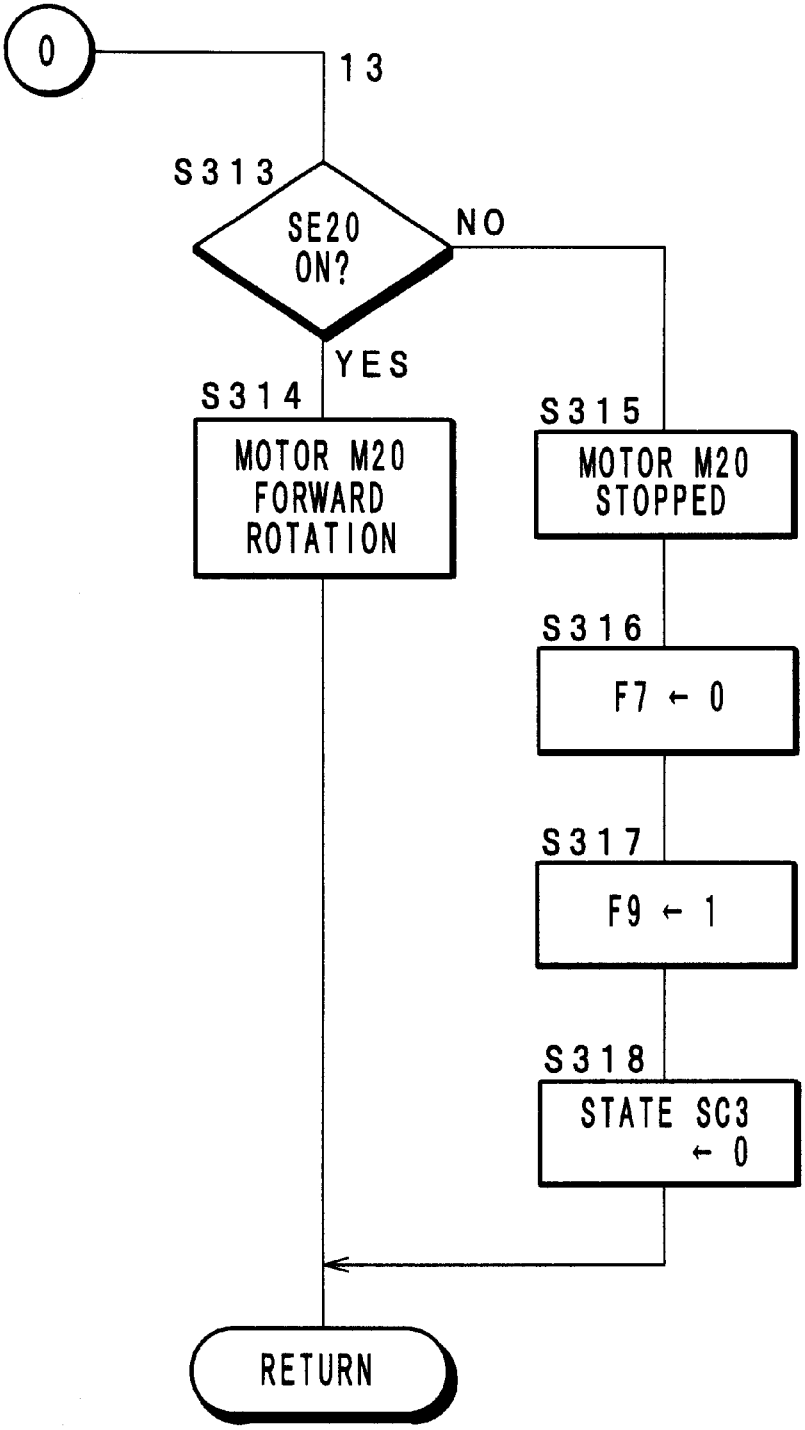

FIGS. 36*a* and 36*b* show a subroutine for the control of the take-out unit 40 which is carried out at step S89. In this subroutine, first, the value of a state counter SC2 is checked at step S200, and the program proceeds according to the value.

When the state counter SC2 is "0", the motor M70 is rotated forward at step S201. Thereby, the second conveyer section 90 retreats upward, and the upper arm 45 and the upper roller 42 come right above a set of sheets stored in the bins 31 in the take-out position on the level $X_2$. Next, the sensor SE54 is checked at step S202, and at an on-edge of the sensor SE54, that is, on the completion of the movement of the second conveyer section 90, the motor M70 is stopped at step S203. Then, the state counter SC2 is set to "1".

When the state counter SC2 is "1", the take-out unit operation flag F8 is checked at step S205. If the flag F8 is "1", the take-out bin counter D is checked at step S206. If the value of the counter D is 0, that is, when all sets of sheets have been taken out of the bins 31, the state counter SC2 is set to "5" at step S213. If the value of the counter D is not 0, the sensor SE35 is checked at step S207. The sensor SE35 is to detect the presence or absence of a set of sheets in a bin 31 set on the level $X_2$. If the sensor SE35 is judged to be off (no sheets in the bin 31) at step S207, the take-out unit operation flag F8 is reset to "0" at step S208. If the sensor SE35 is judged to be on at step S207, the motor M70 is rotated in reverse at step S209. Thereby, the lower arm 46 pivots in the direction of arrow "c" (see FIG. 3), and the lower roller 43 holds up the set of sheets in the bin 31. Next, when an on-edge of the sensor SE56 is judged at step S210, that is, on the completion of nipping of the set of sheets between the rollers 42 and 43, the motor M70 is stopped at step S211. Then the state counter SC2 is set to "2".

When the state counter SC2 is "2", the transport motor M50 is rotated in reverse at step S214. Thereby, the rollers 42 and 43 start rotating to draw the set of sheets out of the bin 31 to the sheet set conveyer gate 100. When the sensor SE21 is judged to be on at step S215, that is, when the set of sheets is being delivered to the gate 100, the state counter SC2 is set to "3" at step S216.

When the state counter SC2 is "3", the sensor SE21 is checked at step S217. At an off-edge of the sensor SE21, that is, when the set of sheets has been completely delivered to the rollers 102 and 103 of the gate 100, the transport motor M50 is stopped at step S218. Then, the state counter SC2 is set to "4" at step S219.

When the state counter SC2 is "4", the motor M70 is rotated in reverse at step S220. Thereby, the lower arm 46 and the lower roller 43 start returning to the home position. Next, an on-edge of the sensor SE55 is judged at step S221, that is, when the return of the lower arm 46 and the lower roller 43 is completed, the motor M70 is stopped at step S222. Then, the take-out unit operation flag F8 is reset to "0" at step S223, and the state counter SC2 is set to "1" at step S224.

When the state counter SC2 is "5", the motor M70 is rotated forward at step S225. Thereby, the second conveyer section 90 starts returning to the home position. Next, an on-edge of the sensor SE53 is judged at step S226, that is, when the return of the second conveyer section 90 is completed, the motor M70 is stopped at step S227. Then, the state counter SC2 is reset to "0" at step S228.

FIGS. 37*a* through 37*h* show a subroutine for the control of the sheet set conveyer gate 100 which is carried out at step S90. In this subroutine, the value of a state counter SC3 is checked at step S230, and the program proceeds according to the value.

When the state counter SC3 is "0", the travel summation counter E is reset to "0" at step S231, and the sensor SE33 is checked at step S232. The sensor SE33 is to detect the presence or absence of a sheet on the non-sort tray 20. If the sensor SE33 is judged to be on at step S232, that is, if there are any sheets on the tray 20, the state counter SC3 is set to "3" at step S233. If the sensor SE33 is judged to be off, that is, if there are no sheets on the tray 20, the state counter SC3 is set to "1" at step S234.

When the state counter SC3 is "1", the gate home position sensor SE20 is checked at step S235. If the sensor SE20 is on, that is, if the gate 100 is above the home position, the gate up/down motor M20 is rotated forward at step S236 to move down the gate 100. When an off-edge of the sensor SE20 is judged at step S237, the motor M20 is stopped at step S240. On the other hand, if the sensor SE20 is judged to be off at step S235, that is, if the gate 100, is below the home position, the motor M20 is rotated in reverse to move up the gate 100. When an on-edge of the sensor SE20 is judged at step S239, the motor M20 is stopped at step S240. Next, at step S241, the value of the second travel constant counter G, which indicates the travel distance of the gate 100 from the home position to the second position, is set in the total travel counter H. Then, the state counter SC3 is set to "2" at step S242.

When the state counter SC3 is "2", the gate 100 is moved to the second position. First, the motor M20 is rotated forward at step S243 to move down the gate 100. Next, the total travel counter H is checked at step S244. If the value of the counter H is not 0, the value of the counter H is reduced by one at step S249. The value of the counter H decreases in accordance with the rotation of the motor M20. When the value of the counter H becomes 0, the motor M20 is stopped at step S245. Simultaneously, at step S246, a value calculated by subtracting the value of the second travel constant counter G from the value of the first travel constant counter F is set in the stacking start position counter K. The value "F−G" indicates the travel distance for the gate 100 to reach the take-out position from the second position. Then, the same value is set in the total travel counter H at step S247, and the state counter SC3 is set to "4" at step S248.

When the state counter SC3 is "3", the sensor SE23 is checked at step S250. The sensor SE23 is to detect the upper surface of a stack of sheets on the non-sort tray 20. If the sensor SE23 is judged to be on at step S250, the motor M20 is rotated in reverse to move up the gate 100. Next, the value of the travel summation counter E is increased by one at step S252. The value of the counter E increases in accordance with the rotation of the motor M20. Then, when the sensor SE23 is turned off, the motor M20 is stopped at step S253, and a value calculated by adding the value of the travel summation counter E to the value of the first travel constant counter F is set in the stacking start position counter K at step S254. The value "E+F" indicates the travel distance for the gate 100 to reach the take-out position from the position. Next, the same value is set in the total travel counter H at step S255, and the travel summation counter E is reset to "0" at step S256. Then, the state counter SC3 is set to "4" at step S257.

When the state counter is "4", the total travel counter H is checked at step S258. If the value of the counter H is not 0, the motor M20 is rotated forward at step S259 to move down the gate 100. Next, the value of the total travel counter H is reduced by one at step S260. The value of the counter H decreases in accordance with the rotation of the motor M20. When the value of the counter H becomes 0 ("NO" at step S258), the motor M20 is stopped at step S261. Next, it is confirmed at step S262 that a bin 31 is set on the level $X_2$, and the sensor SE35 is checked at step S263. The sensor SE35 is to detect the presence or absence of a sheet in the bin 31 set on the level $X_2$. If the sensor SE35 is on (the presence of a sheet), the state counter SC3 is set to "5" at step S264. If the sensor SE35 is off (the absence of a sheet), a value calculated by adding the value of the travel summation counter E and the value of the stacking start position counter K is set in the total travel counter H at step S265, and the state counter SC3 is set to "9" at step S266. The value "E+K" indicates the travel distance for the gate 100 to reach the delivering position from the take-out position. Thus, if there are no sheets in the bin 31 on the level $X_2$, the gate 100 is once returned to the delivering position.

When the state counter SC3 is "5", the sensor SE21 is checked at step S267. The sensor SE21 is to detect a set of sheets being taken out of a bin 31 and delivered toward the gate 100 by the take-out unit 40. When the sensor SE21 is turned on, the state counter SC3 is set to "6" at step S268.

When the state counter SC3 is "6", at step S269, the roller drive motor M21 is rotated forward at a speed A. The speed A of the motor M21 is such a speed that the rollers 102 and 103 can be rotated to have a higher transporting speed than the transporting speed of the rollers 42 and 43 of the take-out unit 40. With the rotation of the motor M21, the rollers 102 and 103 are rotated forward and receive a set of sheets from the take-out unit 40. When an off-edge of the SE21 is judged at step S270, that is, when the set of sheets has been completely taken out of the bin 31 and received by the gate 100, a timer Tg is started at step S271. Simultaneously, the speed of the motor M21 is reduced to a speed B at step S272, and the state counter SC3 is set to "7" at step S273.

When the state counter SC3 is "7", the timer Tg is checked at step S274. When the end of the timer Tg is confirmed at step S274, the motor M21 is stopped at step S275. The timer Tg counts a time which is required for the set of sheets nipped between the rollers 102 and 103 to come to the state shown in FIGS. 13*c* and 15. Then, a value calculated by adding the value of the travel summation counter E to the value of the stacking start position counter K is set in the total travel counter H at step S276, and the state counter SC3 is set to "8" at step S277. The value indicates the travel distance for the gate 100 to reach the previous delivering position.

When the state counter SC3 is "8", the staple flag F3 is checked at step S278. If the flag F3 is "0", that is, if the set of sheets to be transported to the non-sort tray 20 by the gate 100 is unstapled, it is judged at step S279 whether or not a value calculated by subtracting the value of the take-out bin counter D from the value of the bin counter C is an even number. The value indicates the ordinal number of the bin where the set of sheets to be transported to the tray 20 was stored. If this value is an even number, the solenoid SL51 is turned on at step S280 to shift the movable frame 133 (see FIG. 19) during the upward movement of the gate 100, whereby the set of sheets is delivered onto the tray 20 shifting from a set of sheets previously delivered to the tray 20. Then, the state counter SC3 is set to "9" at step S281.

When the state counter SC3 is "9", the total travel counter H is checked at step S282. If the value of the counter H is not 0, the gate up/down motor M20 is rotated in reverse at step S283 to move up the gate 100. Next, the value of the counter H is reduced by one at step S284. The value of the counter H decreases in accordance with the rotation of the motor M21. When the value of the counter becomes 0 ("NO" at step S282), the motor M20 is stopped at step S285, and the solenoid SL51 is turned off at step S286. Then, the state counter SC3 is set to "10" at step S287.

When the state counter SC3 is "10", the roller drive motor M21 is rotated in reverse at step S288. Thereby, the rollers 102 and 103 are rotated in reverse to deliver a set of sheets to the non-sort tray 20. Next, the sensor SE23 which detects the upper surface of a stack of sheets on the tray 20 is checked at step S289. If the sensor SE23 is on, the motor M20 is rotated in reverse to move up the gate 100 at step S290, and the value of the travel summation counter E is increased by one. When the sensor SE23 is turned off, the motor M20 is stopped at step S294, and the state counter SC3 is set to "11" at step S295. In this way, as the volume of the stack of sheets on the non-sort tray 20 is increasing, the delivering position of the gate 100 is set higher.

During the upward movement of the gate 100, the sensor SE24 is checked at step S292. When the sensor SE24 is turned on, that is, when the tray 20 has been stored with sheets to its capacity, the take-out flag F7 is reset to "0" at step S293. Thereby, transportation/stacking of succeeding sets of sheets onto the tray 20 is cancelled.

When the state counter SC3 is "11", the sensor SE22 is checked at step S296. At an off-edge of the sensor SE22, that is, when a set of sheets has been delivered from the gate 100 to the tray 20, the motor M21 is stopped at step S297. Then, the value of the take-out bin counter D is reduced by one at step S298, and the state counter SC3 is set to "12".

When the state counter SC3 is "12", the take-out bin counter D is checked at step S300. If the value of the counter D is 0, the sort flag F1 is checked at step S301. If the flag F1 is "1", it is judged at step S302 whether or not the value of the registered number counter A and the value of the job counter B satisfy the condition "A>20B". If the condition is fulfilled, that is, if the copying is to be continued, a value calculated by adding the value of the travel summation counter E to the value of the stacking start position counter K is set in the counter H at step S305. Next, the one-bin take-out completion flag F9 is set to "1" at step S306, and the take-out flag F7 is reset to "0" at step S307. Then, the state counter SC3 is set to "4". If the condition "A>20B" is not fulfilled ("NO" at step S302), that is, if the copying to make the registered number of copy sets has been completed, the state counter SC3 is set to "13" at step S303.

If the copying is in the group mode ("NO" at step S301), it is judged at step S304 whether or not there is a pre-fed document (see step S177). If there is a pre-fed document, the copying is to be continued, the processes at steps S305 through S308 are executed. If there is no pre-fed document, the state counter SC3 is set to "13" at step S309.

On the other hand, if the value of the take-out bin counter D is not 0 ("NO" at step S300), in order to take a set of sheets out of the next bin, a value calculated by adding the value of the travel summation counter E to the value of the stacking start position counter K is set in the total travel counter H at step S310. Next, the one-bin take-out completion flag F9 is set to "1" at step S311, and the state counter SC3 is set to "4" at step S312.

When the state counter SC3 is "13", if the gate 100 is above the home position, the gate 100 is returned to the home position 100. The home position sensor SE20 is checked at step S313, and if the sensor SE20 is on, the gate up/down motor M20 is rotated forward to move down the gate 100. When the sensor SE20 is turned off ("NO" at step S313), the motor M20 is stopped at step S315. Next, the take-out flag F7 is reset to "0" at step S316, and the one-bin take-out completion flag F9 is set to "1" at step S317. Then, the state counter SC3 is reset to "0" at step S318.

Figure 38:
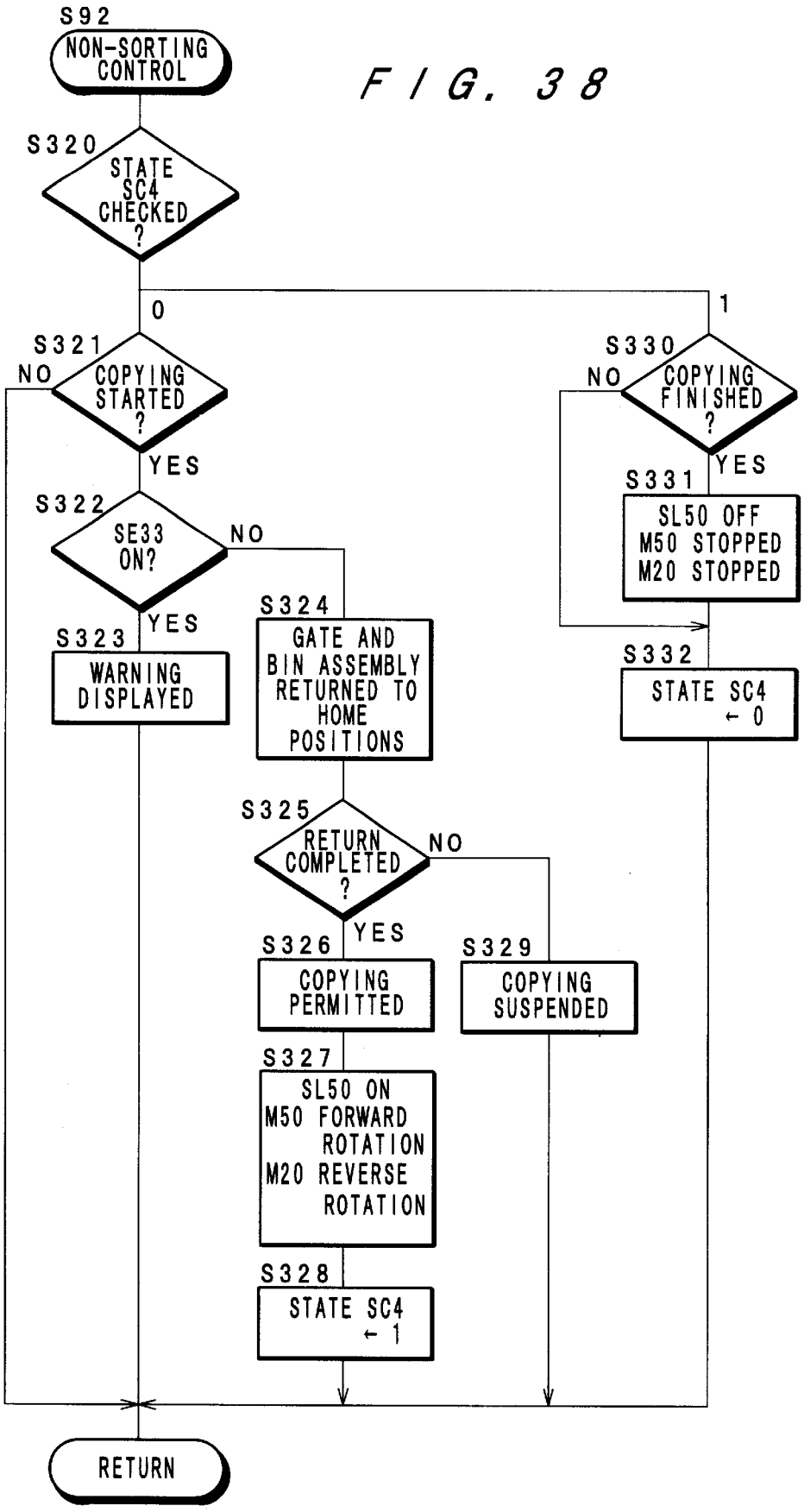
FIG. 38 is a flowchart which shows a subroutine for control or non-sorting.

FIG. 38 shows a subroutine for the control for non-sorting which is carried out at step S92. In this subroutine, first, the value of a state counter SC4 is checked at step S320, and the program proceeds according to the value.

When the state counter SC4 is "0", it is judged at step S321 whether or not start of copying has been commanded. If the start of copying is judged, the sensor SE33 is checked at step S322. If the sensor SE33 is on, which means that there is a sheet on the non-sort tray 20, a warning display is presented on the touch panel 151 at step S323. If the non-sort tray 20 is empty ("NO" at step S322), the gate 100 and the bin assembly 30 are returned to the respective home positions at step S324.

Next, when the return of the gate 100 and the bin assembly 30 is confirmed at step S325, execution of copying is permitted at step S326. Subsequently, at step S327, the solenoid SL50 is turned on, the transport motor M50 is rotated forward, and the roller drive motor M20 is rotated in reverse. Thereby, the diverter 82 is set in the position to guide a sheet to the non-sort tray 20, and sheets ejected from the copying machine 1 are delivered to the non-sort tray 20 directly. Then, the state counter SC4 is set to "1" at step S328. Until the gate 100 and the bin assembly 30 has returned to the respective home positions, at step S329, the copying is stopped from starting.

When the state counter SC4 is "1", it is judged at step S330 whether the copying is completed. When the completion of the copying is judged, at step S331, the solenoid SL50 is turned off, and the motors M50 and M20 are stopped. Then, the state counter SC4 is reset to "0" at step S332.

The present invention is applicable not only to a staple-sorter attached to a copying machine but also to a staple-sorter attached to a printer which outputs image data transmitted from a host computer as a hard copy.

The bin assembly 30 and the sheet conveyer section 80 may have any structure. For example, if such a staple-sorter is to be attached to a copying machine or a printer which has an image memory and is capable of forming images in order of page to make a desired number of copy sets, only a single bin 31, not a plurality of bins 31, is necessary. Also, it is possible to provide a stale bin where stapling is performed besides the sort bins 31.

Although the present invention has been described with reference to the preferred embodiment above, it is to be noted that various changes and modifications are possible to those who are skilled in the art. Such changes and modifications are to be noted as being within the scope of the present invention.

What is claimed is:

1. A sheet handling apparatus comprising:

a tray which can receive a large number of sheets thereon;

a plurality of bins among which sheets are distributed for sorting;

conveying means which transports a set of sheets from each of the bins to the trays and delivers the set of sheets onto the tray; and pressing means which presses sets of sheets which have been delivered and stacked on the tray when a set of sheets is being delivered onto the tray, said pressing means being connected to said conveying means.

2. The sheet handling apparatus as claimed in claim 1, wherein the pressing means is disposed at an entrance side of the tray.

3. The sheet handling apparatus as claimed in claim 1, wherein the conveying means has a pair of rollers which nips and holds a set of sheets.

4. The sheet handling apparatus as claimed in claim 3, wherein the conveying means rotates the pair of rollers near the entrance of the tray to deliver a set of sheets onto the tray.

5. The sheet handling apparatus as claimed in claim 4, wherein the pressing means moves to a position to press sets of sheets on the tray with the rotation of the rollers.

6. The sheet handling apparatus as claimed in claim 5, wherein the pressing means comes to press sets of sheets on the tray with the rotation of the rollers for delivery of a set of sheets onto the tray and releases the sets of sheets with reverse rotation of the rollers.

7. The sheet handling apparatus as claimed in claim 6, wherein the tray is disposed above the plurality of bins.

8. A sheet handling apparatus comprising:

a tray which can receive a large number of sheets thereon;

a plurality of bins among which sheets are distributed for sorting;

conveying means which transports a set of sheets from each of the bins to the trays and delivers the set of sheets onto the tray; and pressing means connected to the conveying means and which presses sets of sheets which have been delivered and stacked on the tray when a set of sheets is being delivered onto the tray, wherein the tray has a recess on its bottom surface; and the pressing means has a plurality of pressing members, at least one of which is disposed opposite the recess.

9. The sheet handling apparatus as claimed in claim 8, further comprising stapling means which staples a set of sheets, wherein the recess of the tray is formed at a position to receive a stapled portion of a set of sheets.

10. A sheet handling apparatus comprising:

a tray which can receive a large number of sheets thereon;

a plurality of bins among which sheets are distributed for sorting;

take-out means for taking out each set of sheets from each of the bins;

conveying means for receiving said each set of sheets taken out from each of the bins from the take-out means, transporting said each set of sheets from the plurality of bins to the tray and delivering said each set of sheets onto the tray; and pressing means connected to the conveying means and which presses sets of sheets which have been delivered and stacked on the tray when a set of sheets is being delivered onto the tray.

11. The sheet handling apparatus as claimed in claim 10, wherein the pressing means is disposed at an entrance side of the tray.

12. The sheet handling apparatus as claimed in claim 10, wherein the take out means includes a first pair of rollers which nips said each set of sheets and rotate to remove said each set of sheets from a respective bin.

13. The sheet handling apparatus as claimed in claim 12, wherein the conveying means includes a second pair of rollers which nips and holds said each set of sheets removed from said respective bin by the first pair of rollers during delivery of said each set of sheets to the tray, said second pair of rollers rotate near the entrance of the tray to deliver the held said each set of sheets onto the tray.

14. The sheet handling apparatus as claimed in claim 13, wherein the pressing means is connected to one roller of said second pair of rollers and moves to a position to press sets of sheets on the tray with the rotation of said second pair of rollers for delivery of said each set of sheets onto the tray.

15. The sheet handling apparatus as claimed in claim 14, wherein the pressing means releases the sets of sheets on the tray with reverse rotation of the second pair of rollers.

16. The sheet handling apparatus as claimed in claim 15, wherein the tray is disposed above the plurality of bins.

* * * * *